US012460911B2

(12) United States Patent
Lindsay et al.

(10) Patent No.: US 12,460,911 B2
(45) Date of Patent: Nov. 4, 2025

(54) PROGRESSIVE AMMUNITION PRESS SYSTEM

(71) Applicant: AOB Products Company, Columbia, MO (US)

(72) Inventors: Michael Lindsay, Columbia, MO (US); Michael Cottrell, Ashland, MO (US); Timothy S. Kinney, Warrenton, MO (US); Justin Burke, Columbia, MO (US); Paul Coryell, Columbia, MO (US); Brian Steere, Columbia, MO (US); Jarrod Grove, Columbia, MO (US); Kyle Martin, Columbia, MO (US); Kyle Mauzey, Columbia, MO (US); James Tayon, Moberly, MO (US); Curtis Smith, Columbia, MO (US)

(73) Assignee: AOB Products Company, Columbia, MO (US)

( * ) Notice: Subject to any disclaimer, the term of this patent is extended or adjusted under 35 U.S.C. 154(b) by 0 days.

(21) Appl. No.: 18/888,388

(22) Filed: Sep. 18, 2024

(65) Prior Publication Data

US 2025/0283706 A1 Sep. 11, 2025

Related U.S. Application Data

(62) Division of application No. 17/655,777, filed on Mar. 21, 2022, now Pat. No. 12,117,277.

(60) Provisional application No. 63/163,520, filed on Mar. 19, 2021.

(51) Int. Cl.

| | |
|---|---|
| ***F42B 3/00*** | (2006.01) |
| ***F42B 33/00*** | (2006.01) |
| ***F42B 33/02*** | (2006.01) |

(52) U.S. Cl.

CPC ..... *F42B 33/001* (2013.01); *F42B 33/02* (2013.01); *F42B 33/004* (2013.01)

(58) Field of Classification Search

CPC ..... F42B 33/00; F42B 33/001; F42B 33/002; F42B 33/004; F42B 33/02

USPC ..... 86/12, 18, 23, 25, 26, 27, 46

See application file for complete search history.

(56) References Cited

U.S. PATENT DOCUMENTS

| | | | |
|---|---|---|---|
| 2,031,850 | A | 2/1936 | Peterson |
| 2,383,008 | A | 8/1945 | Meister |
| 3,058,387 | A | 10/1962 | Hoyer |
| 3,440,923 | A | 4/1969 | Purdie |
| 3,483,792 | A | 12/1969 | Williams |
| 3,796,127 | A | 3/1974 | Deitemeyer |
| 3,862,567 | A | 1/1975 | Hildreth |
| 4,116,109 | A | 9/1978 | Ervine |
| 4,163,410 | A | 8/1979 | Dillon |
| 4,183,410 | A | 1/1980 | Dion-Biro |
| 4,331,063 | A | 5/1982 | Schaenzer |

(Continued)

*Primary Examiner* — James S Bergin

(74) *Attorney, Agent, or Firm* — Stinson LLP

(57) ABSTRACT

Progressive ammunition press system, components thereof, and associated methods. The press system may include a press control system integrated with the press. The press may include a case carriage including a case carrier supported by a bearing. Case retainer gates may be provided for retaining cases in the case carrier. A bullet feeding system can be arranged to permit bullet feeding and seating in a single station of the press. A primer feeder can be self-contained, gear-driven, and/or recirculating.

16 Claims, 62 Drawing Sheets

(56) References Cited

U.S. PATENT DOCUMENTS

| | | | | |
|---|---|---|---|---|
| 4,343,222 | A | 8/1982 | Dillon | |
| 4,522,102 | A | 6/1985 | Pickens | |
| 4,620,422 | A | 11/1986 | Hosokawa et al. | |
| 5,024,135 | A | 6/1991 | Bender | |
| 5,198,606 | A | 3/1993 | Storstad et al. | |
| 5,313,869 | A | 5/1994 | Lee | |
| 5,763,810 | A | 6/1998 | Lee | |
| 6,772,668 | B2 | 8/2004 | Shields | |
| 7,497,155 | B2 | 3/2009 | Koskela | |
| 7,549,363 | B2 | 6/2009 | Rote et al. | |
| 7,552,668 | B1 | 6/2009 | Gonzalez | |
| 7,552,669 | B1 | 6/2009 | Gonzalez | |
| 7,624,665 | B1 | 12/2009 | Lee | |
| 7,694,618 | B1 | 4/2010 | Lee | |
| 7,743,692 | B2 | 6/2010 | Jackson | |
| 7,770,503 | B2 | 8/2010 | de Almeida | |
| 8,683,906 | B2 | 4/2014 | Baxter et al. | |
| 8,783,509 | B2 | 7/2014 | Nordlund | |
| 9,151,583 | B1 | 10/2015 | Stark et al. | |
| 9,267,775 | B1 | 2/2016 | Kleinschmit | |
| 9,303,965 | B1 | 4/2016 | Dykstra | |
| 9,664,488 | B2 | 5/2017 | Pruett et al. | |
| 9,879,961 | B2 | 1/2018 | Pruett et al. | |
| 9,982,982 | B2 | 5/2018 | Pruett et al. | |
| 10,267,609 | B1 | 4/2019 | Richardson et al. | |
| 10,281,253 | B2 | 5/2019 | Stark et al. | |
| 10,619,984 | B2 | 4/2020 | Pruett et al. | |
| 10,639,657 | B2 | 5/2020 | Fontaine et al. | |
| 10,753,717 | B2 | 8/2020 | Stark et al. | |
| 10,794,676 | B1 | 10/2020 | Aerni | |
| 11,274,909 | B2 * | 3/2022 | Kinney | F42B 33/06 |
| 12,117,277 | B2 * | 10/2024 | Lindsay | F42B 33/02 |
| 12,181,260 | B2 * | 12/2024 | Lier | F42B 33/04 |
| 2002/0121184 | A1 | 9/2002 | Fowler | |
| 2006/0180011 | A1 | 8/2006 | Benn | |
| 2006/0180012 | A1 | 8/2006 | Benn | |
| 2019/0094000 | A1 | 3/2019 | Abel | |
| 2019/0257630 | A1 | 8/2019 | Stark et al. | |
| 2019/0368848 | A1 | 12/2019 | Carter et al. | |
| 2020/0217634 | A1 | 7/2020 | Pruett et al. | |
| 2024/0151505 | A1 * | 5/2024 | Ball | F42B 33/04 |

* cited by examiner

PROGRESSIVE AMMUNITION PRESS SYSTEM

CROSS-REFERENCE TO RELATED APPLICATIONS

The present application is a divisional of U.S. patent application Ser. No. 17/655,777, filed Mar. 21, 2022, which claims priority to U.S. Provisional Application No. 63/163,520, filed Mar. 19, 2021, the entireties of which are hereby incorporated by reference.

FIELD

The present disclosure generally relates to firearm ammunition manufacturing equipment, and more particularly to a progressive ammunition press system and associated components and methods.

BACKGROUND

Persons manufacturing or reloading firearm ammunition often use various types of equipment. A variety of types of ammunition presses are available for such purposes. Progressive presses permit a user to complete multiple operations in successive stations of the press.

SUMMARY

In one aspect, a progressive ammunition press system comprises a frame configured to be supported by a support surface. A case carrier is supported by the frame. The case carrier includes multiple case holders each configured to hold an ammunition case. The case carrier is moveable with respect to the frame to move the case holders to a plurality of stations. A tool head is supported by the frame. The tool head comprises a plurality of press accessory mounts. The tool head is moveable with respect to the case carrier. A drive system is operatively connected to the tool head to move the tool head with respect to the case carrier. An electrical power input port is supported by and moveable with the tool head. An electrical power output port supported by and moveable with the tool head and operatively coupled to the electrical power input port to receive power therefrom.

In another aspect, a progressive ammunition press system comprises a frame configured to be supported by a support surface. A case carrier supported by the frame includes multiple case holders each configured to hold an ammunition case. The case carrier is moveable with respect to the frame to move the case holders to a plurality of stations. A tool head supported by the frame comprises a plurality of press accessory mounts. The tool head is moveable with respect to the case carrier. A drive system is operatively connected to the tool head to move the tool head with respect to the case carrier. A communications output port is supported by and moveable with the tool head. A communications input port is supported by and moveable with the tool head and operatively coupled to the communications output port to transmit communication signals to the communications output port.

In yet another aspect, a progressive ammunition press system comprises a frame configured to be supported by a support surface. A case carrier supported by the frame includes multiple case holders each configured to hold an ammunition case. The case carrier is moveable with respect to the frame to move the case holders to a plurality of stations. A tool head supported by the frame comprises a plurality of press accessory mounts. The tool head is moveable with respect to the case carrier. A drive system is operatively connected to the tool head to move the tool head with respect to the case carrier. A communications port is supported by the frame. A press controller is supported by the tool head. A tangible storage medium is supported by the tool head and stores press controller executable instructions to generate a command signal to control an operation of the ammunition press system based on a sensor signal received from the communications port.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
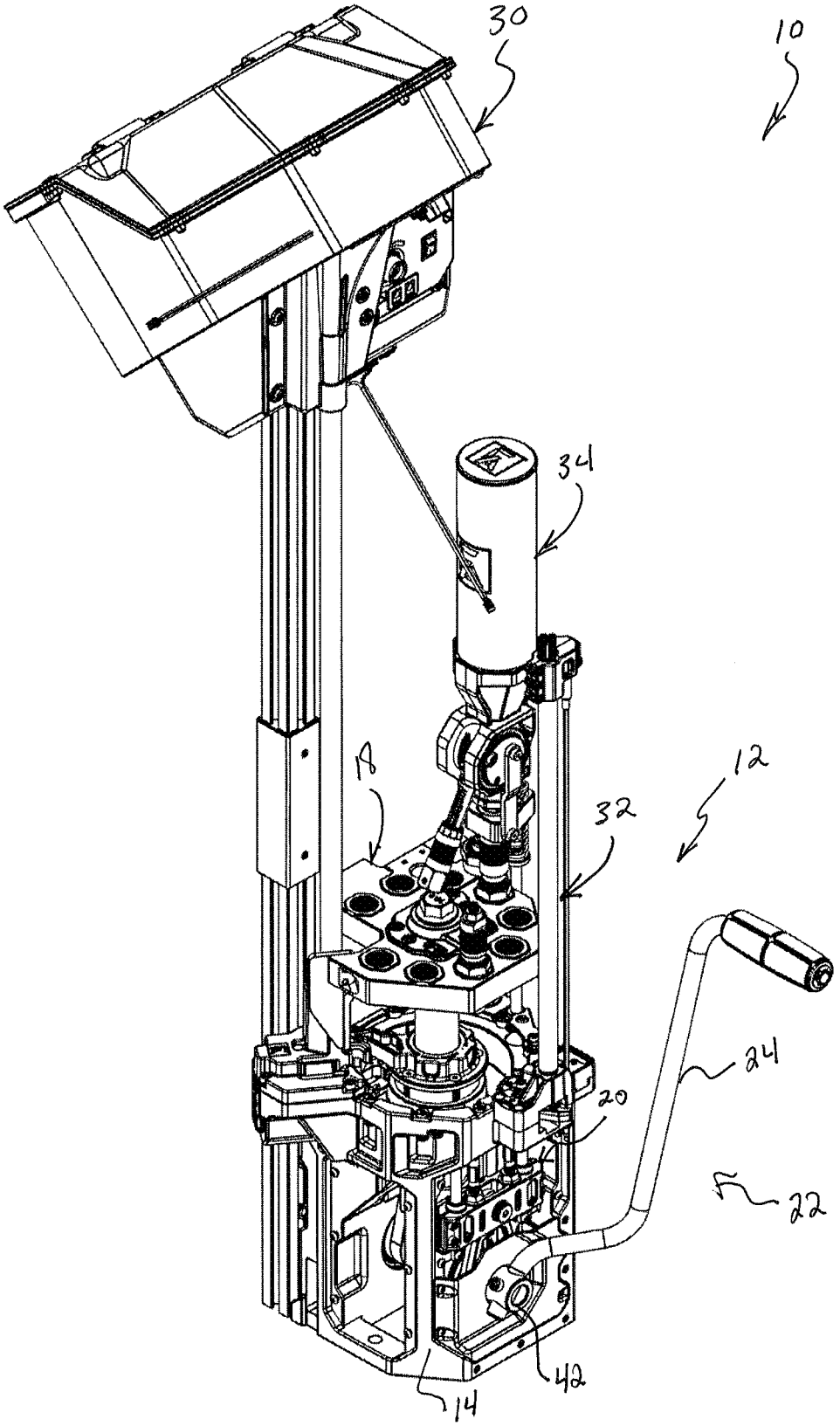
FIG. 1 is a front perspective of a progressive ammunition press system of the present disclosure.
Figure 2:
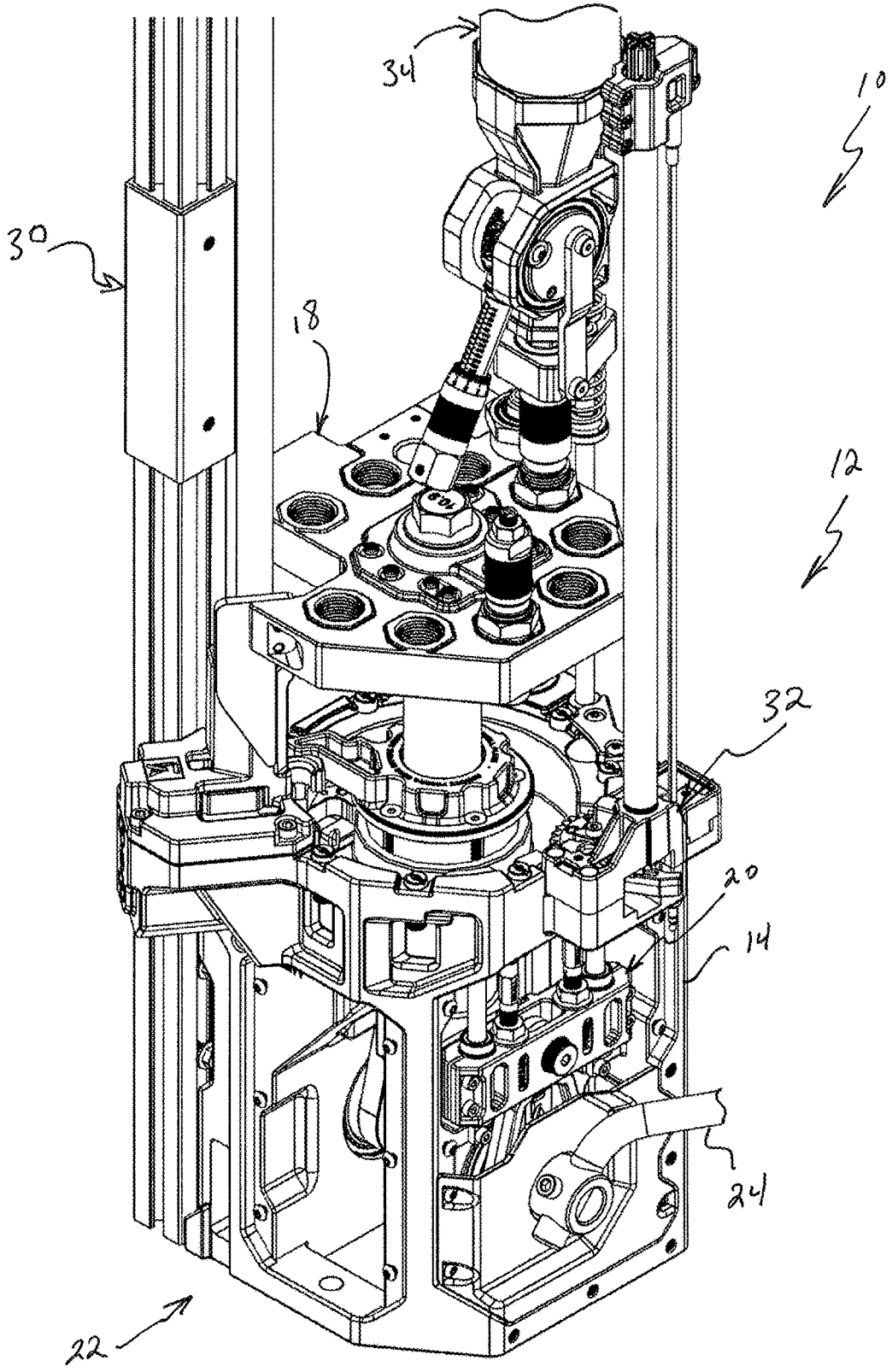
FIG. 2 is an enlarged fragmentary perspective of the ammunition press system similar to the view of FIG. 1.
Figure 3:
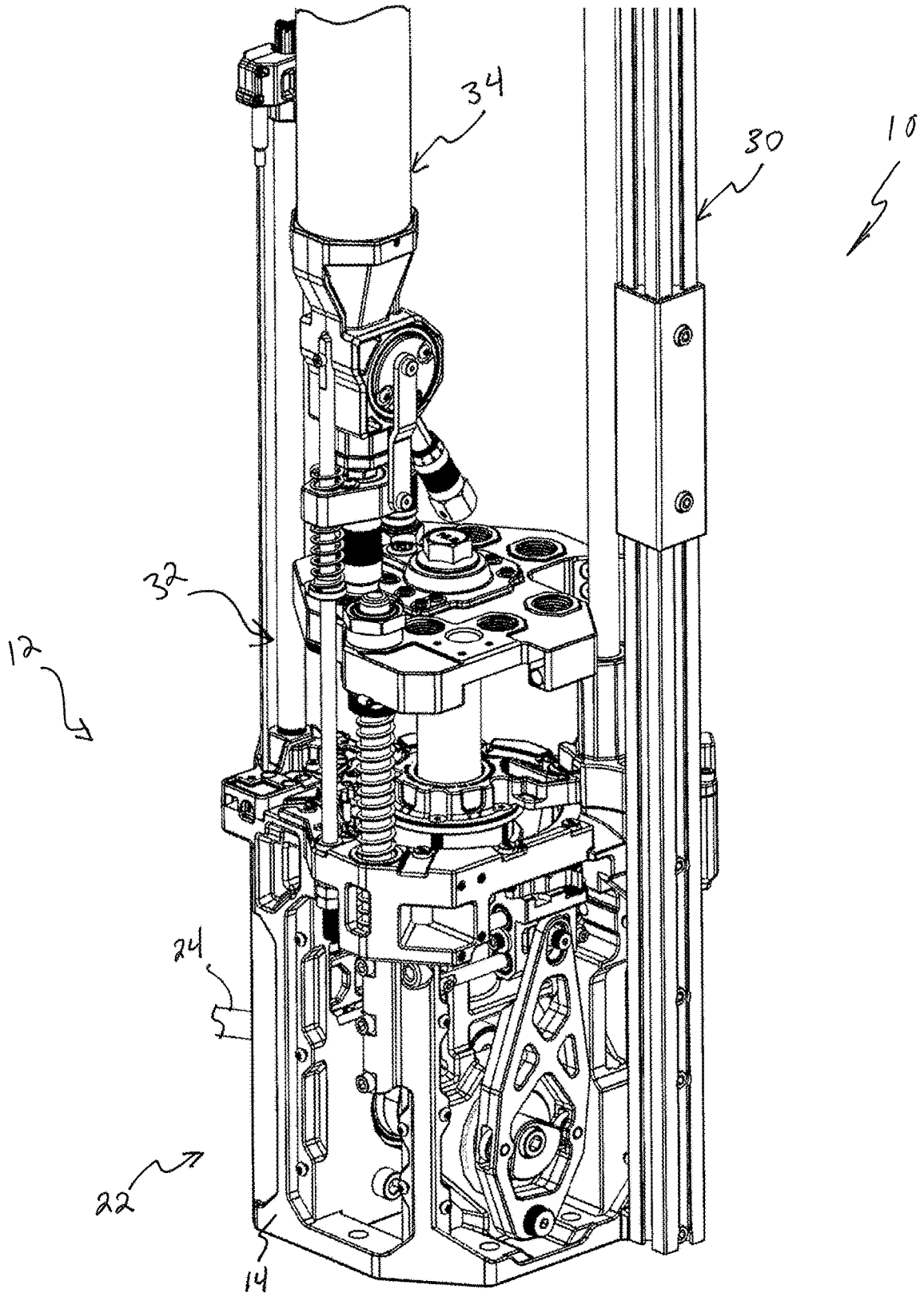
FIG. 3 is an enlarged rear fragmentary perspective of the ammunition press system.

Referring to FIGS. 1-3, a progressive press system of the present disclosure is generally indicated by the reference number 10. As explained in further detail below, the press system is configured to manufacture (e.g., reload) firearm ammunition. The press system can be configured to receive bulk ammunition component materials, such as ammunition cases (sometimes referred to as shells), primers, ammunition powder, and bullets, and assemble the components into ammunition cartridges. The press system includes several improvements relative to conventional systems.

The press system 10 includes an ammunition press 12 and a plurality of press accessories. Referring to FIGS. 2 and 3, the press includes a frame 14, a case carriage 16 (see FIGS. 10-14), an upper tool head 18, a lower tool head 20, and a drive system 22. The frame 14 supports components of the press system and defines a base for resting on a support surface such as a table or reloading bench. The case carriage 16 is configured to carry cases to multiple stations for working the cases and/or assembling the ammunition cartridges. Accessories are mountable on the tool heads 18, 20 to be associated with respective stations to which the cases are indexed. The upper tool head 18 is configured to hold accessories to move up and down above the cases held by the case carriage. The lower tool head 20 is configured to hold accessories (e.g., swaging and priming pins) to move up and down below the cases. The drive system 22 (broadly, "press driver") is configured to turn the cases through the series of stations and to cause movement of the tool heads 18, 20. The drive system 22 includes an actuation lever 24 including a handle by which a user can manually operate the press 12. Alternatively, an automatic actuator 26 including a motor 28 can be used, as described further below with reference to FIG. 62. After each downward stroke of the tool head 18, the cases are indexed to the next stations.

The press system 10 includes press accessories such as dies and/or tools, and other types of accessories, such as feeders and dispensers. The press accessories are mountable on the press 12, such as on the frame 14 and/or on the tool heads 18, 20. As shown in FIG. 1, the illustrated accessories include a case feeder 30, a primer feeder 32, and a powder dispenser 34. Other accessories, such as a bullet feeder 36 (e.g., see FIGS. 53-58), other types of dies and tools, etc., can be used as well, without departing from the scope of the present disclosure.

Figure 4:
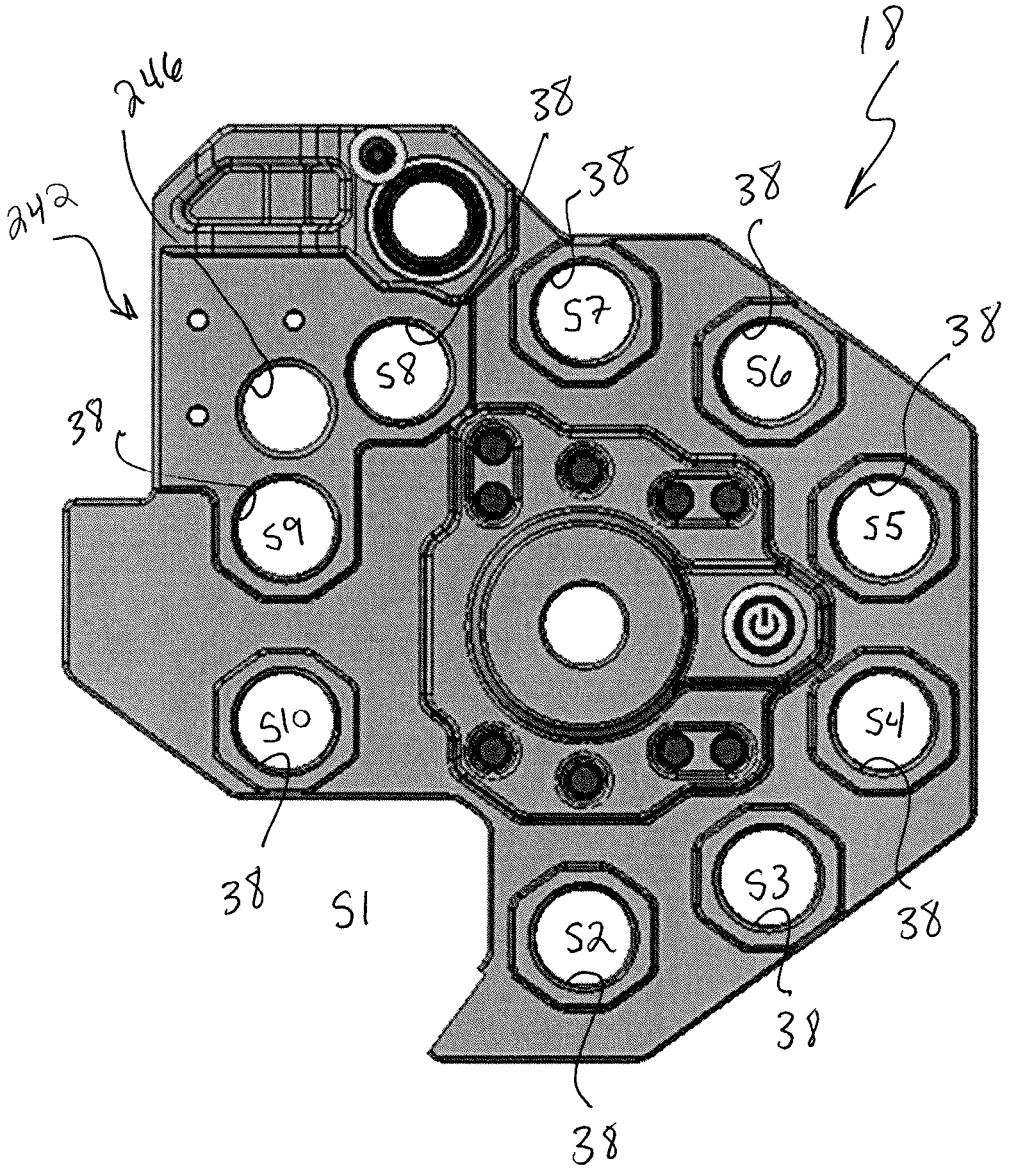
FIG. 4 is a top view of an upper tool head of the ammunition press system.

In the illustrated embodiment, the press 12 includes ten stations S1-S10, which will be explained initially with respect to FIG. 4. It will be appreciated that the stations can be defined by various components of the press system 10, including the frame 14, the upper tool head 18, and the lower tool head 20. The stations S1-S10 are locations to which the carriage 16 indexes cases to be worked on by accessories associated with the respective stations. As shown in FIG. 4, the upper tool head 18 includes accessory mounts 38 (e.g., die mounts) corresponding to nine of the ten stations. The accessory mounts 38 can be configured to receive standard ⅞-14 unc dies (e.g., "threaded die mount opening"). In the illustrated embodiment, each station except for the first station S1 has an associated threaded die mount opening. The first station S1 is designated for feeding cases to the press. The remainder of the stations S2-S10 can be configured as desired by the user by mounting accessories on the tool heads 18, 20 to set up the press 12 for performing various operations. The cases are ejected from the case carriage 16 between the tenth station S10 and the first station S1.

For example, the press system 10 can be configured to execute a single pass processing operation. The ten stations S1-S10 provide ample locations to work cases such that a single pass processing operation is possible. In single pass processing, all operations required to load ammunition are performed in a single rotation of the case carriage 16, from the case feed station S1 to ejection, with minimal case processing (e.g., sorting, case lube (optional)) prior to inserting the case into the press system. Single pass processing can include (e.g., at a minimum) the following: decapping (i.e., removal of a spent primer), sizing (e.g., forming a fired case back to original size), priming (i.e., installation of a new primer), powder drop (i.e., dispensing of a measured powder charge), bullet feeding (feeding a bullet to a mouth of a case), bullet seating (pushing the bullet to a seated depth in the case mouth). Single pass processing can also include case lube, primer pocket swaging, case trimming, neck expansion (can be combined with powder drop), powder drop, powder check, bullet crimp (can be combined with bullet seating). Other steps and variations can be used. A variety of press accessories, such as dies and/or tools can be mounted on the press to implement a variety of single-pass processes, as desired by the user.

It will be appreciated that the press system 10 can be configured for multi-pass processing, without departing from the scope of the present disclosure. In multi-pass processing, the same general operations as single-pass processing can be performed, but are accomplished for each case in two or more rotations of the case carriage 16. Cases can be run as a batch through the press for initial processing. Then the configuration of the press 12 is changed, and the cases are run through a second time. Multi-pass processing provides an increased number of available stations if the user desires to perform operations at more than ten stations. Multi-pass processing can also provide smoother operation during powder metering and bullet feeding/seating if performed in a second pass, after performing decapping and resizing operations in a first pass.

Figure 5:
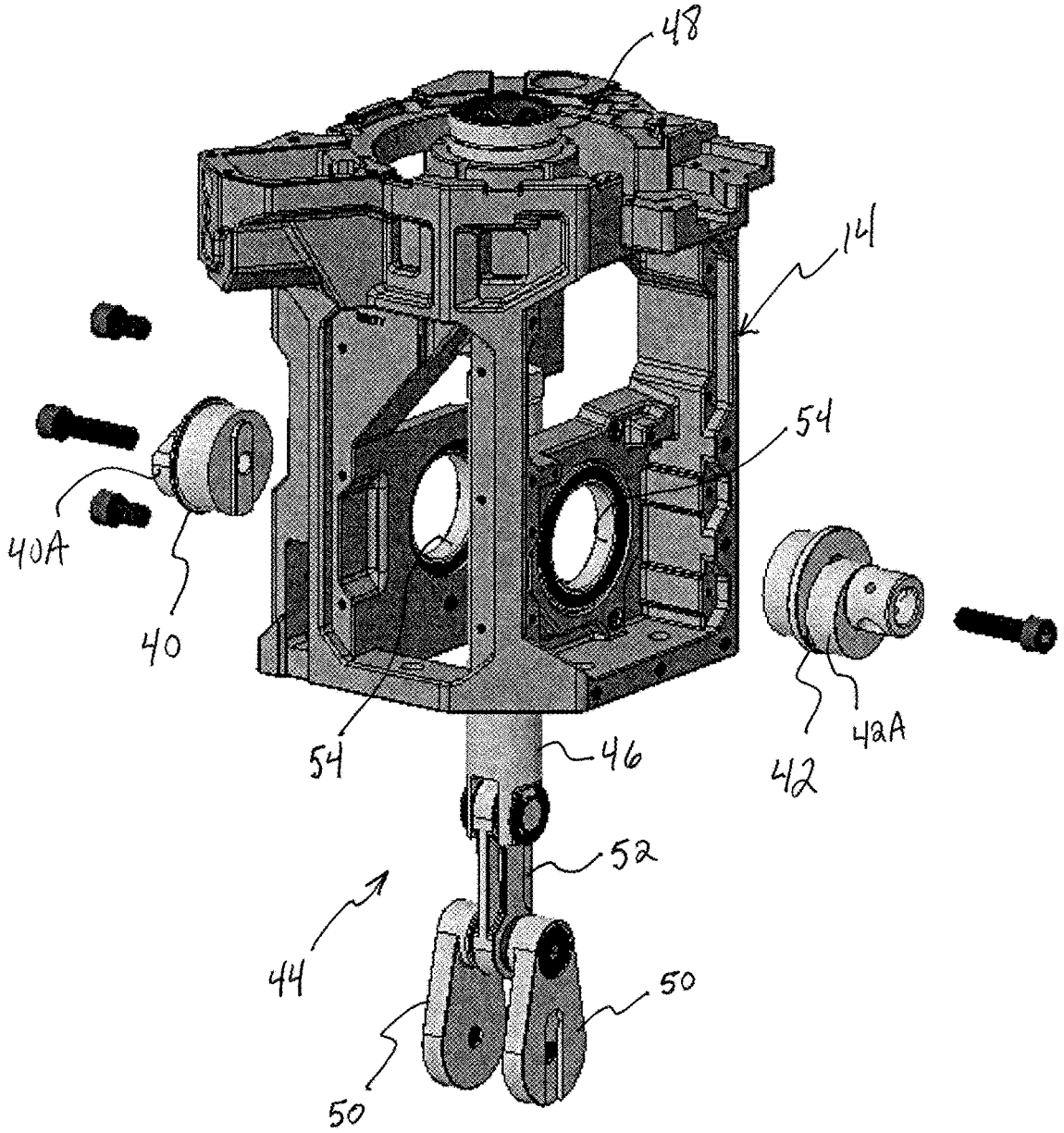
FIG. 5 is a perspective of a frame and drive components of the ammunition press system.
Figure 6:
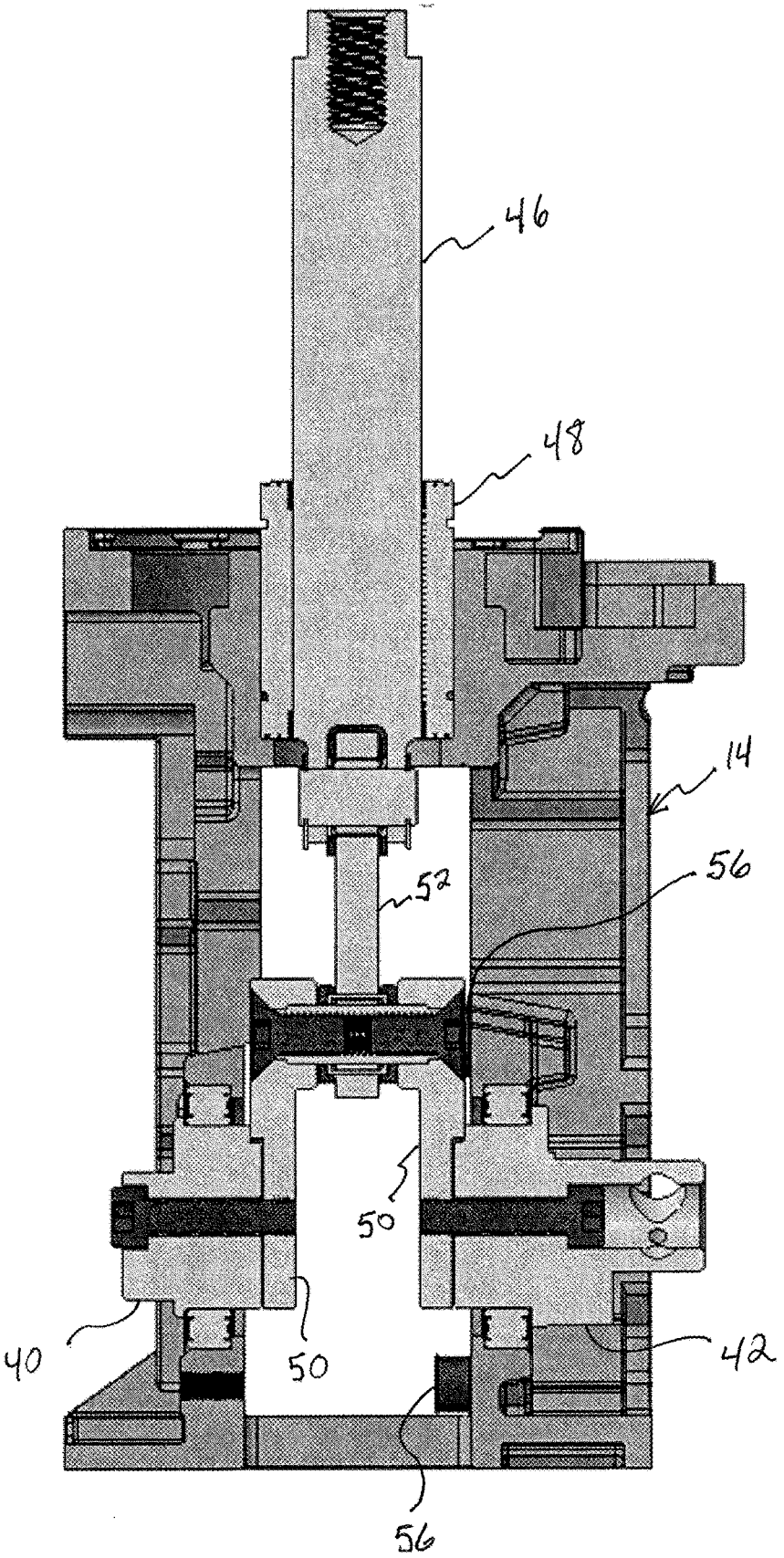
FIG. 6 is a section of the frame with the drive components.
Figure 7:
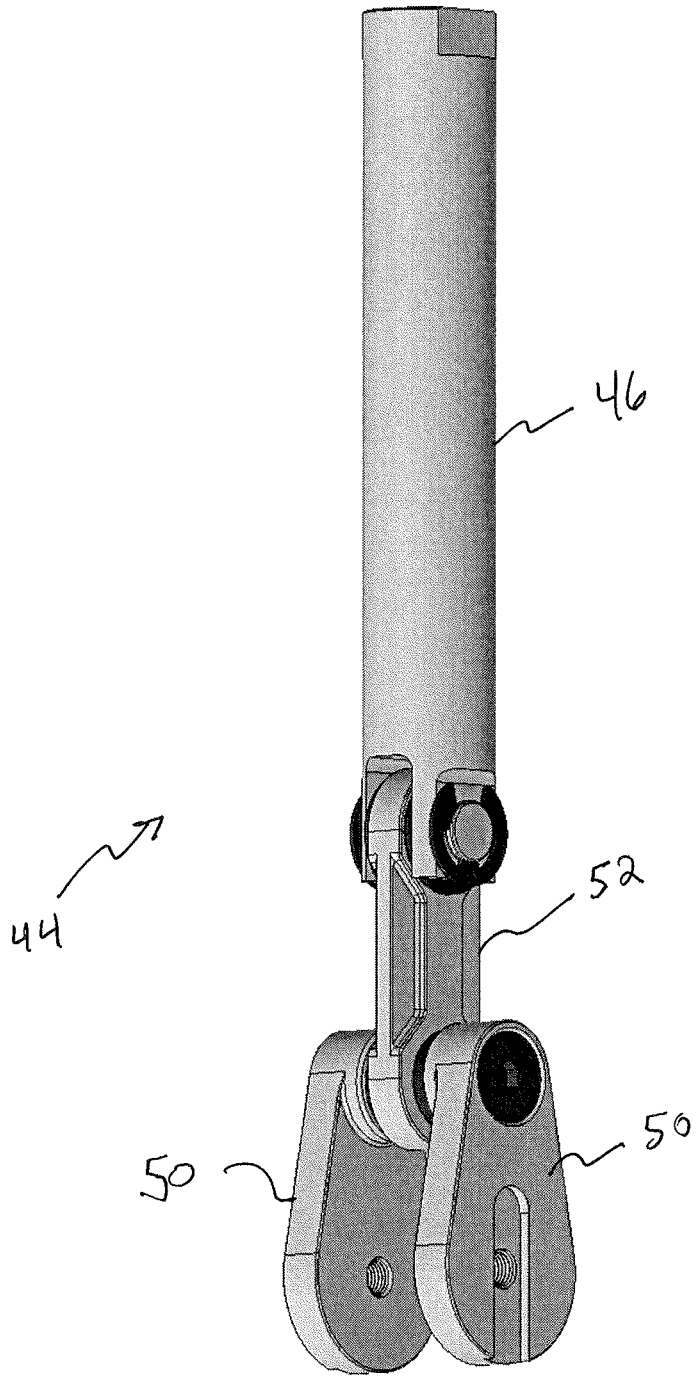
FIG. 7 is a perspective of drive components.
Figure 8:
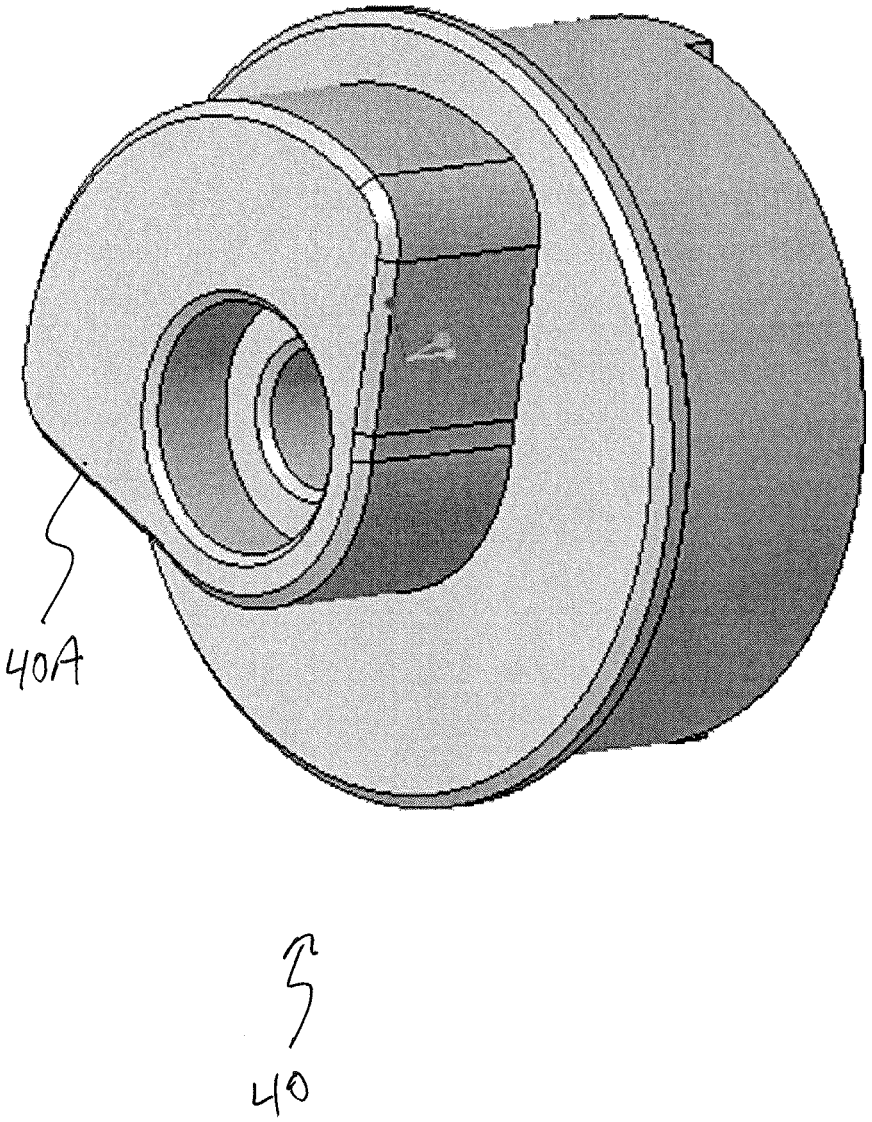
FIG. 8 is a perspective of a journal shaft.
Figure 9:
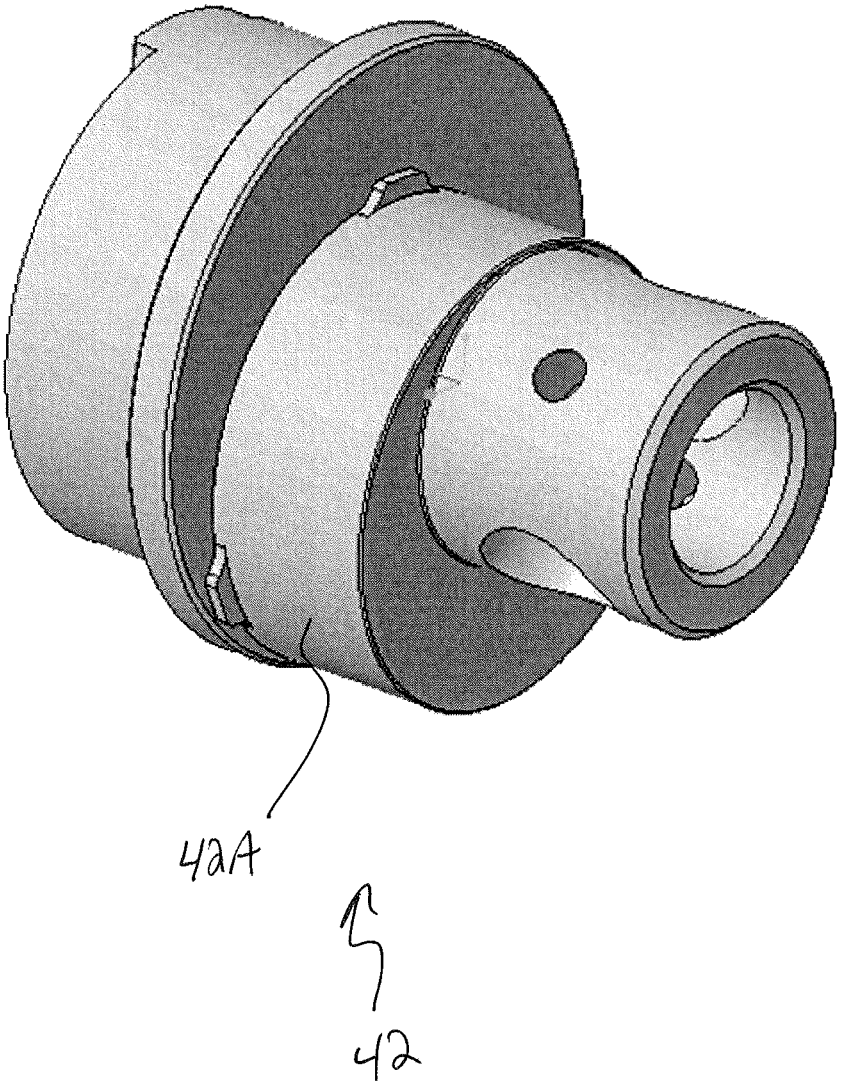
FIG. 9 is a perspective of another journal shaft.
Figure 10:
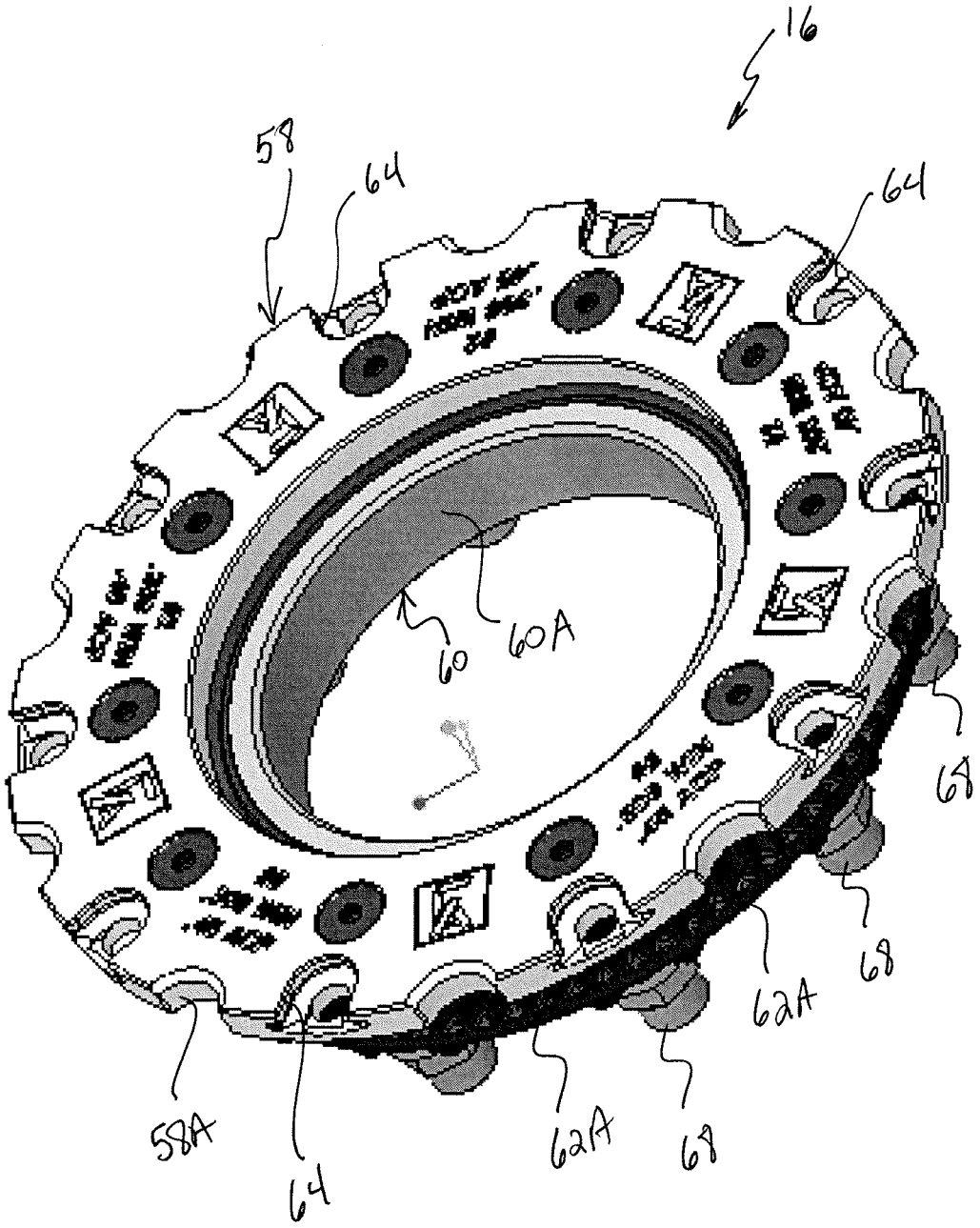
FIG. 10 is a perspective of a case carriage of the ammunition press system.
Figure 11:
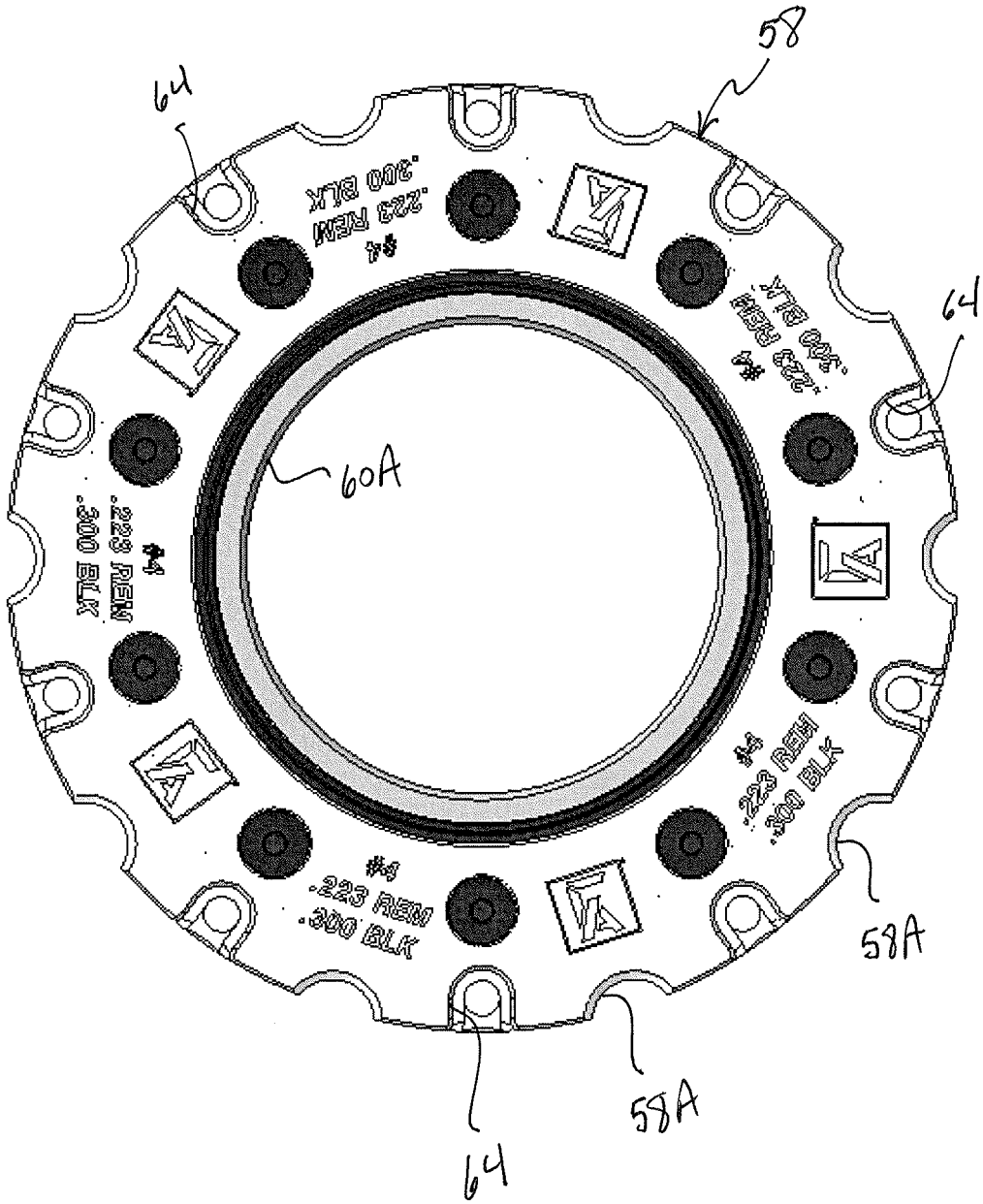
FIG. 11 is a top view of the case carriage.
Figure 12:
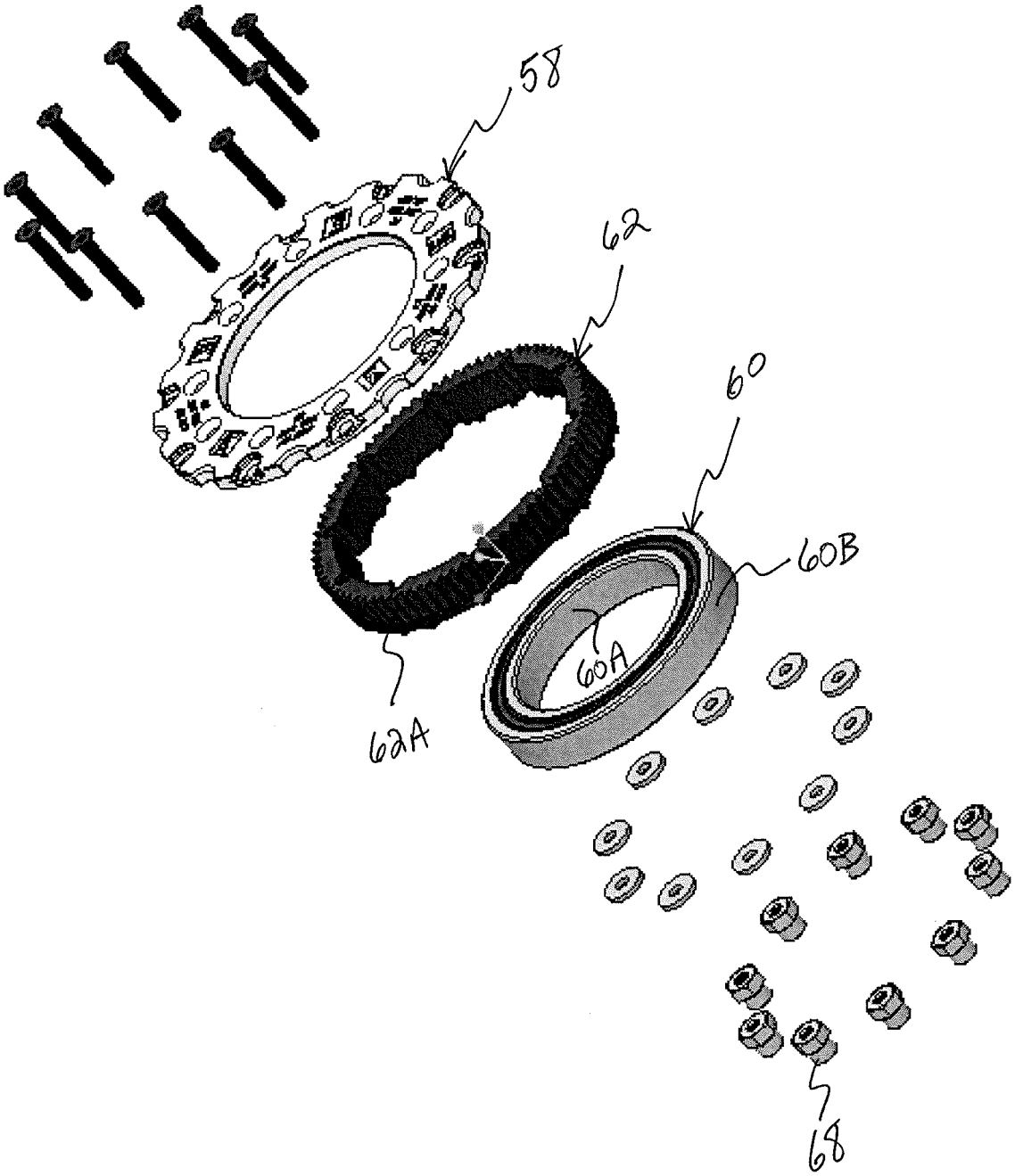
FIG. 12 is an exploded perspective of the case carriage.

Referring to FIG. 5, the frame 14 can be made of cast iron or another suitable material. The frame 14 includes an upper face and a lower base for resting on a support surface. The frame serves as supporting structure for components of the press system 10.

Referring to FIGS. 1 and 5-9, the drive system 22 includes the actuator 24, and a drive train for moving the tool heads 18, 20 and indexing the case carriage 16. The drive train (broadly, linkage) includes a left (first) journal shaft 40, a right (second) journal shaft 42, and a throw assembly 44. The throw assembly 44 includes a crank assembly and a ram 46. The ram 46 extends upward through a linear bearing 48 in the top of the frame and includes a threaded opening and flats (collectively, tool head mount) for mounting the upper tool head on the ram. The crank assembly includes left and right crank throws 50 connected to the ram via a link 52. The link 52 is connected to the bottom of the ram 46 by a pivot connection and to the crank throws 50 by another pivot connection. The crank throws 50 are keyed with the respective journal shafts 40, 42 for conjoint rotation with the journal shafts. The journal shafts 40, 42 are received in bearings 54 in respective left and right sides of the frame 14. The journal shafts 40, 42 include lips to capture the bearings 54 in the frame 14 and center the throw assembly 44 between the bearings. Two screws 56 are threaded in the frame 14 to define stops to limit rotation of the crank throws 50 to about 180 degrees. The lower screw 56 defines the bottom travel extent of the ram 46, and the top screw 56 defines the top travel extent of the ram. As shown in FIG. 1, the lever 24 is connected to a hub of the right journal shaft 42. The arrangement is such that the actuator lever 24 can be moved in an actuation cycle including a downward stroke and an upward stroke. The journal shafts 40, 42 and crank throws 50 pivot conjointly with the lever 24. In the downward (actuation) stroke of the lever 24, the ram 46 and thus the upper tool head 18 move downward, and in the upward (return) stroke, the ram and upper tool head move upward. The tool head 18 is lowered by the throw assembly 44 to reach bottom dead center at the rotational limit of the actuator lever defined by the lower screw 56. The journal shafts 40, 42 include cams 40A, 42A configured to transmit force from the journal shafts to other components of the drive system 22 to coordinate indexing of the case carriage 16 and movement of the lower tool head 20 and the upper tool head 18. As the upper tool head 18 reaches bottom dead center, the lower tool head 20 reaches top dead center. After each downward movement of the upper tool head 18, the drive system 22 indexes the case carriage 16 to move the cases to the next stations.

The drive system 22 can have other configurations without departing from the scope of the present disclosure. For example, components thereof (e.g., the linear bearing) may be omitted.

Referring to FIGS. 10-14, the case carriage 16 is configured to hold ten cases at a time for moving the cases through the ten stations S1-S10. The case carriage 16 includes an annular case carrier 58 (e.g., "shell plate"), a bearing 60, and a gear 62. The case carrier 58 includes a plurality of case holders 64 each configured to hold a single case. The case holders 64 each include a side opening permitting a case to slide laterally into the case holder, and a lip to capture a flange of the case to retain the case in the case holder. The cases can be loaded into the case carrier 58 by hand or using the case feeder. Different case carriers (with different sizes of case holders) are used for cases of different sizes. A kit of case carriers 58 can be used (interchangeable with the same bearing and gear). Alternatively, a kit of case carriages 16 each including a case carrier, bearing, and gear, can be used.

The bearing 60 includes an inner race 60A, an outer race 60B, and a plurality of balls captured therebetween. The bearing 60 facilitates rotation of the case carrier 58 to move the case holders 64 to the stations S1-S10.

The gear 62 is annular and includes a plurality of teeth 62A. The gear is sized to receive the bearing in the gear. The teeth 62A are configured to coordinate operation of the primer feeder with the case carriage, as explained in further detail below.

Figure 41:
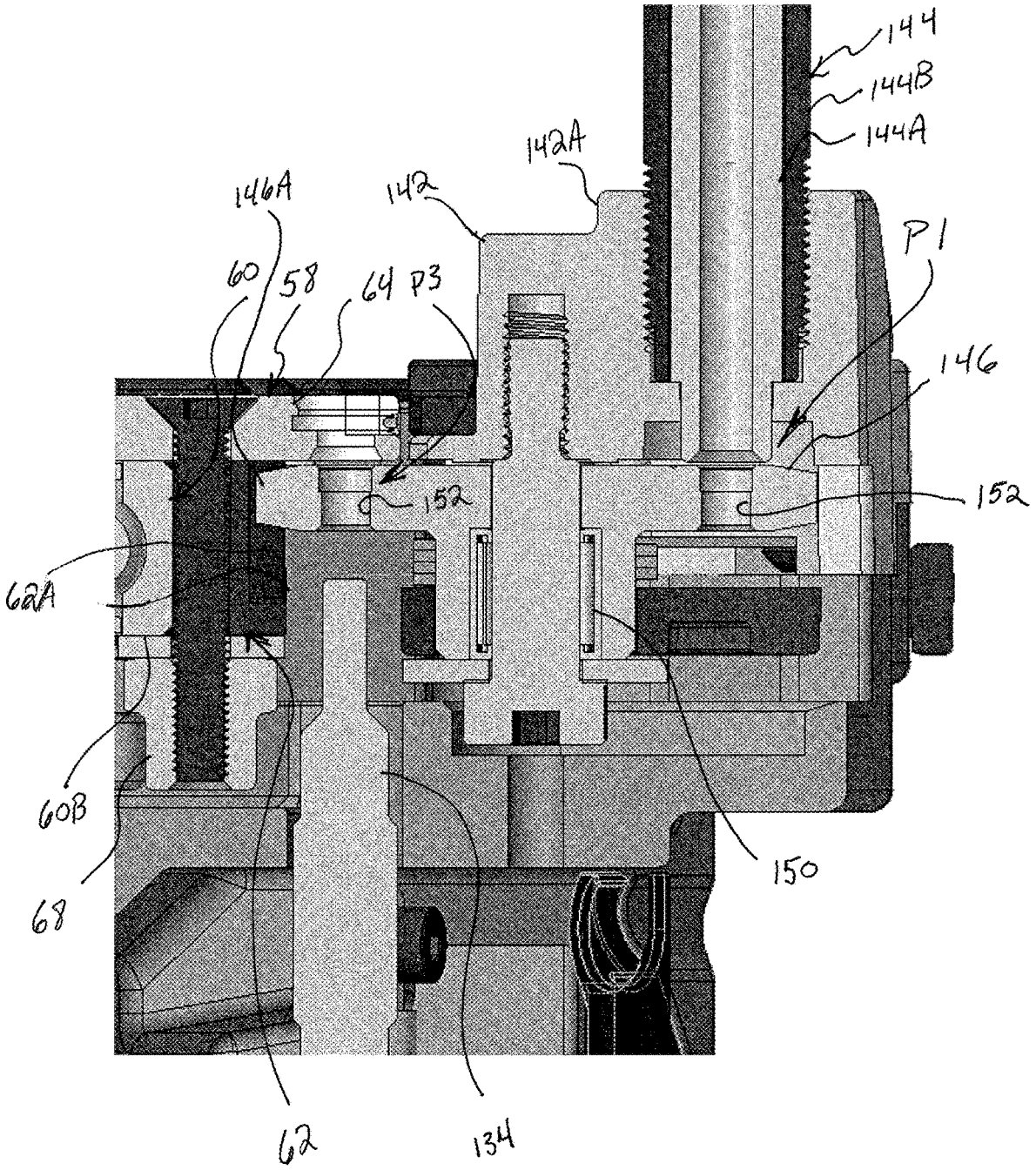
FIG. 41 is an enlarged fragmentary section of the primer feeder mounted on the frame.

The case carrier 58 is connected to the bearing 60 and gear 62 using a plurality of fasteners. Heads of the fasteners abut the case carrier 58, and opposite ends of the fasteners receive washers and nuts. As shown in FIG. 41, the washers abut a bottom side of the gear 62 and a bottom side of the outer race 60B of the bearing 60. The nuts are tightened to press the upper side of the gear 62 and the upper side of the outer race 60B against the bottom of the case carrier 58. The nuts serve as indexing lugs 68 by which the drive system 22 rotates the case carrier 58, as will be explained further below. Bottom ends of the nuts are rounded to facilitate engagement by the drive system 22.

Figure 13:
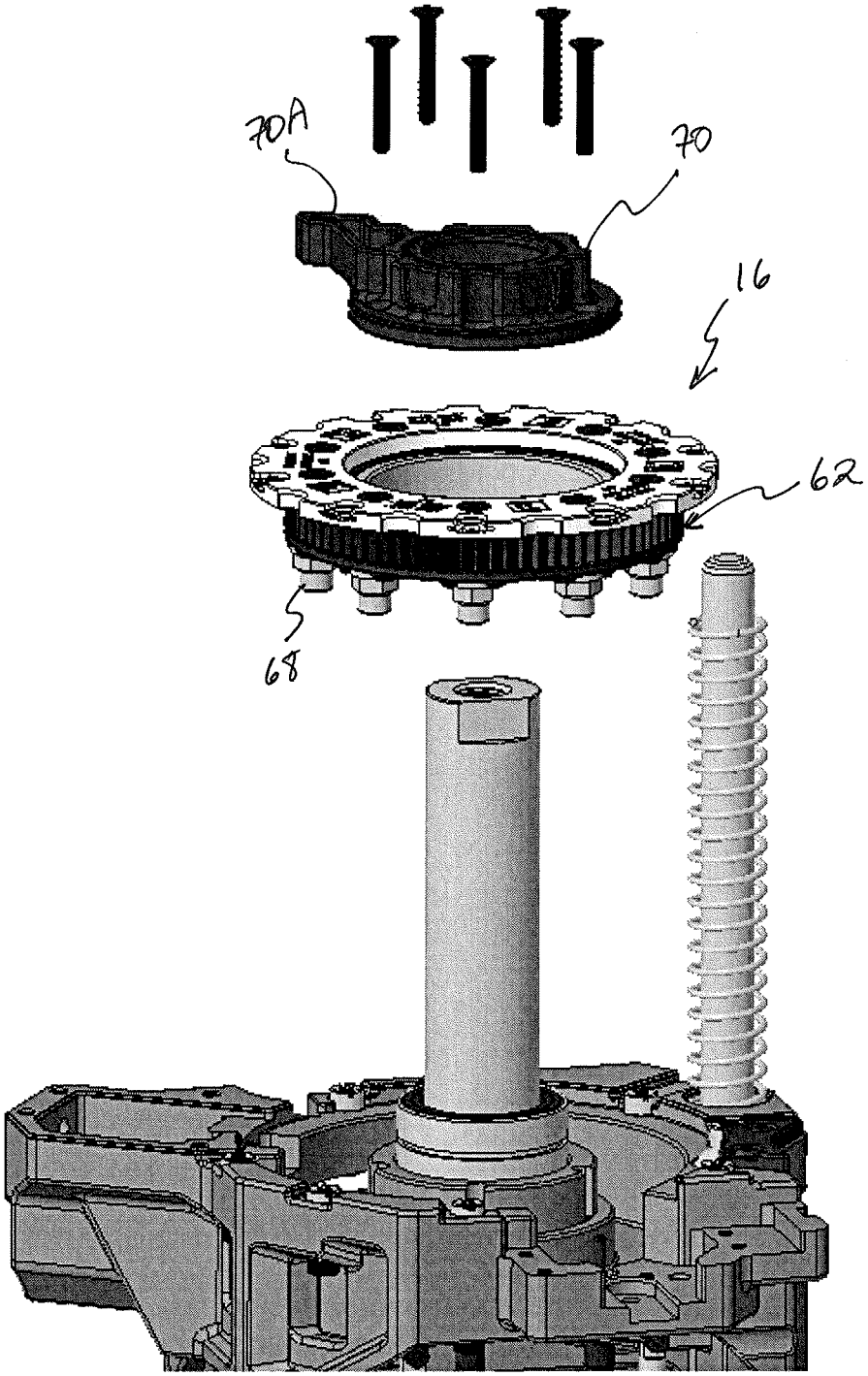
FIG. 13 is a fragmentary exploded perspective of the case carriage, frame, and drive components.

As shown in FIG. 13, the upper face of the frame 14 defines an annular recess (broadly, "case carriage receiver") configured to receive the case carriage 16. The annular recess is defined in part by a central boss over which the case carriage is receivable. When the case carriage 16 is in the annular recess, the inner race 60A of the bearing 60 rests on the frame 14 to locate the case carriage with respect to the frame. The case carriage 16 is secured to the frame by a case carriage retainer 70 (e.g., "bearing clamp") secured to the frame via a plurality of fasteners. The case carriage retainer 70 engages the inner race 60A of the bearing. The arrangement is such that the outer race 60B of the bearing is free from engagement with the frame 14 to isolate the case carrier 58, gear 62, and indexing lugs 68 from the frame to facilitate their rotation with respect to the frame. The case carriage retainer 70 includes an arm 70A configured to deflect cases out of the case carrier 58 between the tenth station S10 and first station S1 so a new case can be inserted in the case carrier at the first station.

A detent ball 72 and associated spring are captured in a pocket in the frame by a ball retainer 74 and are configured to hold the case carrier 58 in position with the case holders 64 at the stations S1-S10. The spring biases the ball 72 upward for reception in notches 58A (broadly, "indexing openings") spaced around a periphery of the case carrier 58 to index movement of the case carrier and retain the case holders 64 at the stations. When sufficient rotational force is applied to the case carrier 58 by the drive system 22, the ball 72 is dislodged from one of the notches 58A and rides on an underside of the case carrier until reaching the next notch.

Figure 14:
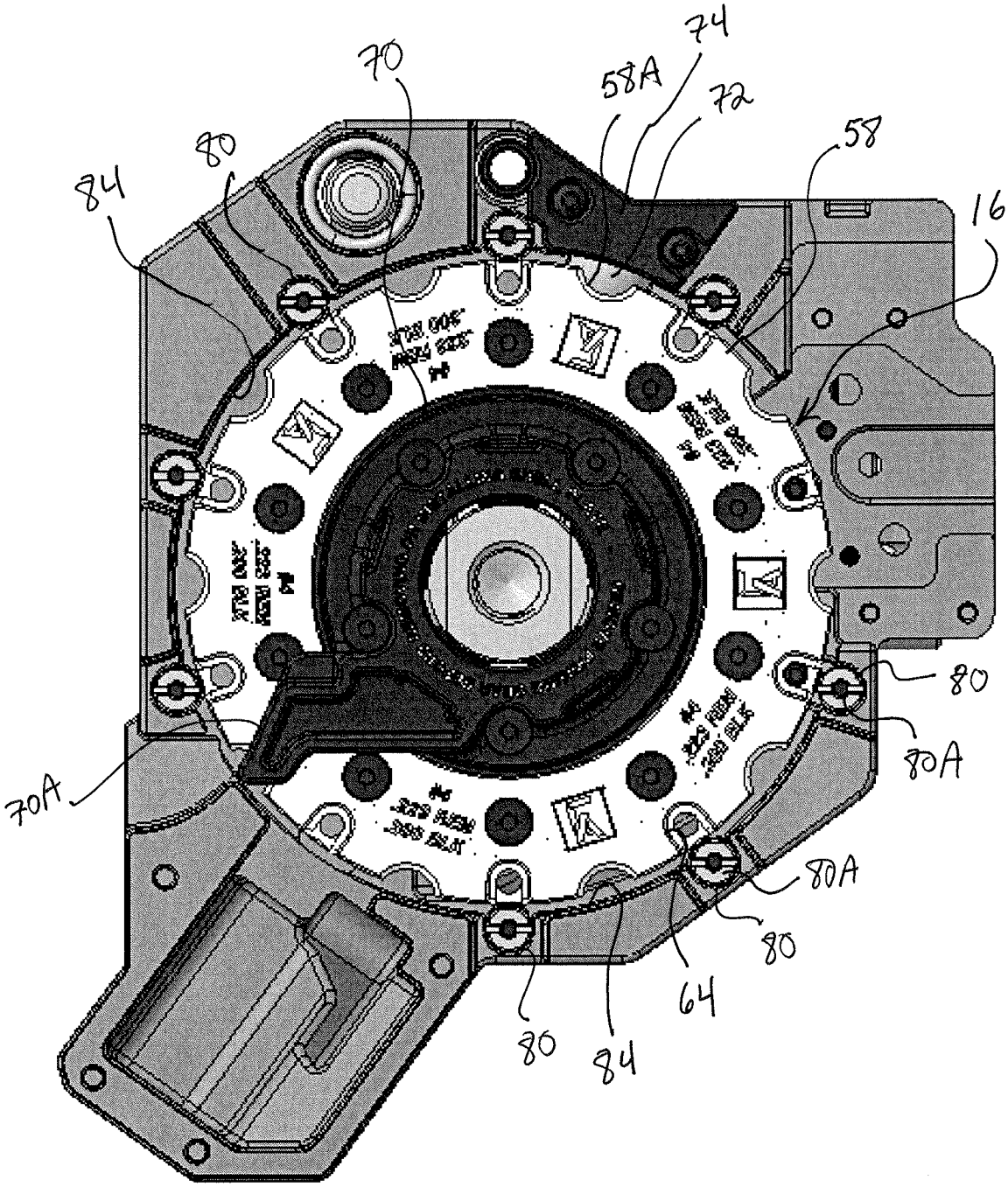
FIG. 14 is a top view of the case carriage installed on the frame.
Figure 15:
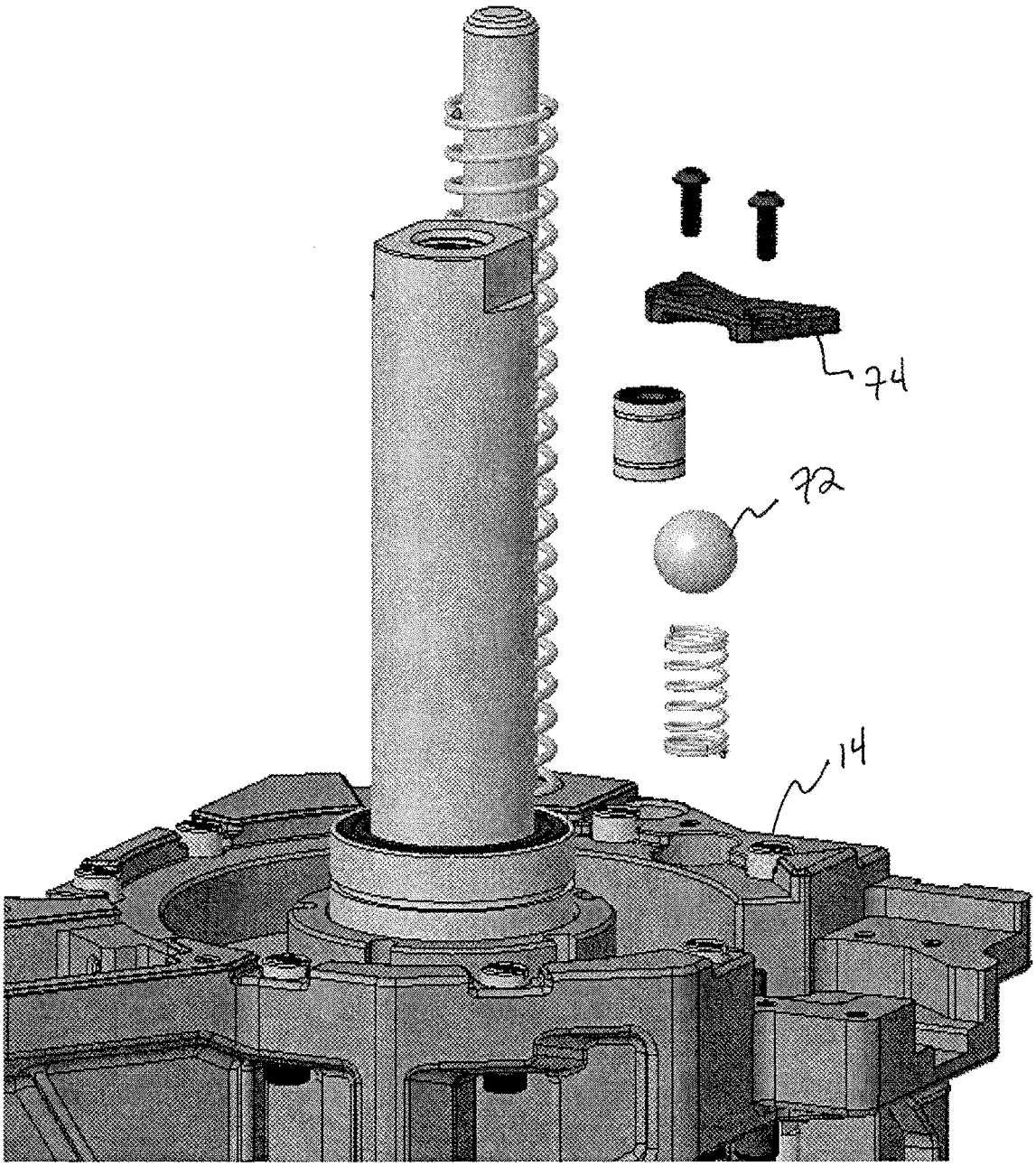
FIG. 15 is a fragmentary exploded perspective of a ball detent for engagement with the case carriage.
Figure 16:
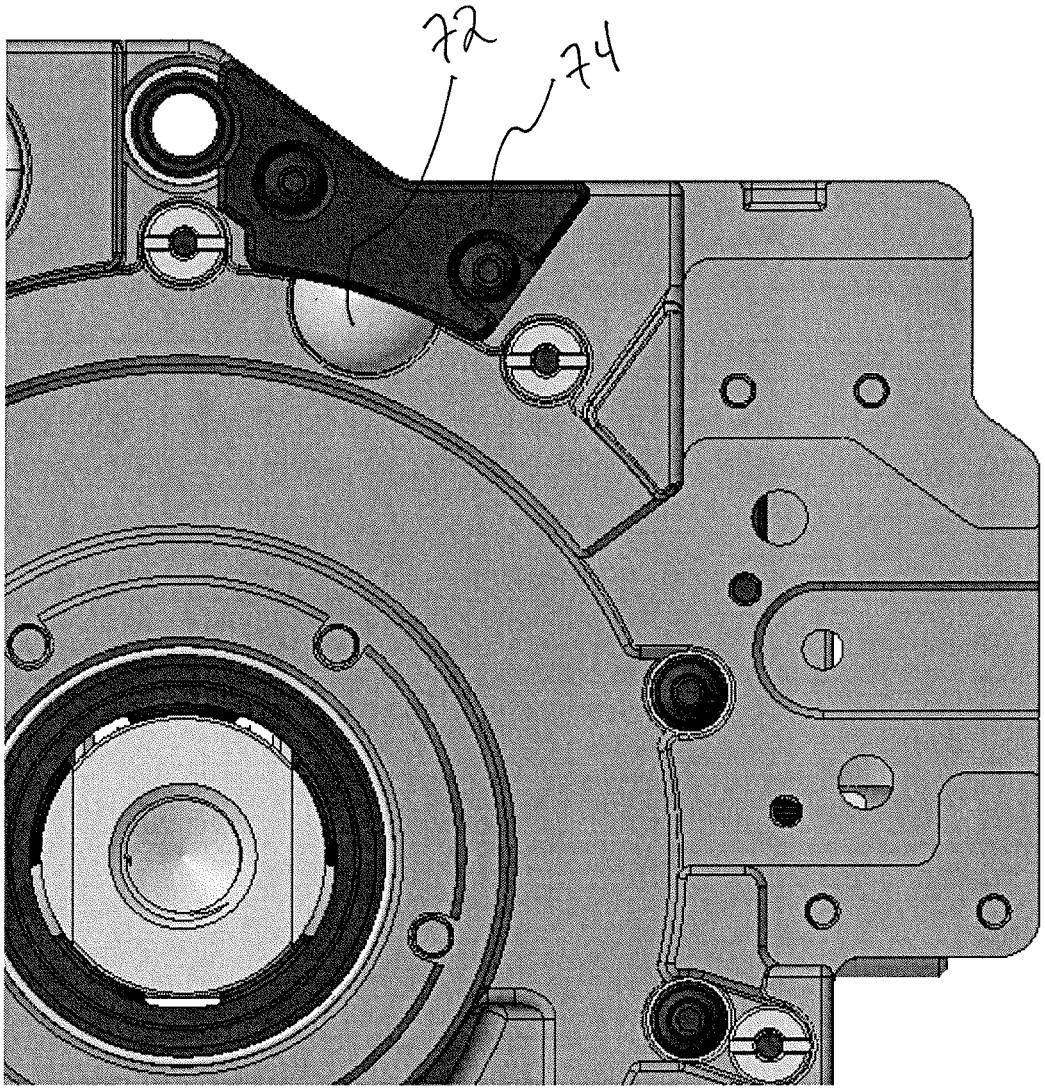
FIG. 16 is a top view of the ball detent installed on the frame.
Figure 17:
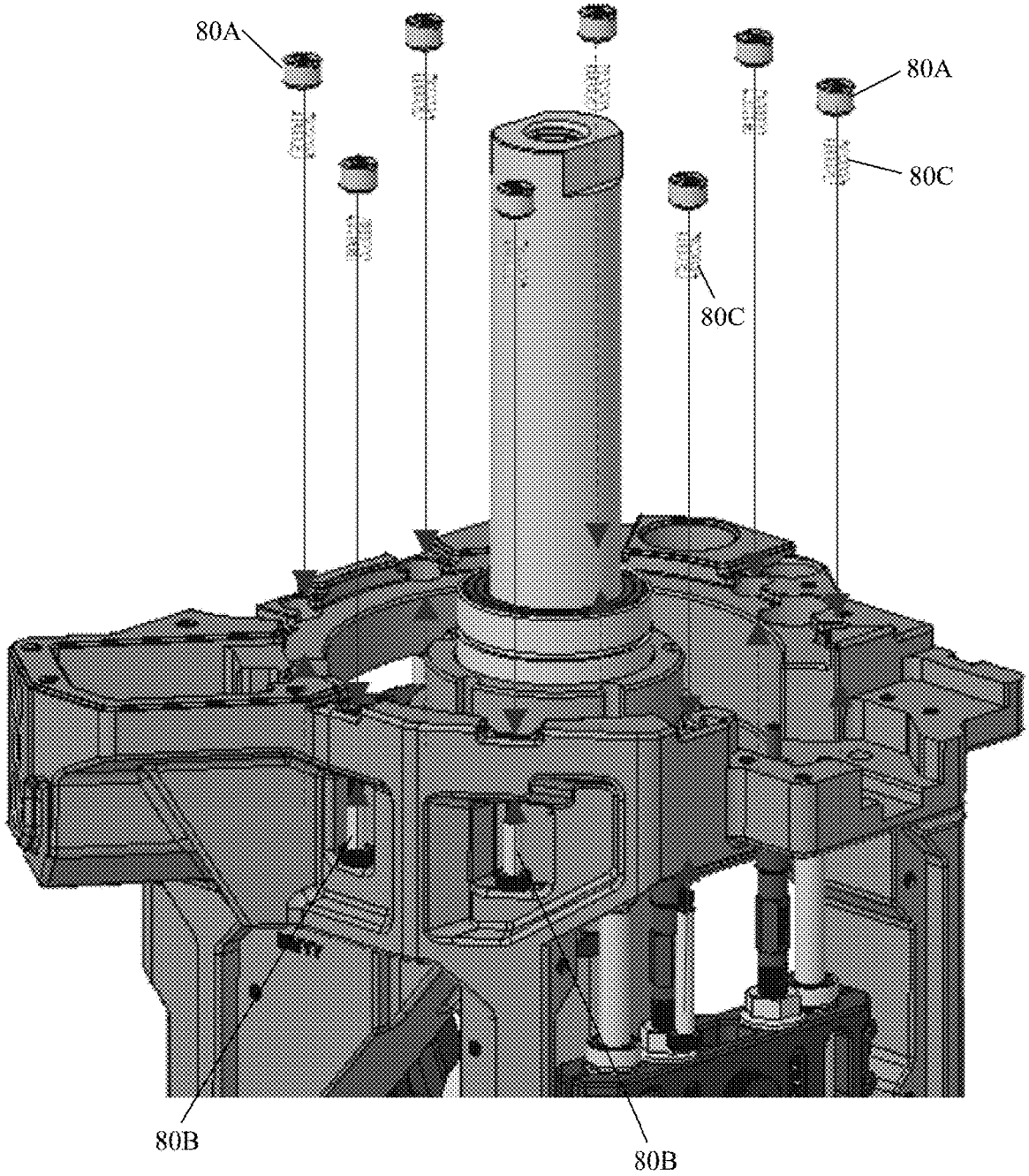
FIG. 17 is a fragmentary exploded perspective of case retainers and the frame.
Figure 18:
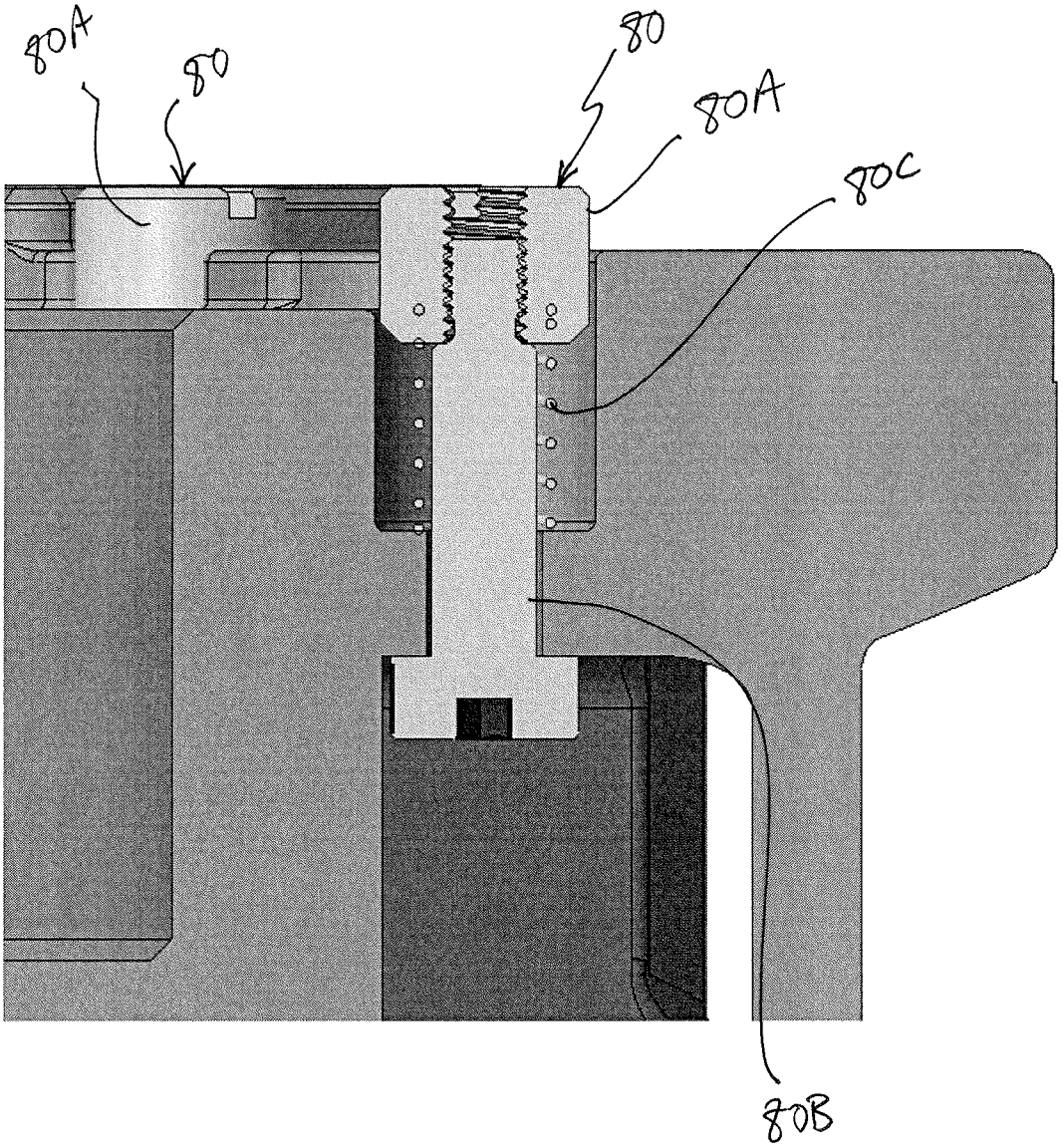
FIG. 18 is a section of a case retainer and the frame.
Figure 19:
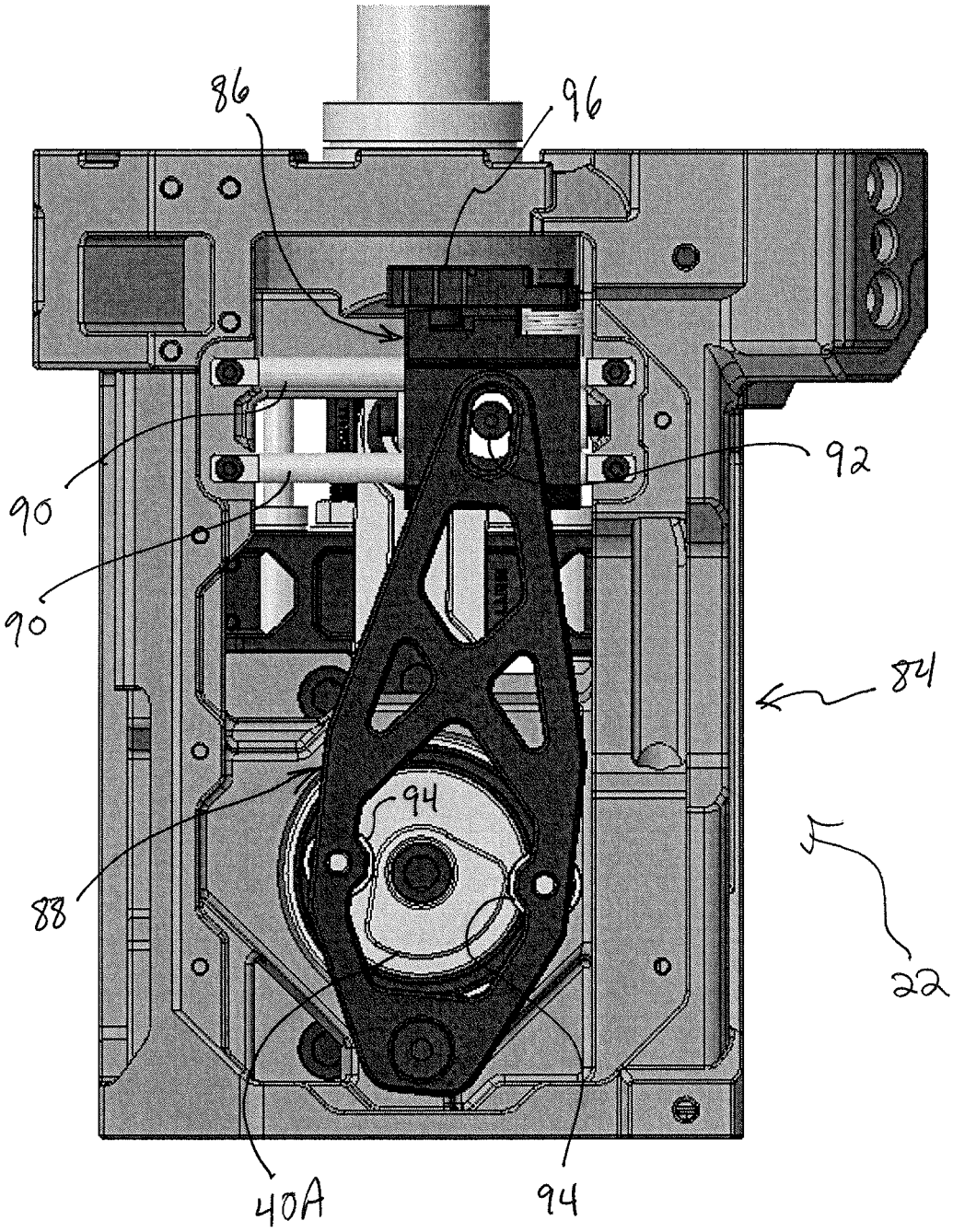
FIG. 19 is a side view of the frame and drive components associated with an indexing carriage for indexing the case carrier.
Figure 20:
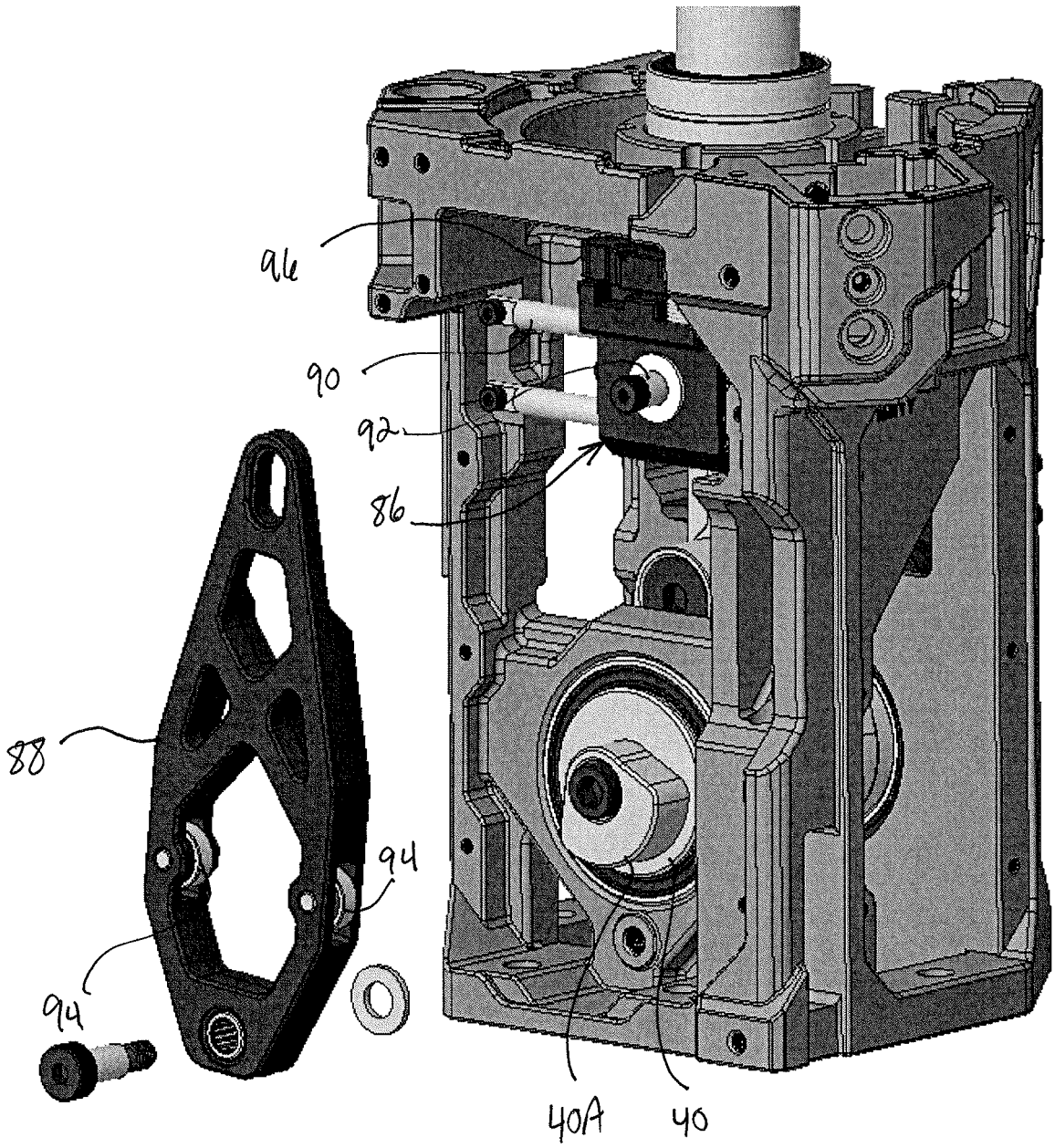
FIG. 20 is a fragmentary exploded perspective of the frame, indexing carriage, and drive components.
Figure 21:
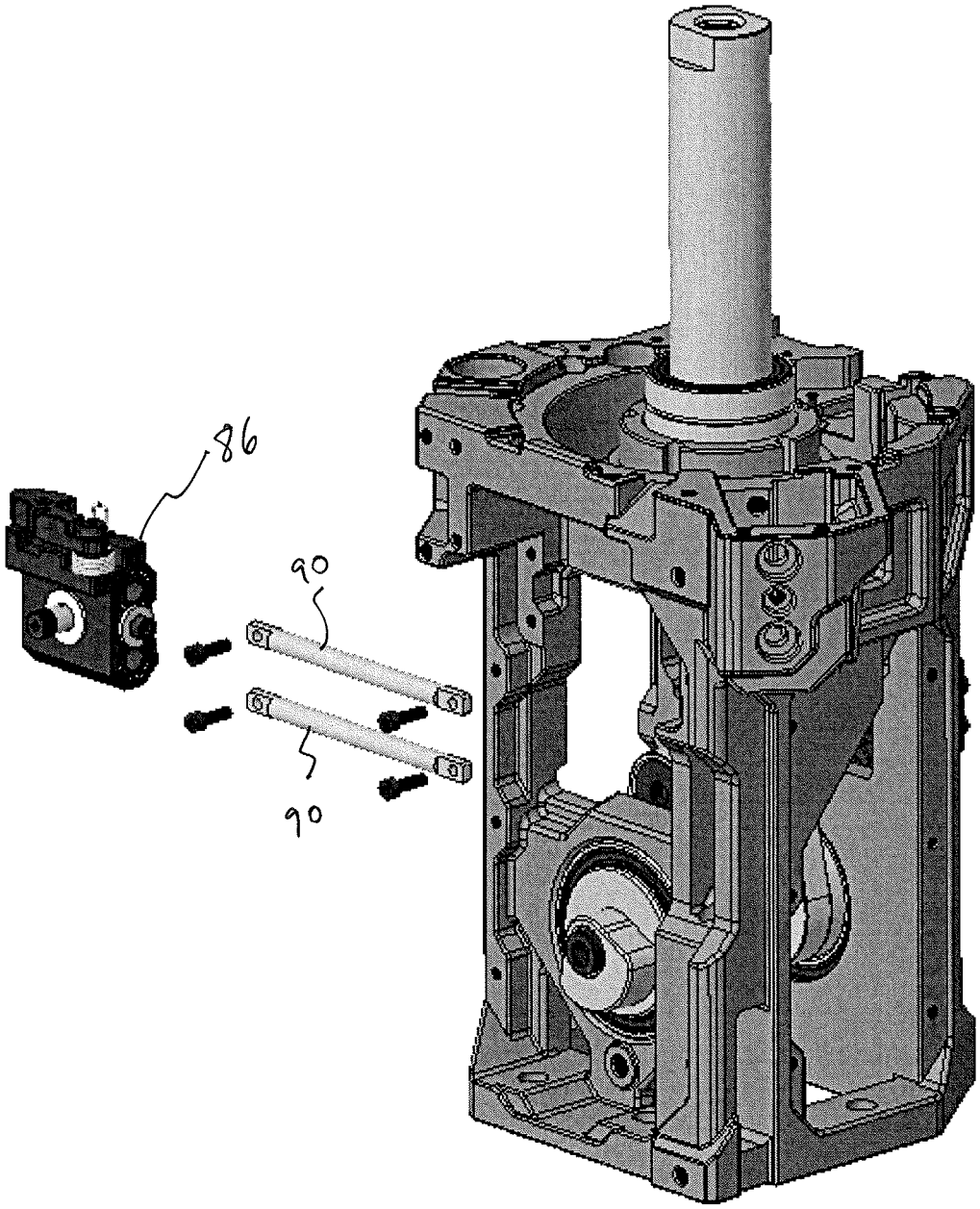
FIG. 21 is an exploded perspective of the frame and the indexing carriage.
Figure 22:
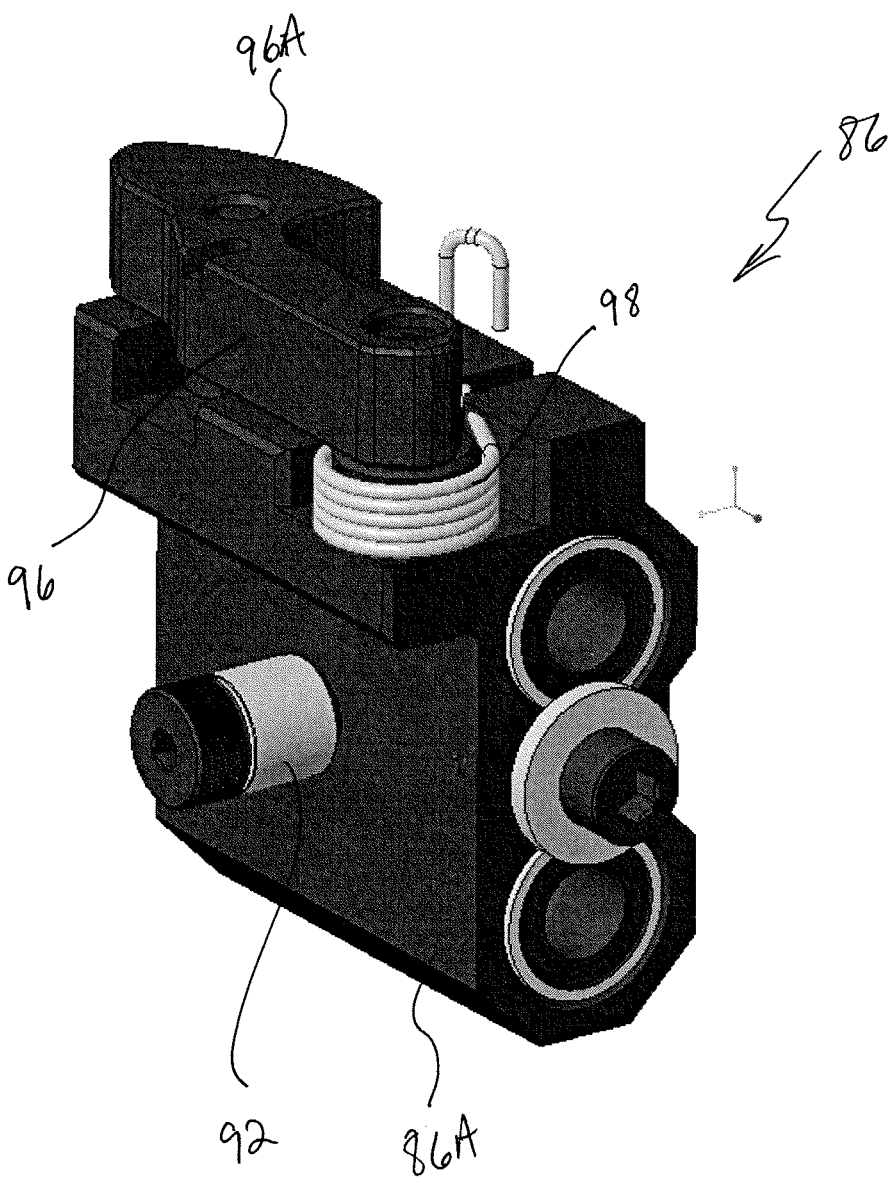
FIG. 22 is an enlarged perspective of the indexing carriage.

Referring to FIGS. 14, 17, and 18, case retainers 80 are provided at each of the stations except the case feeding station S1 and the priming station S5. The case retainers 80 serve as gates to selectively permit removal/insertion of a case from/to the case carrier 58. A user may want to remove or insert a case for inspection or to clear a jam. The case retainers 80 each comprise a spring-biased lug 80A arranged to obstruct removal of a case from the case carrier 58 when the case is at one of the stations S2-S4, S6-10. Between the stations, the frame includes fences 84 (FIG. 14) that obstruct removal the cases from exiting the case holders as the case carrier indexes.

As shown in FIGS. 17 and 18, each case retainer 80 includes a screw 80B, a spring 80C, and a nut. The nuts (e.g., threaded "buttons") form the lugs 80A that block the case holders 64. The screws 80B have shafts extending upward through openings in the frame 14. The springs 80C are captured on the screw shafts between the nuts and the frame. The heads of the screws limit upward movement of the screws. In the illustrated embodiment, the springs 80C are coil springs, and more particularly compression coil springs. However, other types of springs, such as tension springs can be used.

To move a lug 80A (i.e., open the gate), the user presses downward on the lug with their hand or with the primer end of the case to resiliently compress the spring 80C. This moves the retaining lug 80A down into the upper face of the frame 14 to permit lateral passage of the case into or out of the case holder 64. When pressure on the lug 80A is released, the lug extends back to its at rest or closed position. To remove a case, the lug 80A is pressed downward and the case is extracted from the case carrier over the lug. The case is reinstalled by pressing down on the lug with the case, and then sliding the case on the surface of the frame into the case holder 64. The case retainers 80 are vertically displaceable by applying a downward force to the retainers to deform the springs 80C. The retainers 80 are spring loaded to be depressed vertically. It will be appreciated that the lugs 80A permit one-handed installation of a case into a case holder 64 without requiring the user to touch the lugs by hand because the lug can be moved with the case held by the user. The case retainers 80 do not need to be separated from the frame 16 to permit a case to be inserted or removed. The case retainers 80 operate independently from each other. The case retainers 80 do not apply a biasing force to a case when the case is in a case holder 64. When a case is in a case holder 64, lateral force applied by a case to a case retainer 80 is not capable of compressing the spring 80C or opening the case retainer. Other configurations can be used without departing from the scope of the present disclosure.

Referring to FIGS. 19-24, the drive system 22 includes an index driver 84 configured to rotate the case carrier 58. The index driver 84 includes an index carriage 86 driven by an index armature assembly 88 (broadly, "linkage") installed over the cam 40A of the left journal shaft 40. The index carriage 86 moves along a track 90 defined by two guide rods. The index carriage 86 carries a bearing 92 (broadly, "connector") received in a slot in the upper end of the index armature assembly 88. The index armature assembly includes two bearings 94 (broadly, "wheels") that ride on the cam 40A. The cam profile is designed so that both bearings 94 are in contact with the cam 40A through the entire 360 degree rotation of the left journal shaft 40. The armature 88 remains stationary throughout most of the travel of the journal shaft 40 as the bearings 94 are in contact with opposing rounded portions of the cam 40A. When the bearings 94 contact the flat portions of the cam profile, the armature 88 moves quickly to opposite extreme ends of its travel range. The connection of the index armature 88 to the index carriage 86 causes the index carriage to intermittently move horizontally along the track 90 when the index armature moves.

The index carriage 86 includes a catch 96 biased toward a case carrier engagement position by a torsion spring 98. The catch 96 is configured to engage one of the indexing lugs 68 of the case carriage 16 to turn the case carrier 58. The catch 96 has a finger arranged to pull an indexing lug to cause the case carrier to turn. When the index armature 88 moves the indexing carriage 86 to engage the next indexing lug 68, the catch 96 disengages the previous indexing lug, and a ramp 96A on the catch causes the catch to resiliently deflect over the next indexing lug. The index armature 88 then moves the catch to pull that indexing lug 68 to turn the case carrier again. The operation of the indexing carriage 86 is coordinated with movement of the tool heads 18, 20 via the drive system 22 so the case carrier 58 moves cases to the next stations when the accessories on the upper tool head are spaced upward from the cases and the accessories on the lower tool head are spaced downward. Each cycle of the index carriage 86 causes the case carrier 58 to rotate counter-clockwise about 36 degrees, which is the angular distance between adjacent case stations (e.g., S2 and S3), between adjacent case holders 64, and between adjacent notches 58A.

Figure 23:
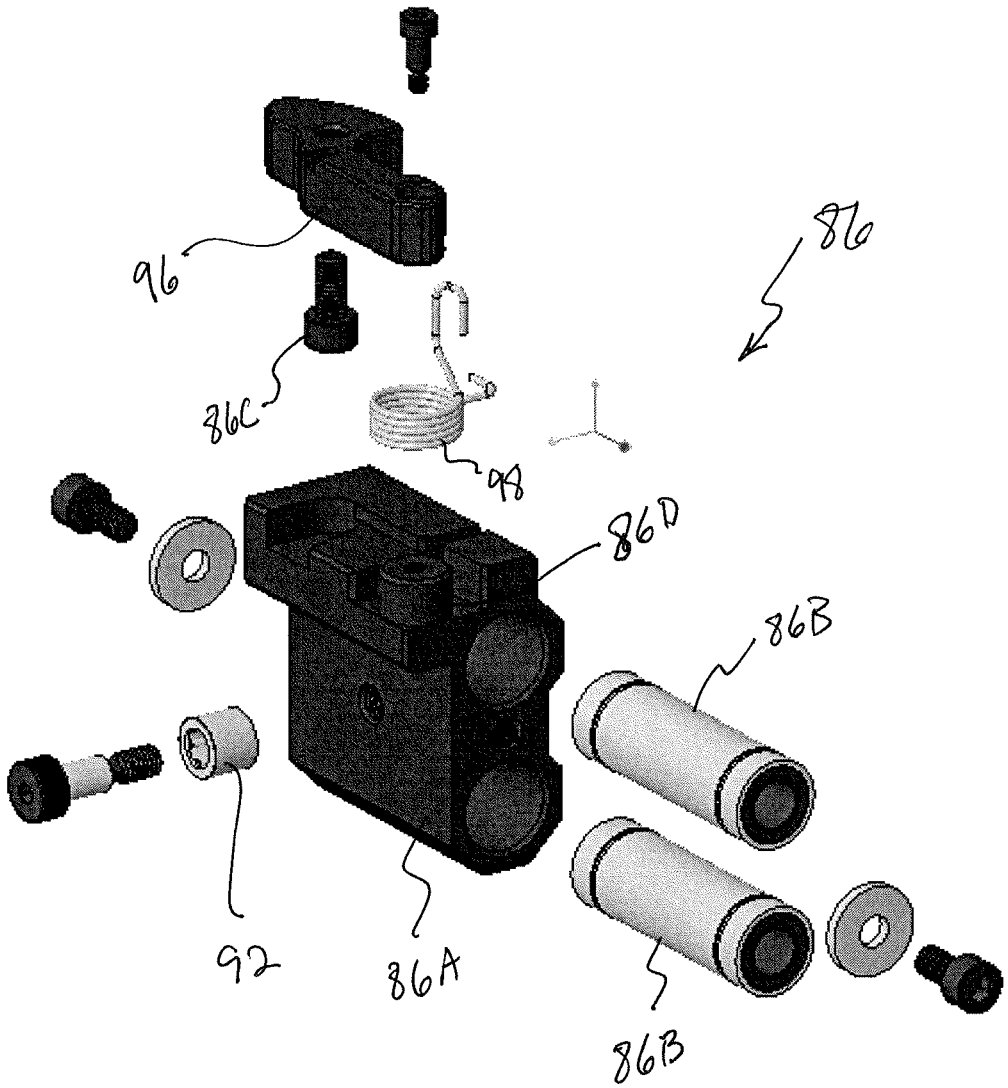
FIG. 23 is an exploded perspective of the indexing carriage.

As shown in FIG. 23, the indexing carriage 86 includes a carriage body 86A that receives two linear bearings 86B held in the body by opposite screws and associated washers. The guide rods forming the track 90 extend through these linear bearings 86B. The armature bearing 92 is secured to the body 86A by a fastener. An upper fastener secures the catch 96 to the body 86A, and a lower fastener threaded to the catch serves as a stop 86C for the catch to oppose the bias of the torsion spring 98. The torsion spring 98 is received over a hub 86D to which the upper fastener is threaded.

Figure 24:
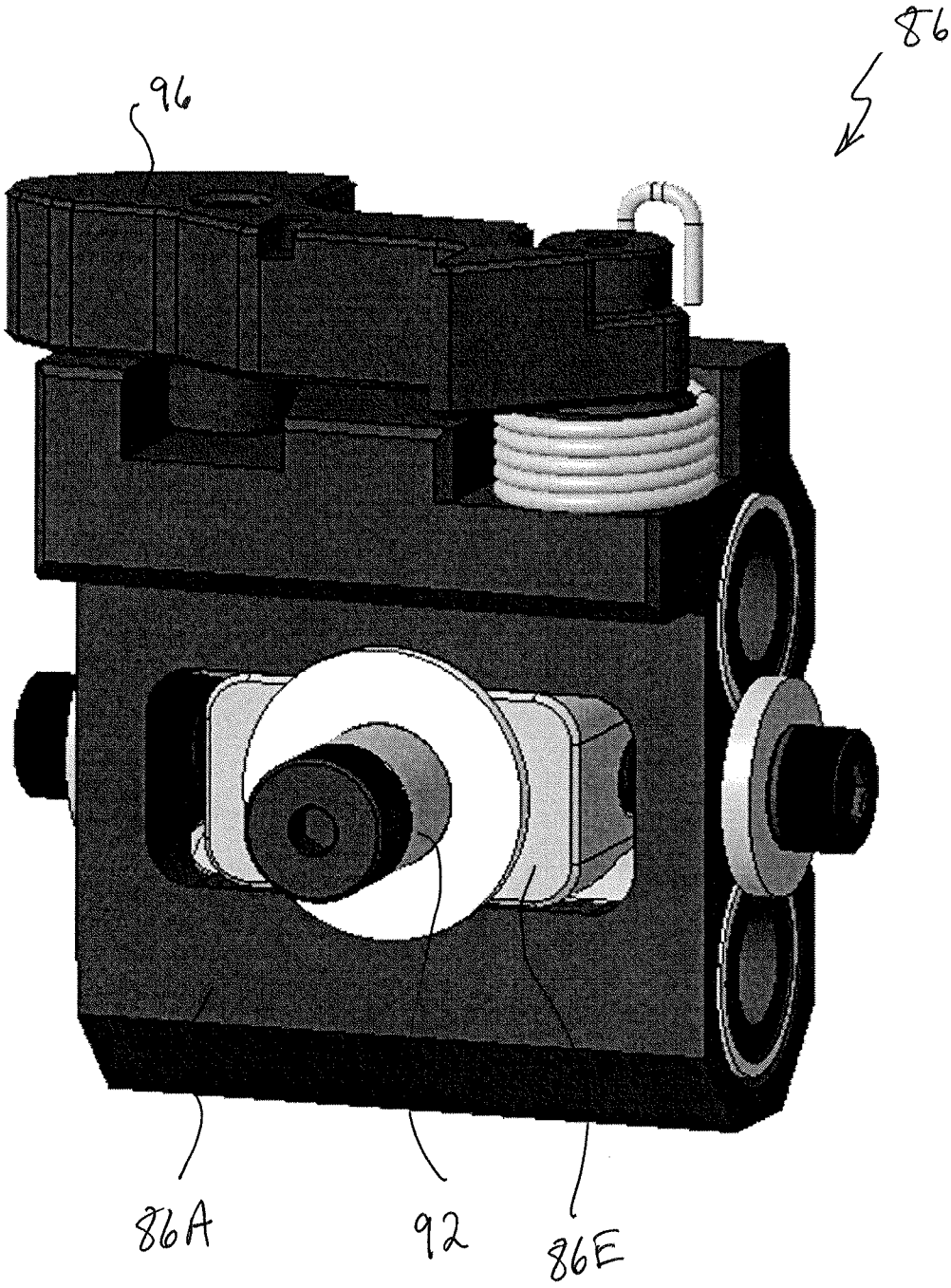
FIG. 24 is a perspective of another embodiment of an indexing carriage.

In an alternative embodiment of the indexing carriage 86, shown in FIG. 24, the armature bearing 92 (connector) is horizontally adjustable with respect to the carriage body 86A. This permits adjustment to locate the catch 96 to properly index movement of the case carrier 58. In this embodiment, the carriage body 86A includes an opening in which a slide 86E is received. The armature bearing 92 is mounted on the slide 86E. When one or both fasteners are loose, the slide 86E is movable in the carriage body 86A, and the slide can be secured in an adjusted position by tightening the fasteners by threading them into the slide.

Figure 25:
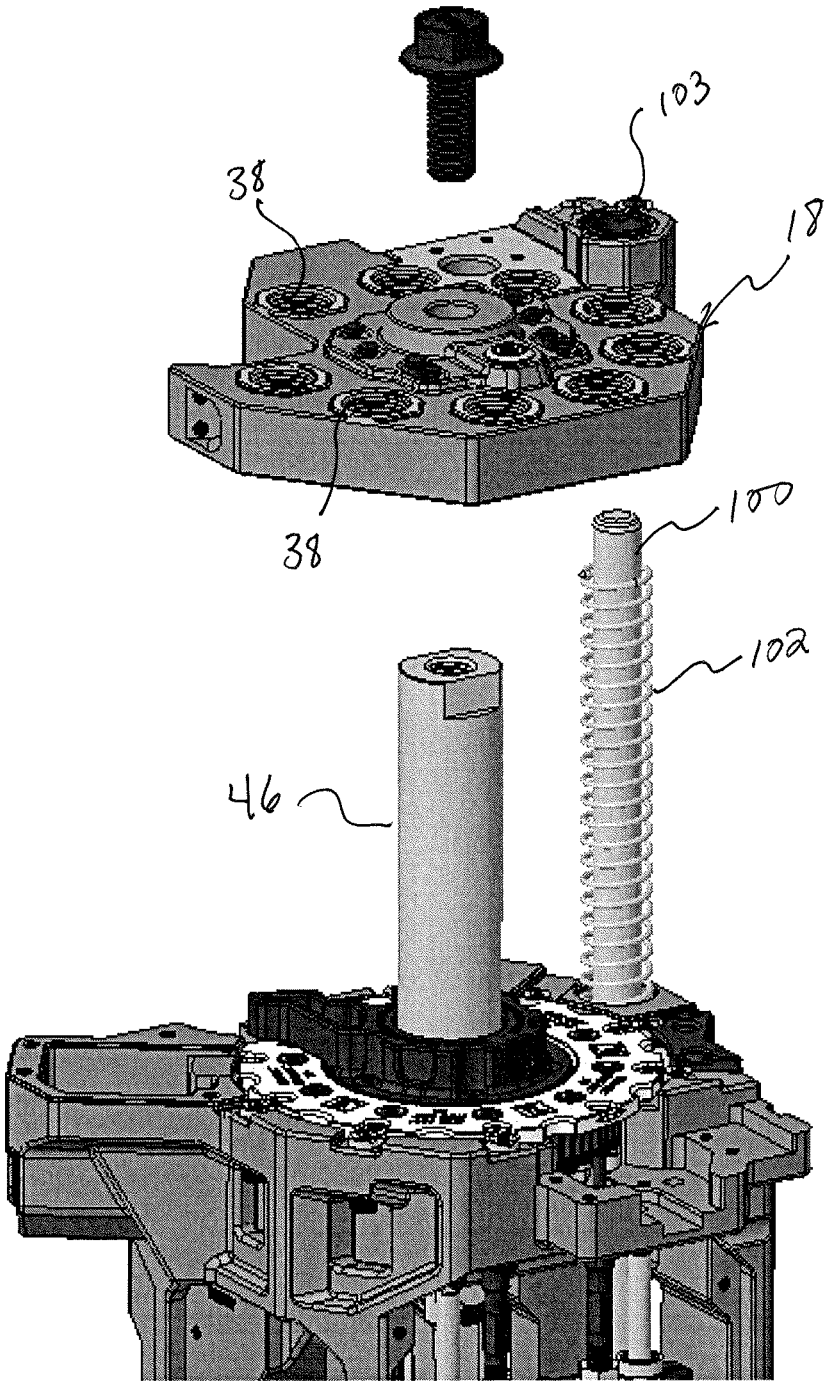
FIG. 25 is a fragmentary exploded perspective of the frame, drive components, and the upper tool head.
Figure 27:
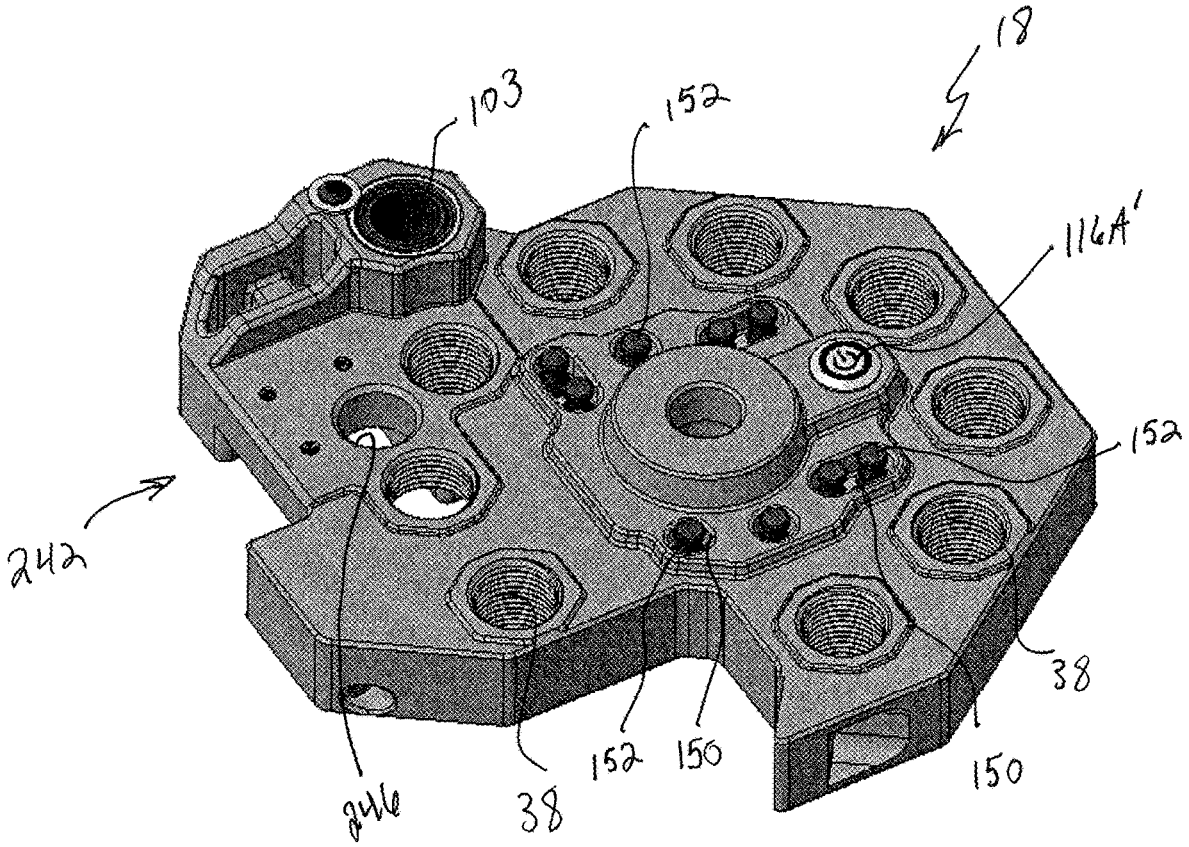
FIG. 27 is a top perspective of the tool head.

As shown in FIG. 25, the upper tool head 18 is receivable on the mount of the ram 46 and secured to the ram via a fastener. A tool head guide 100 extends upward from the frame 14 to guide up and down movement of the tool head. In the illustrated embodiment, the tool head guide 100 comprises a rod secured to the frame. The guide 100 limits rotation of the tool head 18 about the ram 46 and forces the tool head die mounts 38 to be in vertical registration with the case stations. A coil spring 102 is provided on the guide 100 to facilitate upward return of the tool head 18. The tool head 18 includes a guide receiver through which the guide 100 extends. As shown in FIGS. 25 and 27, the guide receiver can comprise a bearing 103 in a pocket in the tool head.

Figure 26:
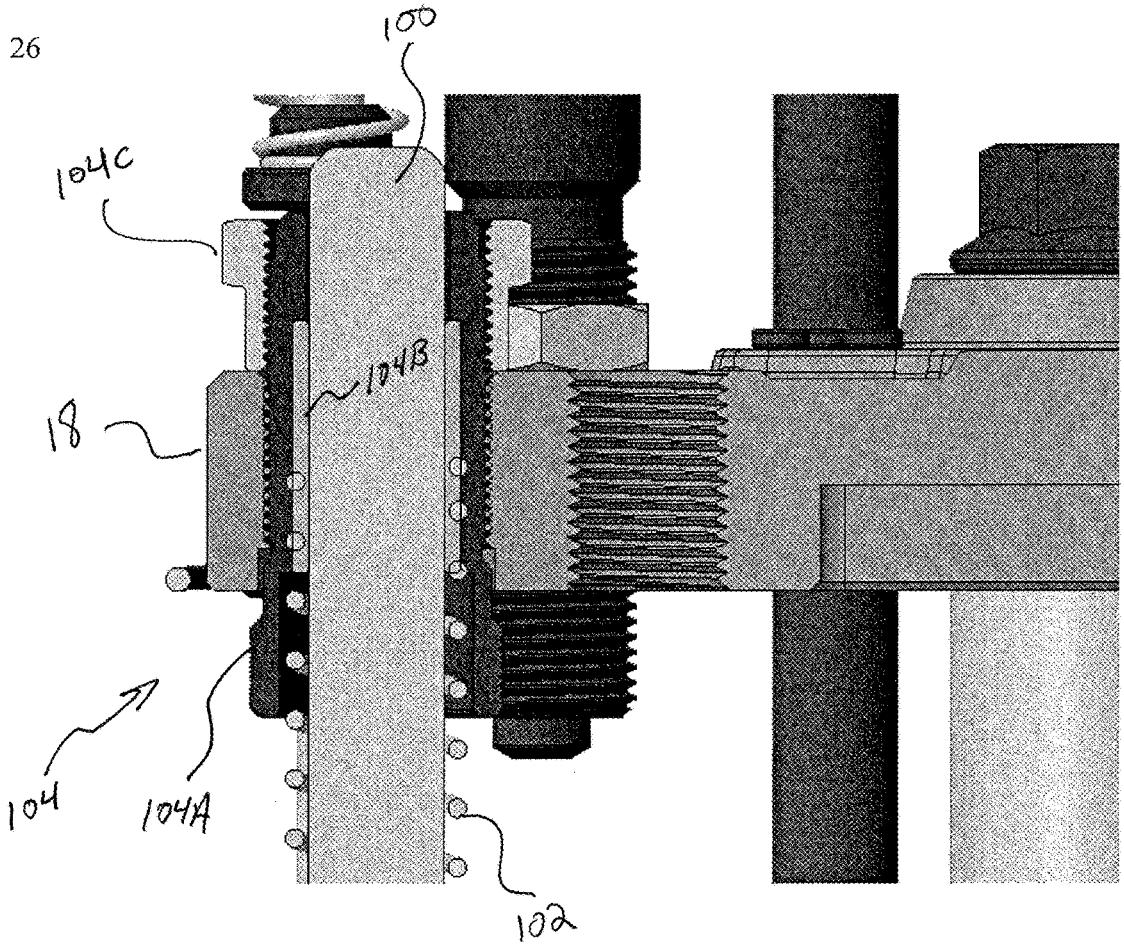
FIG. 26 is a section of a depth stop installed on the upper tool head.

In an alternative embodiment, shown in FIG. 26, the guide receiver can comprise a tool head depth stop 104 (broadly, "torque brace") to limit tool head rock or flex. It will be appreciated that the tool head 18 can be subjected to substantial force, such as in a resizing operation. The force on the tool head 18 at a station where resizing is happening may cause the too head to flex or rock. Torque is induced in the tool head which can cause the tool head to rock relative to the shell plate as the case is resized. When the press system 10 is set up to perform several operations at different stations at the same time, varying displacements of the tool head 18 can affect operations offset from the resizing operation, such as bullet seating, and can prevent the cases from being completely resized. The tool head depth stop 104 is located on the tool head 18 generally on an opposing side of the ram 46 with respect to the second station S2, the recommended resizing station, and the fourth station S4, the recommended primer pocket swaging station. As explained in further detail below with respect to FIGS. 33 and 34, the primer pocket swaging operation can include a case support die 108 in the fourth station S4 configured to contact the case from above to brace the case against the force of the primer pocket swaging tool. When the resizing die (second station S2), the case support die 108 (fourth station S4), and tool head depth stop 104 are each properly adjusted, the tool head 18 has three points of contact with the case carrier and frame, which facilitates maintaining the tool head in a level orientation when the tool head is lowered. It will be appreciated that a similar effect is achieved even if there is contact at only two locations on generally opposing sides of the ram 46 (e.g., resizing and tool head depth stop).

Referring to FIG. 26, the tool head depth stop 104 includes a depth stop body 104A in the form of a threaded sleeve in a threaded opening in the tool head 18. A bushing 104B (e.g., made of brass) is received in the depth stop body 104A to act as a bearing for movement of the guide 100 in the depth stop. The depth stop 104 is adjustable by changing the amount the depth stop body 104A is threaded upward into the tool head 18. The depth stop body 104A includes a stop surface at its lower end configured to engage the frame 14 when the tool head 18 is lowered. The return spring 102 is nested in the lower end of the depth stop body 104A such that the stop surface is outboard of the spring and the depth stop body transmits the spring force to the tool head 18. The depth stop 104 includes a lock nut 104C threaded on the depth stop body 104A that can be tightened against the tool head 18 to secure the depth stop body in a desired position. Desirably, the location of the stop surface is adjusted by the operator to contact the frame 14 when the resizing die contacts the case carrier to counteract the moment induced by the resizing operation.

The tool head depth stop 104 can have other configurations or be omitted without departing from the scope of the present disclosure. For example, the tool head depth stop can be provided in a die mount of the tool head (e.g., at the seventh station S7) instead of at the tool head guide receiver. It will be appreciated that locating the tool head depth stop at the guide receiver frees the seventh station for incorporating a die to increase the available operations on the cases As shown schematically in FIG. 30, the press system can include a control system 110 including a press controller 112 (e.g., microprocessor or central processing unit), a non-transitory tangible storage medium 114 (e.g., including forms of storage such as software and/or firmware), and a user interface 116 (e.g., including a user input 116A and an alarm 116B). A power source 118 such as batteries or a port for a power cord (broadly, "electrical power input port") can be used for providing electrical power to the control system 110. The control system can include one or more LEDs 120 (broadly, "illuminators") for illuminating work areas of the press (e.g., the ten stations S1-S10). The control system 110 also includes a plurality of accessory ports 122 to which press accessories can be connected. For example, in FIG. 30, connected accessories include a low primer sensor 130, a primer holder illuminator 132, and a primer detector 134, all described in further detail below. The ports 122 can include electrical power terminals and communication terminals for forming a power and communication connection with an accessory via a single port connection (e.g., micro USB). Alternatively, the power and communications can be provided separately (e.g., wireless communications, such as Bluetooth, Zigbee, etc., between accessory and press controller). The control system 110 also includes a communications port 140 for transmitting communication signals from the control system 110 to other devices and/or receiving communication signals. For example, the communications port 140 can be a wired port (e.g., USB or micro USB port, collectively "USB type" port) or a wireless port (e.g., WiFi, Bluetooth, Zigbee, etc.).

The control system 110 includes interconnection electronics 142 (e.g., including electrical, fiber optic lines, and/or wireless communication devices) that operatively connect the various components of the control system with each other and with other components of the press system 10. It will be appreciated that the interconnection electronics 142 can include other components, such as A/D converters and/or filters through which signals such as the scale signal passes to the press controller.

Figure 28:
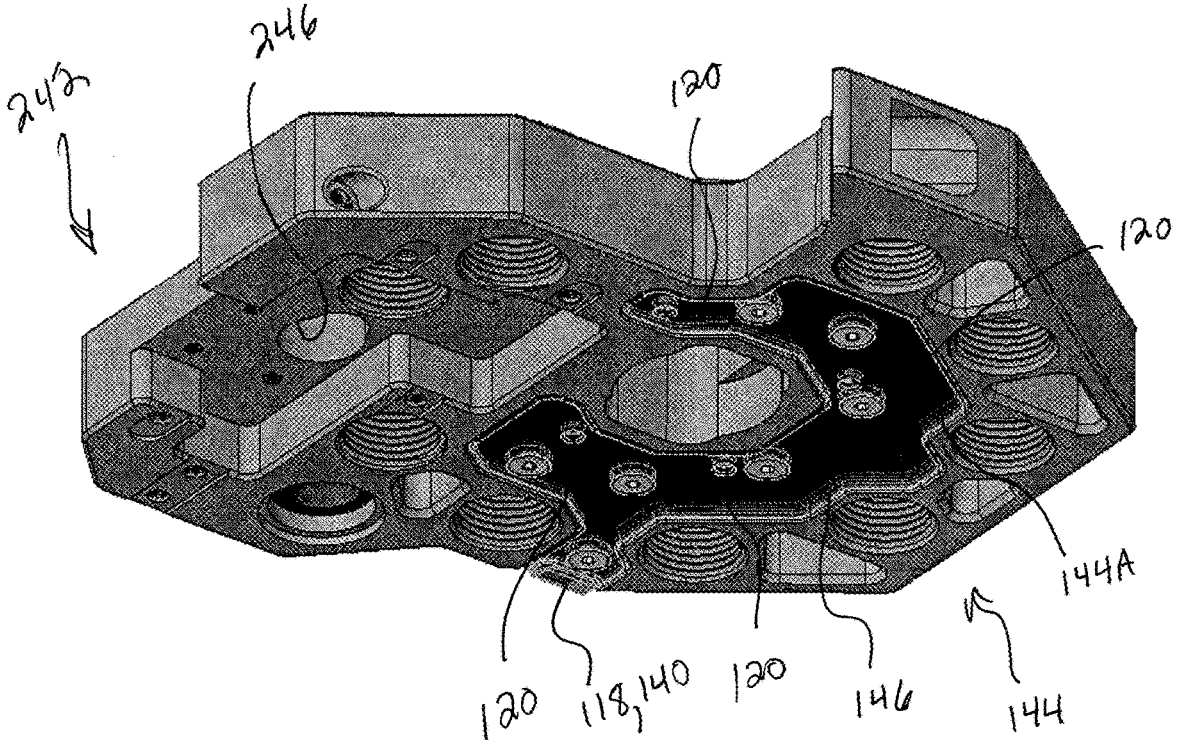
FIG. 28 is a bottom perspective of the tool head.
Figure 29:
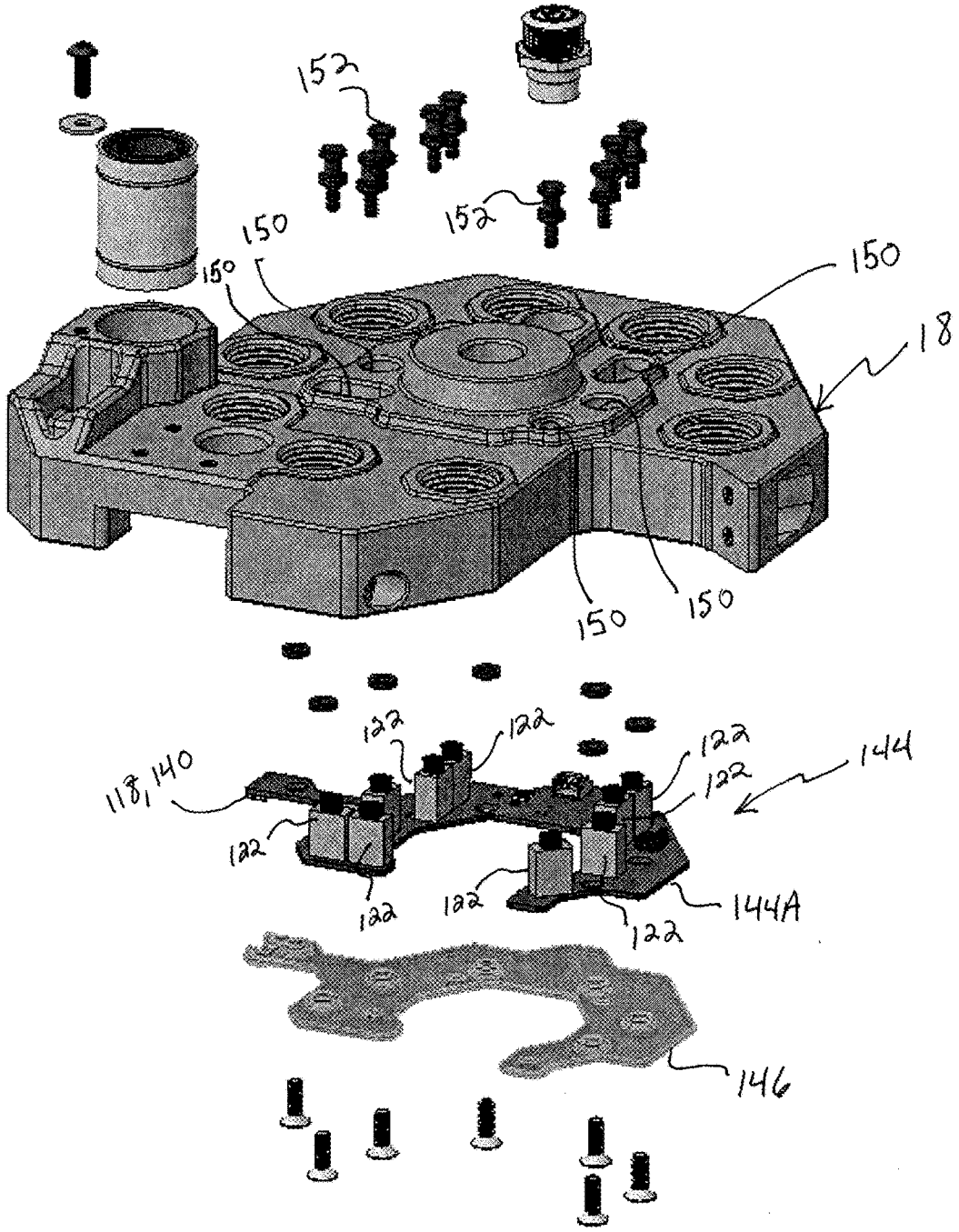
FIG. 29 is an exploded perspective of the tool head.

Referring to FIGS. 27-29, in the illustrated embodiment, the press system 10 includes a printed circuit board assembly 144 forming a part of the press control system 110. The printed circuit board assembly 144 includes a printed circuit board structure 144A (shown as a single circuit board, but optionally comprising multiple circuit boards directly or indirectly connected (e.g., tethered)), the press controller 112, and the storage medium 114. The printed circuit board includes interconnection electronics 142 in the form of circuitry operatively connecting the press controller 112, storage medium 114, and other components connected to the circuit board, such as the LEDs 120 and the accessory ports 122. In this embodiment, the power source port 118 and communications port 140 are combined into a single port (e.g., micro USB port) having both power and communications terminals, and the single port is accessible at a side of the tool head 18 and can be used for connecting the onboard press controller 112 to an offboard controller or control system. The printed circuit board assembly 144 is receivable in a recess in the bottom of the tool head 18 that is sized and shaped to correspond to a shape of the printed circuit board structure 144A. A plurality of fasteners with corresponding spacers (e.g., resiliently compressible rubber washers) are used to secure the printed circuit board assembly 144 in position and to secure a cover 146 (e.g., transparent or translucent plastic) over the printed circuit board assembly. The LEDs 120 face downward and emit light that passes through the cover to illuminate the stations S1-S10.

The accessory ports 122 (e.g., 3.5 mm sockets) are located on the printed circuit board structure 144A to correspond to locations of openings 150 in the tool head 18. When the printed circuit board assembly 144 is secured in the recess in the bottom of the tool head 18, the accessory ports 122 are located to be accessible through the openings 150 in the top of the tool head. Suitable cords (e.g., cables having 3.5 mm jacks) can be used for connecting the accessories to the ports 122. Plugs 152 can be used to close and protect the ports when the ports are not in use. Nine ports 122 are provided, but other numbers can be used without departing from the scope of the present disclosure.

The press controller 112 is configured to read and execute instructions stored in the storage medium 114, and is responsive to the user interface 116, for controlling operation of the press system. The press controller 112 receives signals from the accessory ports 122 (if used) and, based on instructions stored in the storage medium 114, transmits responsive signals (e.g., command signals) to one or more components of the press system 10. In the illustrated embodiment, the user input 116A comprises a push button actuator 116A' for turning on/off the press controller 112 and the LEDs 120. A user can enter and/or modify instructions stored on the storage medium 114 via the communications port 140. The user interface 116 can include a display (not shown), and the LEDs 120 can be used as part of the user interface, as will become apparent. For example, when the press controller 112 determines a fault, it can energize the alarm 116B (e.g., emit sound from a speaker) and/or flash and/or change colors (broadly, "change state") of the LEDs 120 to notify the operator of the fault. Example faults or malfunctions include case misfeed, primer misfeed, primer/bullet/case/powder refill needed, etc. Other types of user interfaces (e.g., including other types of user inputs) can be used without departing from the present disclosure.

In some embodiments, one or more press accessories connected to the ports 122 will include their own accessory controllers, such that the accessories can determine a fault condition based on sensory feedback and communicate that fault condition to the press controller 112. Alternatively, the press accessory may merely transmit sensor signals to the press controller 112, which determines a fault condition based on instructions in the storage medium 114.

It will be appreciated that in other embodiments the press controller 112, the storage medium 114, and/or the user interface 116 can be part of another device such as a smart phone or tablet operatively connectable to the press system (e.g., wirelessly, such as via a wireless communications port of the control system) without departing from the scope of the present disclosure. Moreover, other configurations of press control systems can be used without departing from the scope of the present disclosure.

In view of the above, it will be appreciated that the printed circuit board assembly 144 serves as a harness for consolidating power and communications connections at the accessory ports 122. Power to those ports 122 is provided via one connection to the upper tool head 18 at the micro USB port 118, 140. Moreover, if desired to transmit signals from the accessories and/or onboard controller 112 to an offboard control system, that can be done via the single micro USB port 118, 140. This limits the number of power supplies needed (e.g., a single USB to micro USB power cord) for powering various press accessories, and limits the overall number of cords needed, which is beneficial for avoiding interference with the moving components of the press system. The accessories mounted on the upper tool head 18 will move with their power and/or communication connections at the ports 122 and thus not tend to extend or pull on the cords connecting them for power and/or communications as the upper tool head moves. In other words, because the power and/or communications ports 122 are carried by the upper tool head 18, the upper tool head in its up/down strokes does not move relative to these ports and is less likely to lead to inadvertent disconnection or obstruction. The printed circuit board assembly 144 serves as a power and communications hub carried by the press 12, and in particular carried by the upper tool head 18.

In another aspect of the present disclosure, the press 12 is configured to facilitate decapping operations (spent primer removal) at the second and third stations S2, S3. Redundant decapping operations can be implemented in sequential stations to more reliably remove spent primers from the cases. Two stations prior to the swaging/priming stations both allow primers to be ejected and drop into the spent primer collection receptacle.

A problem for conventional progressive ammunition presses is primer "draw-back." This occurs when the spent primer sticks to the end of the decapping pin (the pin that punches the spent primer out of the case) and is drawn back into the primer pocket as the decapping pin is extracted. The case is then moved to the next station, and the reloading machine attempts to either swage the primer pocket or seat a new primer on top of the spent primer, depending on the configuration of the machine. Draw-back is especially common when loading miliary cases with crimped primers, or other rounds that require excessive force to push the primer out of the primer pocket.

Current solutions to this issue include spring loaded decapping pins and vacuum tubes intended to use vacuum force to pull the spent primer off of the decapping pin before it can be drawn back into the pocket. The vacuum systems require a vacuum source and are noisy. Spring loaded pins are delicate and break often. Presses with fewer stations usually require a single decapping operation (e.g., single decapping and resizing operation) to permit a single-pass process.

In one example, a universal decapping die can be used in the second station S2, and a decapping and resizing die can be used in the third station S3. This provides a second chance to eject a stuck spent primer from a case (increasing reliability) and reduces chances of damaging the decapping and resizing die due to a particularly stubborn primer. Because there are ample stations on the press 12, there is room to provide redundant decapping operations even in a single-pass processing operation. A second decapping pin will reliably separate the primer from the case using readily available and affordable standard decapping dies. The first decapping pin will overcome all of the force required to separate the primer from the primer pocket, and when the second pin contacts the spent primer it should fall away freely. The use of a redundant decapping die can also prevent damage to expensive resizing dies. If a universal decapping die is used in the first station and a combination sizing/decapping die is used in the second station, the universal decapping die will encounter any damaging obstructions first and will protect the more expensive and caliber specific resizing die.

Figure 31:
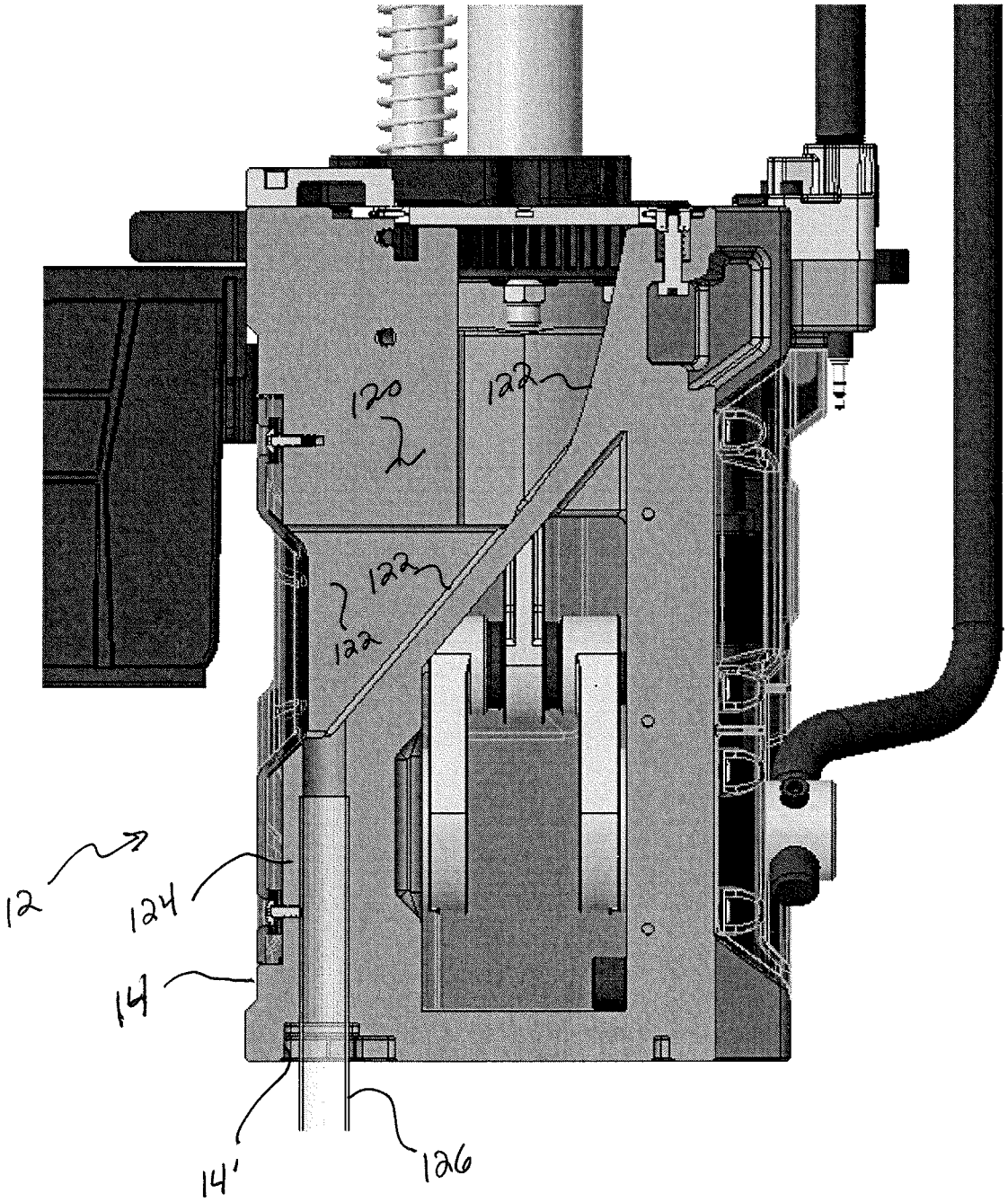
FIG. 31 is a fragmentary section of the ammunition press system showing a primer collection feature.
Figure 32:
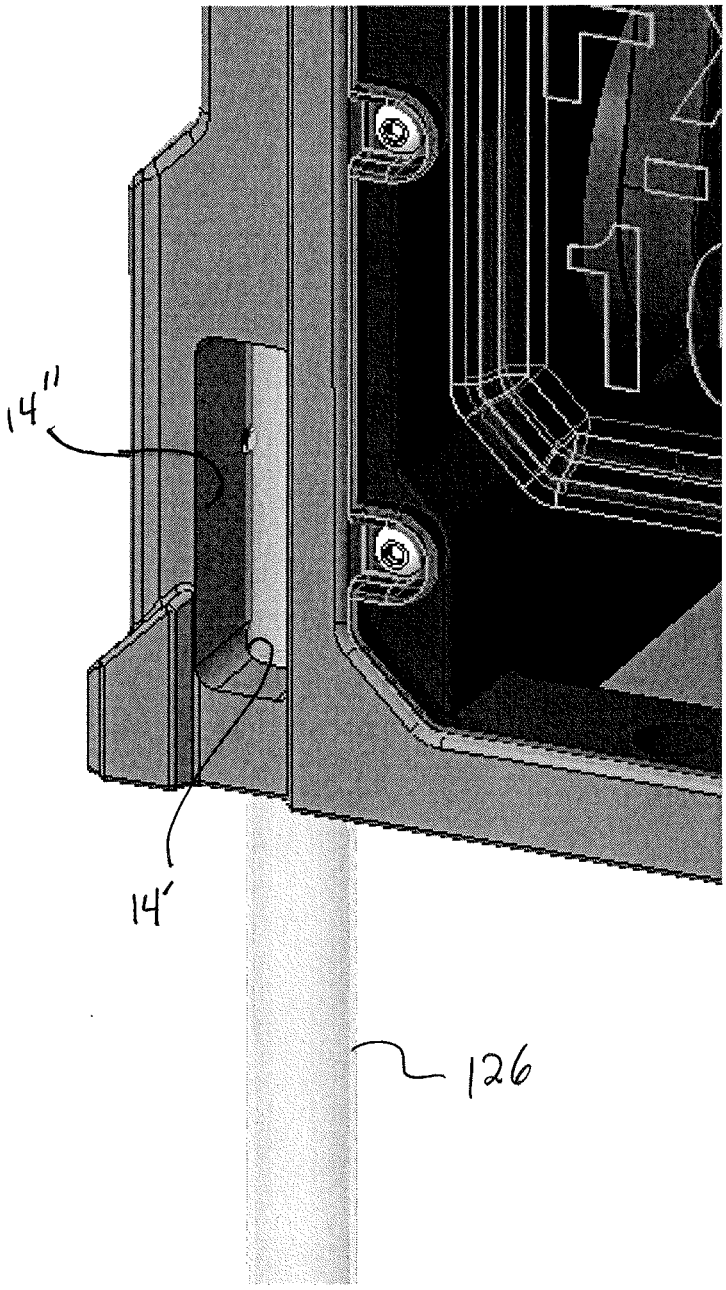
FIG. 32 is an enlarged fragmentary perspective of a primer collection tube extending from the frame.

Referring to FIG. 31, the press 12 is configured to collect spent primers from both the second and third stations S2, S3. The frame 14 includes a cavity 120 sized and shaped to receive spent primers that may fall from the second and third stations S2, S3. Interior walls 122 of the frame form a funnel for funneling these spent primers to an outlet 120A of the cavity. The press includes a tube connector 124 in the form of a tube receiver in which an upper end of a spent primer transport tube 126 can be installed (e.g., retained by friction). The arrangement is such that spent primers collected by the cavity 120 are funneled into the spent primer transport tube 126. As shown in FIGS. 31 and 32, the frame 14 includes an opening 14' in the bottom of the frame and an opening 14" in the side of the frame. The operator can choose to route the spent primer transport tube 126 through the bottom opening 14' if desired to run the tube through the support surface (e.g., table top), or can choose to route the tube through the front opening 14". In either case the outlet end of the tube 126 can be located to deliver the spent primers to a spent primer receiver such as a bucket or other receptacle.

Figure 33:
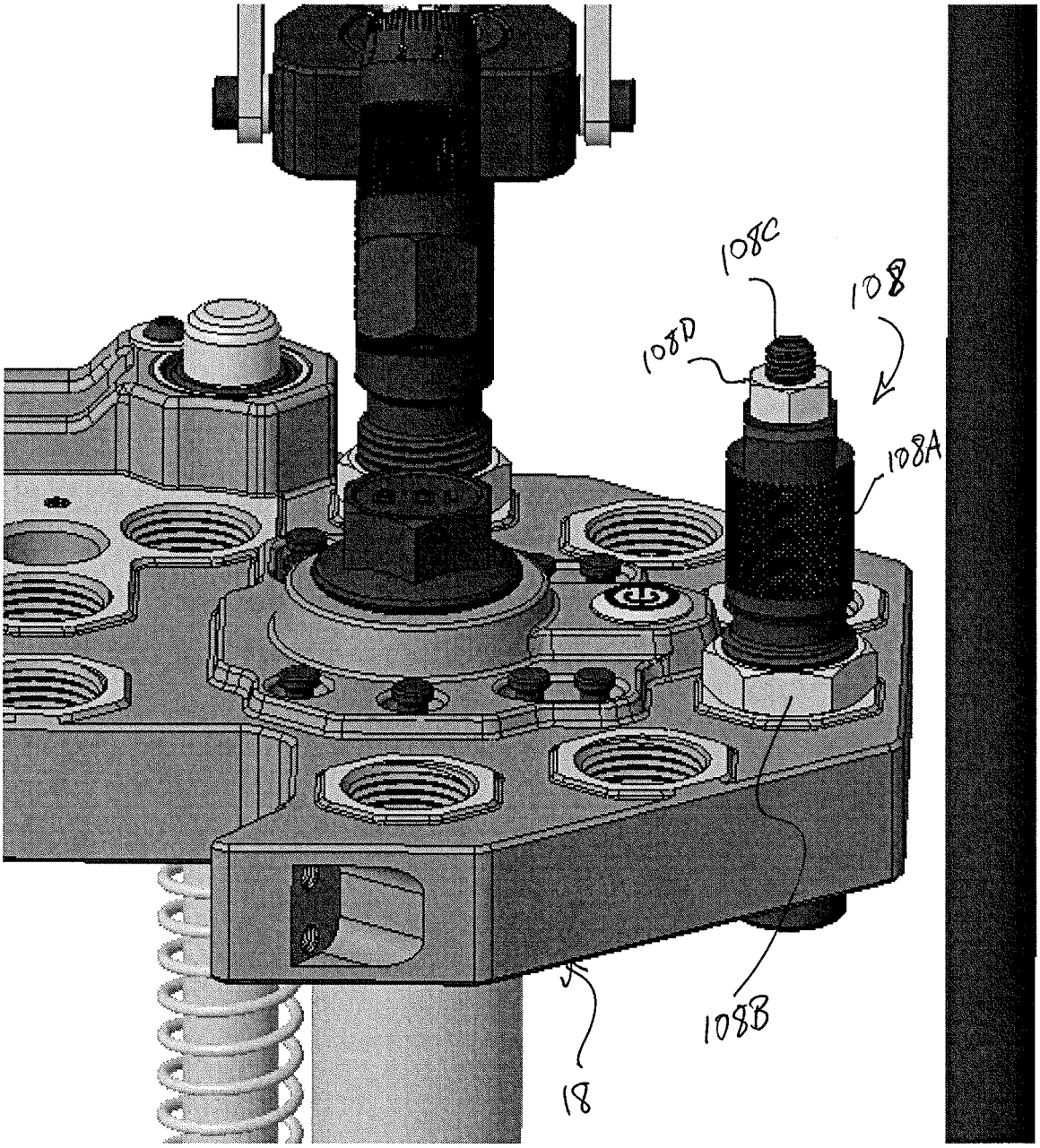
FIG. 33 is a fragmentary perspective of the upper tool head having a support die installed thereon.
Figure 34:
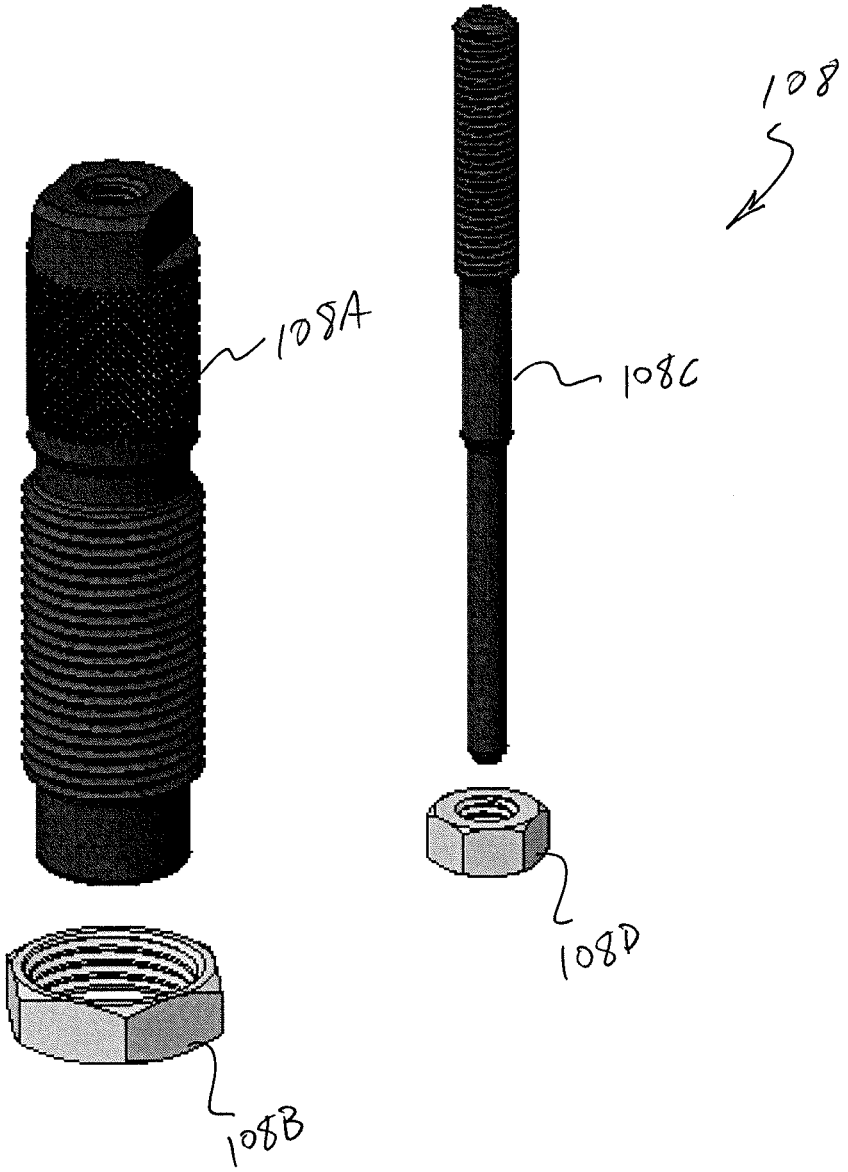
FIG. 34 is an exploded perspective of the support die.

Referring to FIGS. 33 and 34, the case support die assembly 108 can be installed at the fourth station S4 (swage) to support the case from above to oppose the force of the primer pocket swage tool as the primer pocket is swaged. The case support die assembly 108 includes a die body 108A, which can be adjusted so that the bottom of the die is in contact with the case carrier 58 at the bottom of travel of the tool head 18. The die body 108A can be locked in place using a lock nut 108B (e.g., ⅞-14 nut). The die assembly 108 includes a stem 108C that can be adjusted (threaded into the die body 108A) so that the stem contacts the bottom of the inside of the case at the bottom of travel of the tool head 18, holding the case down against the swage pin. The position of the stem 108C can be secured with respect to the die body 108A using a stem lock nut 108D.

Figure 35:
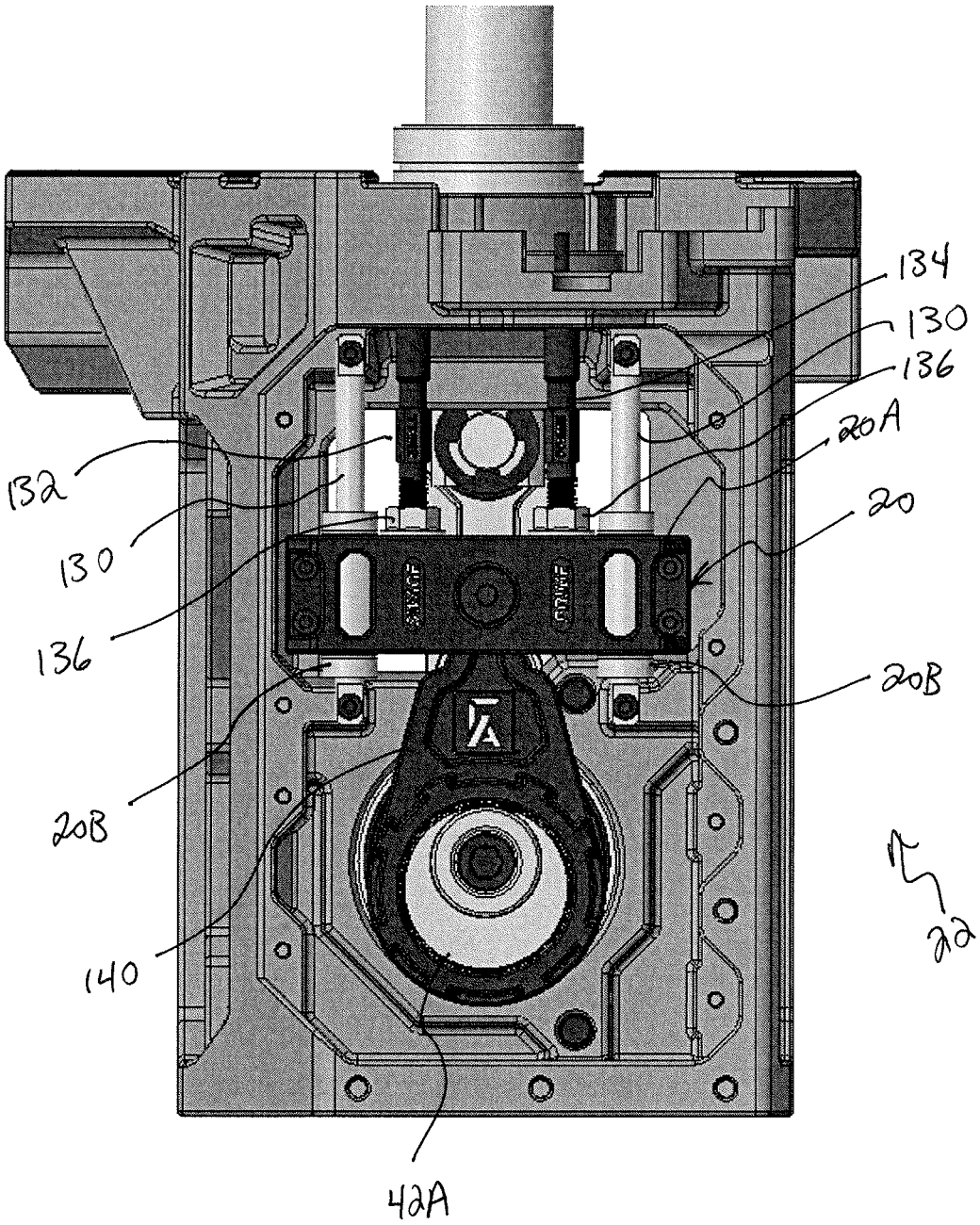
FIG. 35 is a fragmentary side view of the ammunition press system showing a lower tool head and associated drive components.
Figure 36:
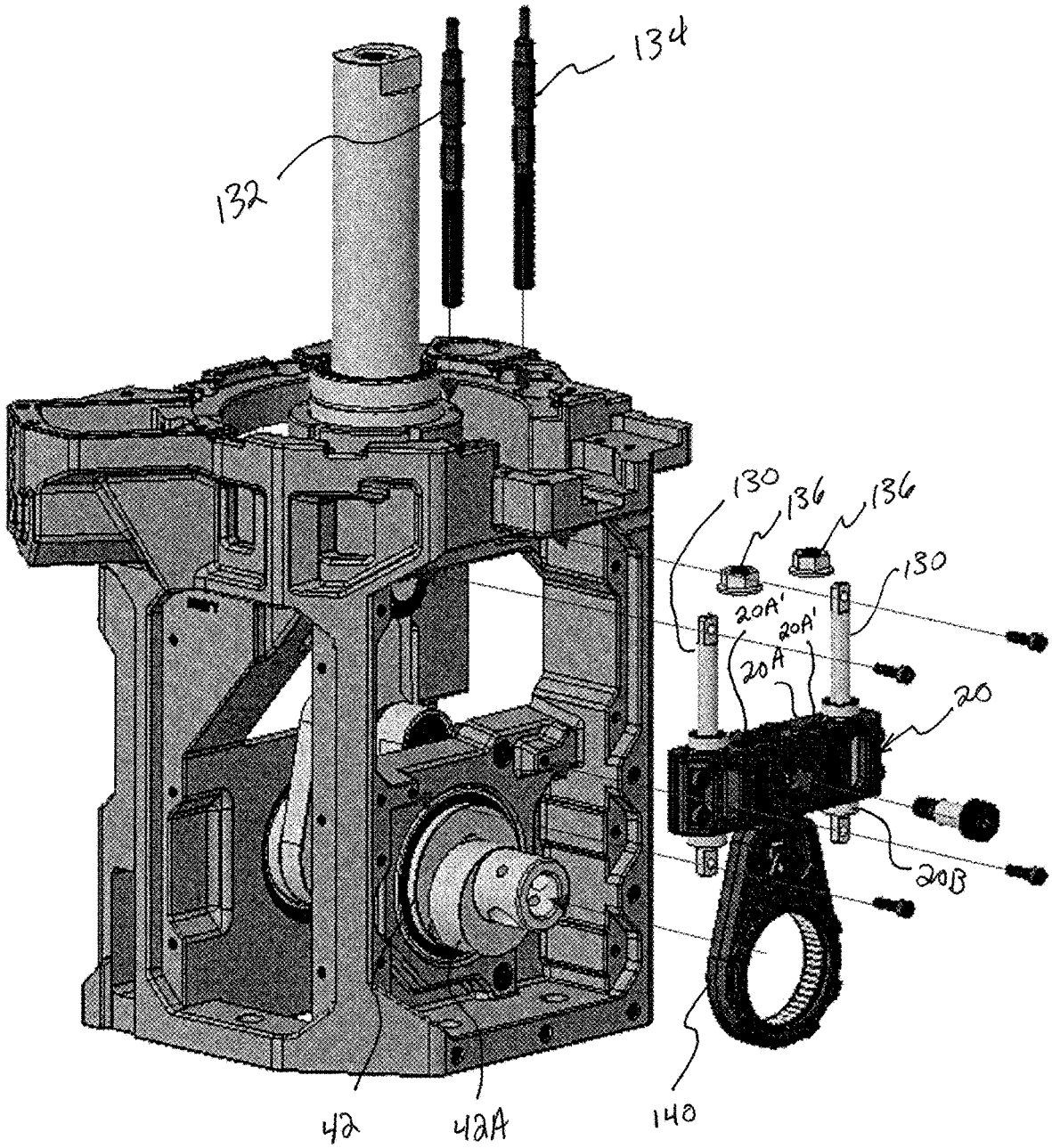
FIG. 36 is an exploded perspective of the frame, the lower tool head, and drive components.

As shown in FIGS. 35 and 36, the lower tool head 20 includes a tool head body 20A and two linear bearings 20B, which act as guides movable along a track 130 formed by two guide rods secured to the frame. The lower tool head 20 is associated with the fourth and fifth stations S4, S5. The tool head body 20A includes two threaded openings 20A' (broadly, "tool mounts") for receiving tools to be associated with the fourth and fifth stations S4, S5. In the illustrated embodiment, a swaging pin 132 is mounted on the tool head body 20A to be associated with the fourth station S4, and a priming pin 134 is mounted on the tool head body to be associated with the fifth station S5. The pins 132, 134 can be adjusted by threading them into or out of the tool head body 20A. Lock nuts 136 are provided to secure the pins 132, 134 in their adjusted positions.

The drive system 22 includes a linkage connecting the right journal shaft to the lower tool head for moving it upward and downward. The linkage includes a link 140 having an opening with a bearing therein that is received over the cam 42A of the right journal shaft 42. An opposite end of the link 140 is connected by a pivot connection to the lower tool head 20. The cam 42A is oriented such that the lower tool head 20 reaches the top of its travel when the ram 46 is at the bottom of its travel.

Figure 37:
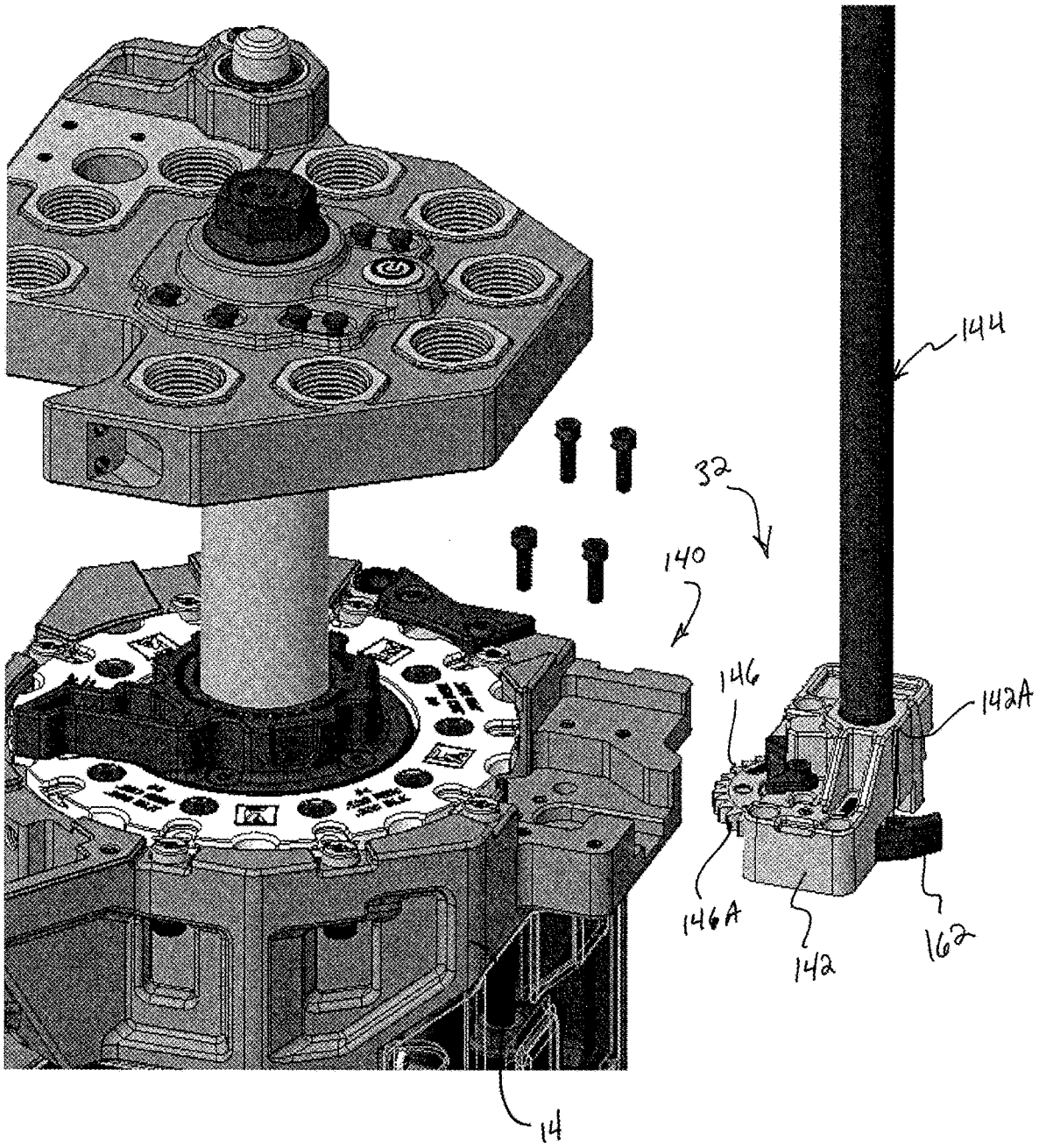
FIG. 37 is a fragmentary exploded perspective of the frame, case carriage, and primer feeder.

Referring to FIGS. 37-42, the primer feeder 32 is mountable on the frame 14 to locate the primer feeder to feed primers for insertion to cases at the fifth station S5. The frame 14 includes a primer feeder mount 140 designed to receive the primer feeder 32 and permit the primer feeder to deliver primers to below the case carrier 58 for insertion into cases by the priming pin 134. As shown in FIG. 37, the primer feeder 32 is connected to the mount 140 by four fasteners. As will become apparent, the primer feeder 32 is designed to be self-contained, recirculating, and gear-driven.

The primer feeder 32 includes a feeder body 142 that serves as a support for other components of the primer feeder. The feeder body 142 includes a mount 142A for holding a primer supply tube assembly 144. The feeder body 142 also serves as a support for a primer gear 146 (broadly "primer shuttle" or "primer wheel") configured to receive primers from the primer supply tube assembly 144 and deliver them to the priming pin 134.

Figure 38:
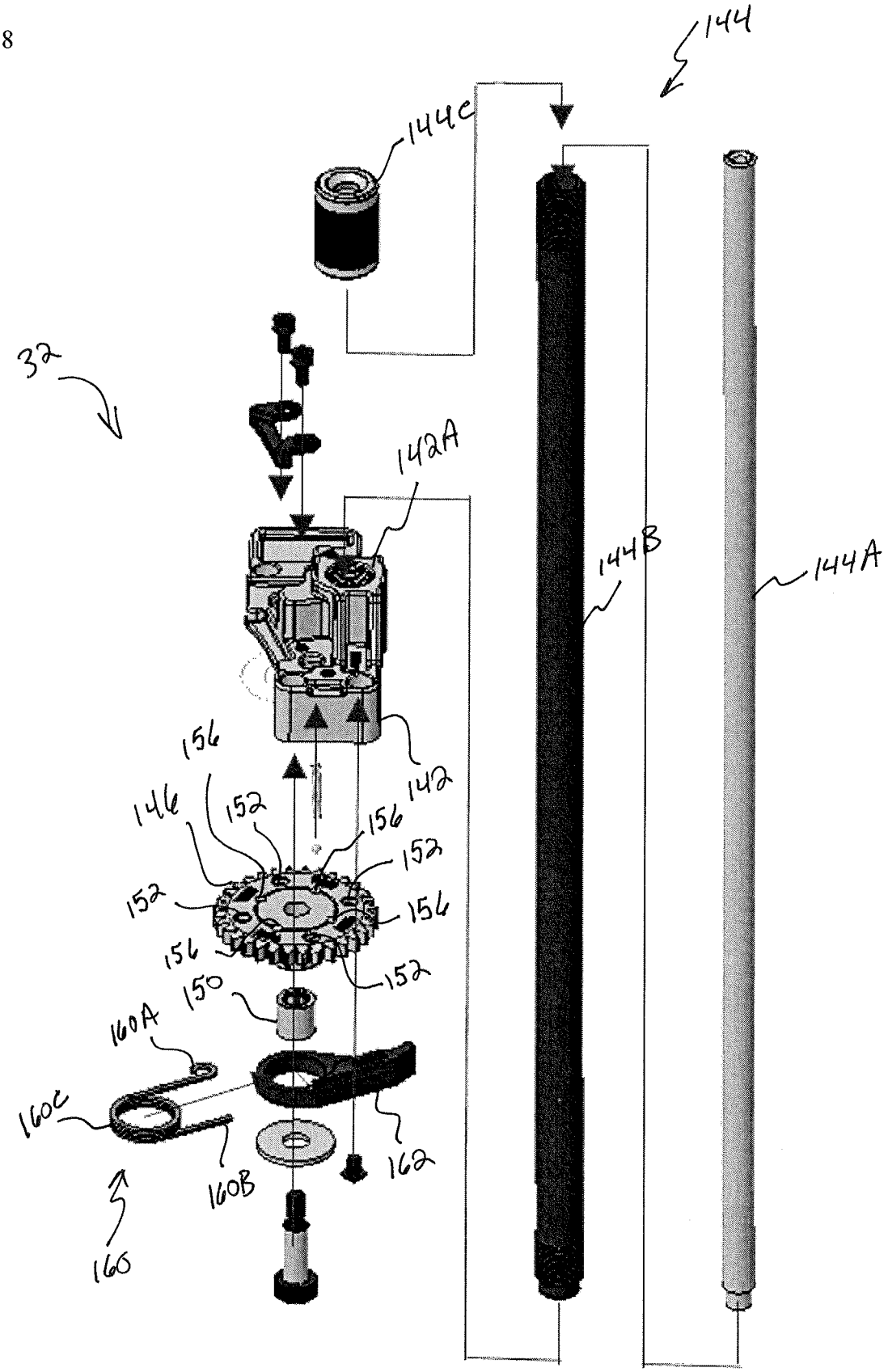
FIG. 38 is an exploded perspective of the primer feeder.
Figure 39:
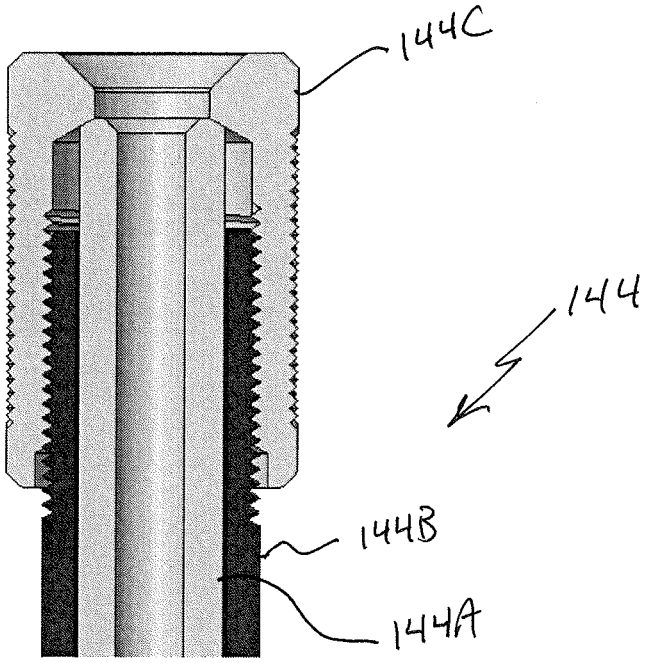
FIG. 39 is an enlarged fragmentary section of an upper end of the primer feeder.

The primer supply tube assembly 144 is shown in closer detail in FIGS. 38 and 39. The tube assembly 144 includes an inner primer feed tube 144A made of plastic or another suitable material. The tube assembly 144 also includes an outer shield tube 144B (broadly, "shield"). Desirably, the outer shield tube 144B is made of metal or another suitable material for resisting lateral explosion if primers in the tube assembly ignite. Such an explosion desirably exits the tube assembly upward rather than laterally to reduce potential for injury to the user. Referring to FIG. 39, the tube assembly 144 includes a threaded cap 144C that threads onto the shield tube 144B and engages a top end of the primer feed tube 144A to secure the primer feed tube in position. As shown in FIG. 41, the bottom end of the primer feed tube 144A has a reduced diameter creating a shoulder that rests on a lip of the feeder body 142. The lower end of the shield tube 144B is threaded to the feeder body 142 to secure the tube assembly to the feeder body.

Figure 40:
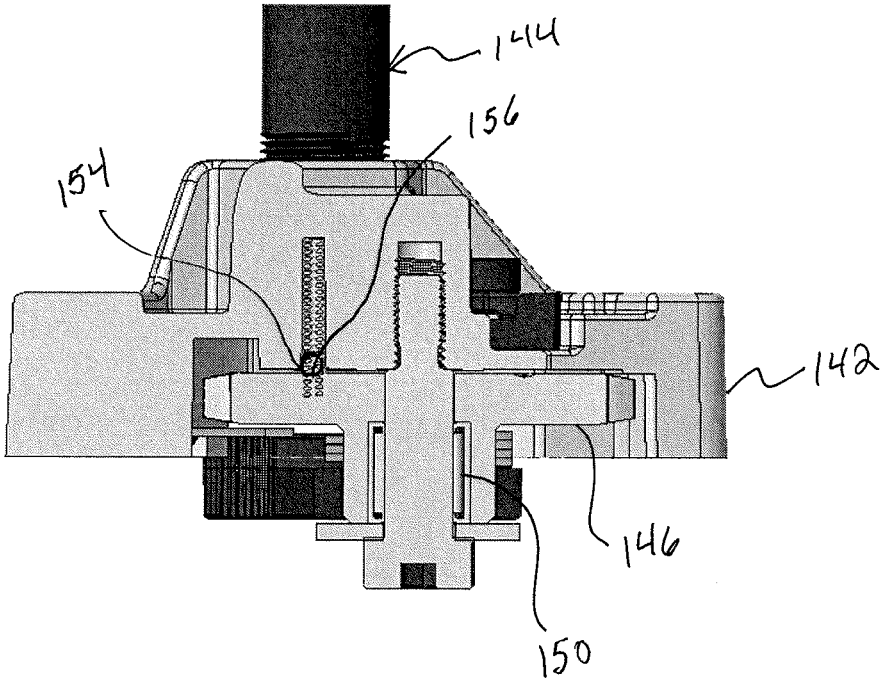
FIG. 40 is an enlarged fragmentary section of a lower end of the primer feeder.

As shown in FIG. 41, the primer gear 146 has a central opening receiving a bearing 150. The primer gear 146 is secured to the feeder body 142 by a fastener and an associated washer. The primer gear 146 rotates about the longitudinal axis of this fastener. The primer gear 146 has four primer holders 152 (e.g., stepped recesses having shoulders for supporting primers therein) spaced around the primer gear at intervals of about 90 degrees. The primer gear 146 is rotatable about the fastener to present a primer holder 152 to receive a primer from the bottom of the primer tube assembly 144. As shown in FIG. 40, a ball detent 154 and associated spring are captured in a pocket in the feeder body 142 and configured to nest in index openings 156 spaced at 90 degree intervals around the primer gear 146. The ball detent 154 facilitates locating the primer holders 152 in proper position to receive primers from the primer tube assembly 144 and for presenting primers to be inserted in cases.

The primer gear 146 has teeth 146A configured to mesh with the teeth 62A of the case carriage gear 62 such that the primer gear is driven by the gear of the case carriage. Accordingly, each time the case carrier 58 is indexed, the primer gear 146 is indexed too. The gears 62, 146 are sized so that as the case carrier 58 is indexed forward one station, the priming gear rotates 90 degrees, which causes a new primer to be located directly between the priming pin 134 and the center axis of the case in the fifth station S5. When the ram 46 is lowered, the priming pin 134 presses the new primer into the bottom of the case.

The primer feeder 32 includes a clutch spring 160 installed over a boss of the priming gear 146. The clutch spring 160 has a looped end 160A secured to the feeder body 142 by a fastener. A second end 160B of the clutch spring 160 is captured by a lever 162 that has an opening received over the boss of the priming gear 146. A coil 160C of the clutch spring 160 wraps around the boss of the primer gear 146. The arrangement is such that the coil 160C permits clockwise rotation of the priming gear 146. However, counter-clockwise rotation of the priming gear 146 is prevented because such motion of the priming gear boss in the clutch spring coil 160C causes the coil to constrict the boss. It will be appreciated that the case carrier 58 is likewise prevented from turning backwards (clockwise direction for the case carrier) because its gear 62 is in mesh with the primer gear 146 and is effectively stopped by the clutch spring 160. If desired, the user can release the clutch spring 160 by pulling the lever 162 laterally, which causes the lever to pivot about the primer gear boss and to bring the associated end 160B of the clutch spring with it, thus loosening the coil 160C on the hub. The primer gear 146 and case carrier 58 can be turned backward while the user holds the release lever 162 against the bias of the clutch spring 160.

In another aspect of the clutch spring 160, the spring acts as an index damper for the case carrier 58. Providing damping to the case carrier movement can help prevent powder spillage and reversal of case carrier 58. As explained above, the case holders 64 of the case carrier are located in the stations by engagement of a ball detent 72 with notches 58A in the case carrier. When the detent ball 72 begins to engage a notch 58A in the case carrier 58, the case carrier may jump forward abruptly and outrun the index mechanism. This can cause the case carrier 58 to jerk the cases and result in spilled powder, which reduces the consistency of the powder charge weights and can clog the press and affect the indexing and priming functions. Rotating the case carrier backwards (while sometimes necessary to correct a malfunction) can lead to dangerous conditions such as double charges of powder and crushed primers. The clutch spring 160 on the primer gear 146 induces a small amount of drag on the case carrier 58. This prevents the case carrier from "jumping" ahead of the index mechanism and reduces powder spillage. The friction of the clutch spring 160 on the boss of the primer gear 146 is transmitted to the case carrier 58 via the meshed teeth of the gears. It will be appreciated that the clutch spring 160 can be referred to as a case carrier movement damper or rotation damper.

In one aspect of the primer gear 146, the primer holders 152 are separated from each other sufficiently to prevent a chain reaction in the event that a primer is inadvertently ignited in the primer gear. For example, if a primer in position to be pushed into a case is inadvertently ignited (e.g., by the priming pin), that primer is separated from the other primers in the primer gear, and from all of the primers in the primer tube assembly. The ignited primer would not generate a chain reaction of primers igniting up the primer tube assembly 144.

It will be appreciated that the primer feeder 32 can be removed from the frame 14 as a self-contained unit. The primers do not need to be removed from the primer tube assembly 144 before removing the primer feeder 32. When the primer feeder 32 is disconnected, the ball detent 154 of the primer feeder engaging the primer gear 146 holds the primer gear in position to prevent the gear from inadvertently rotating and dispensing primers. Desirably, a kit of two primer feeders 32 is provided with the press 12 such that the operator can change between a first primer feeder for feeding small primers and a second primer feeder for feeding large primers. The large primer feeder would have essentially the same construction as shown in FIGS. 37-41 but would have an inner feed tube 144A of larger diameter, and the primer holders 152 of the primer gear would be larger. Accordingly, the process of changing the press system over from loading different types of cases can be made simpler by permitting the user to change out the self-contained primer feeder 32. This is more convenient than conventional systems in which converting the priming system between large and small primers is difficult and time consuming.

Figure 42:
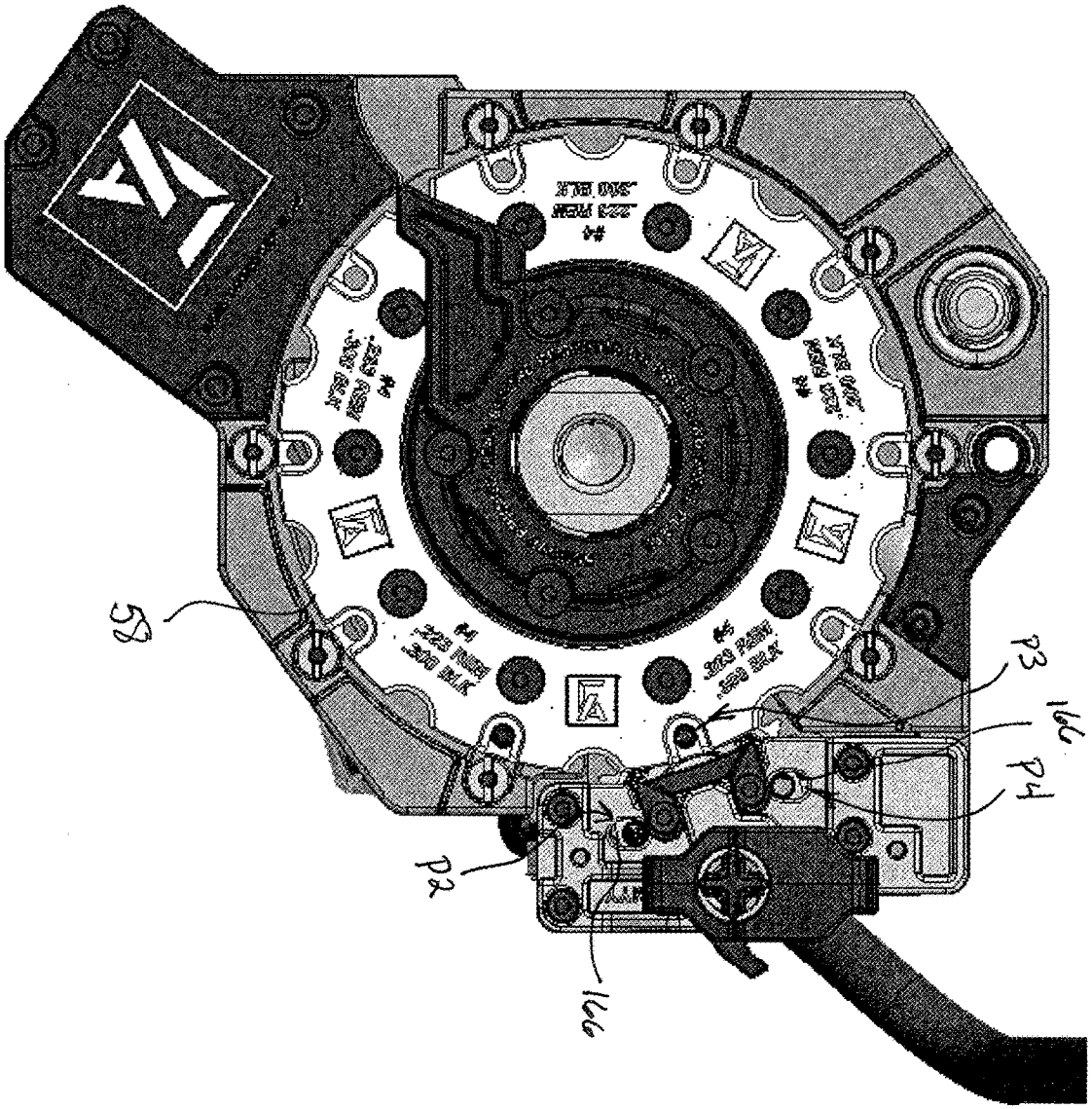
FIG. 42 is a top view of the primer feeder installed on the frame.
Figure 43:
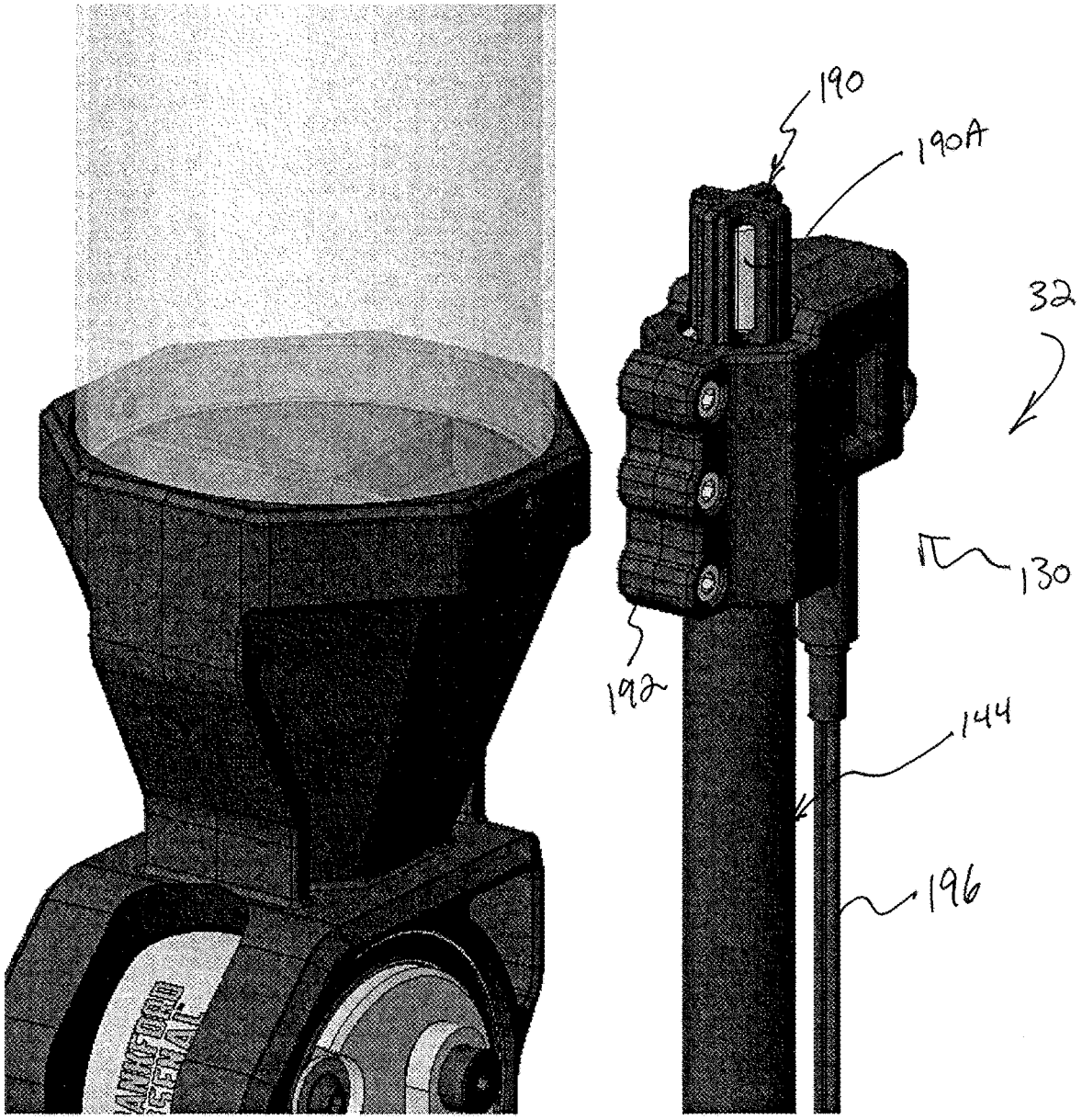
FIG. 43 is a fragmentary perspective of an upper end of a powder dispenser.
Figure 44:
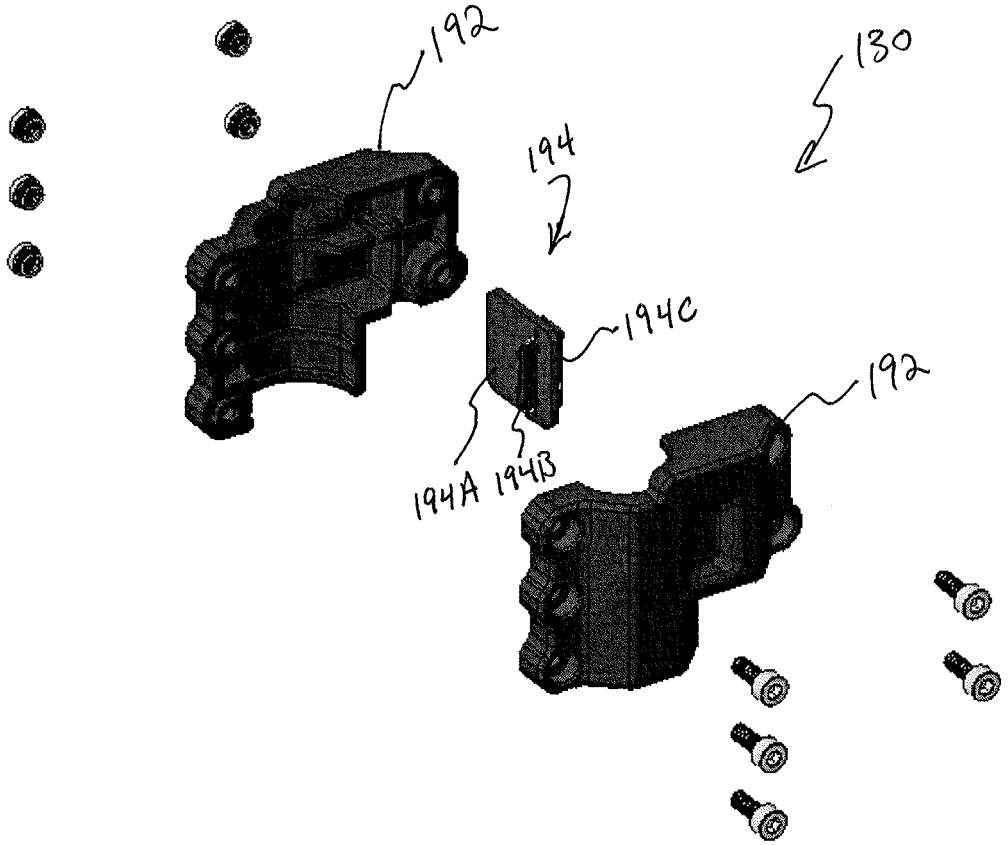
FIG. 44 is an enlarged exploded perspective of a low primer sensor assembly.
Figure 45:
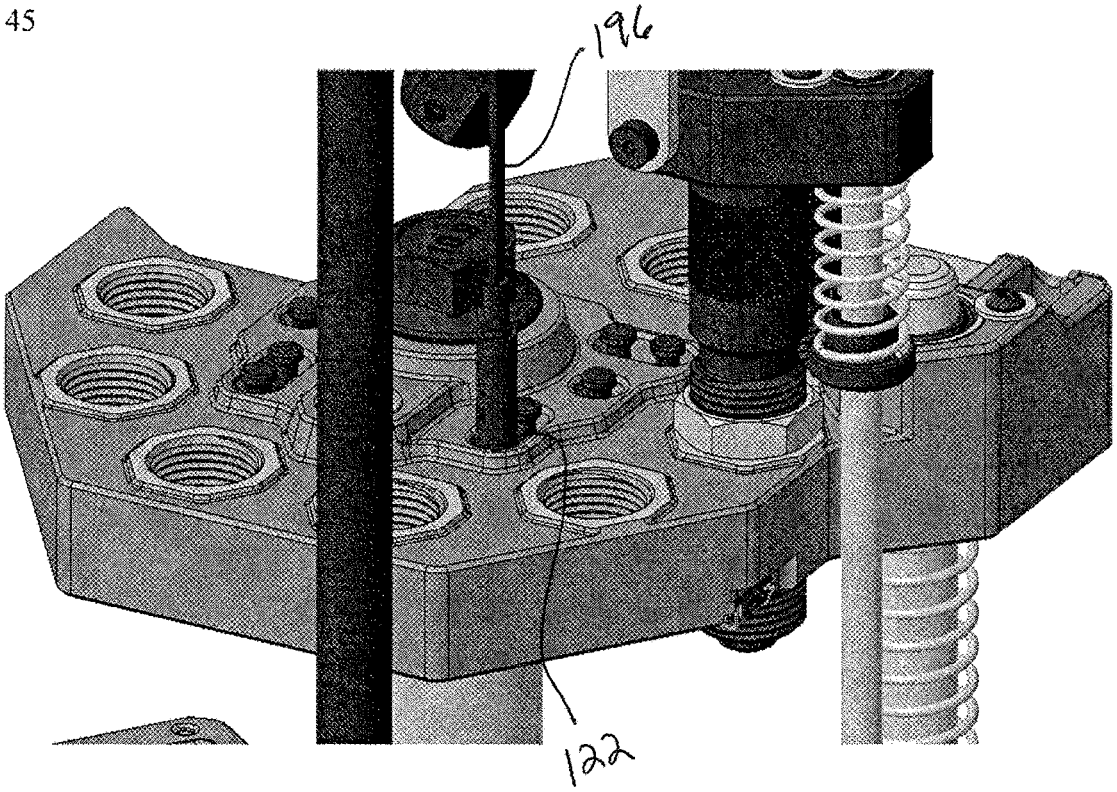
FIG. 45 is a fragmentary perspective of a lower end of a cord from the low primer sensor assembly connected to a port in the upper tool head.
Figure 46:
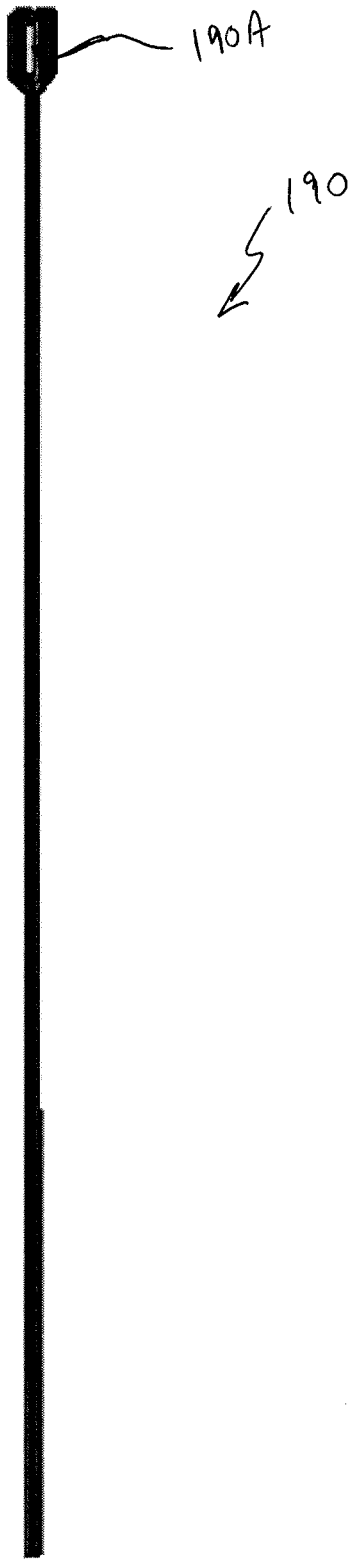
FIG. 46 is a perspective of a primer follower.

As mentioned above, each advancement of the case carrier 58 causes the primer gear 146 to advance a quarter turn. Thus, the primer gear 146 moves the four primer holders 152 through four stations P1-P4. In the first station P1, the primer holder 152 is located under the primer tube assembly 144 for receiving a primer. In the third station P3, the primer is located under the case carrier 58 and above the priming pin 134 for installing the primer in a primer pocket of a case. The second and fourth primer stations P2, P4 serve as valuable witness stations. As shown in FIG. 42, the feeder body 142 includes first and second witness openings 166 corresponding to the second and fourth primer stations P1, P4. The witness openings 166 permit the user to see the primer holders 152 in the second and fourth primer stations P2, P4. The second primer station P2 serves as a witness station where the operator can visually confirm that a primer is present in the primer holder 152 (i.e., that a primer has successfully loaded into the primer holder from the feed tube). Thus, the user can confirm a primer is "on deck" to be installed in a future case. The fourth primer station P4 serves as a witness station for the operator to visually confirm that a primer is not present in the primer holder (i.e., that the primer was successfully loaded into the case). If primer insertion did not happen properly, the primer may have been crushed and remains in the primer holder 152 at the fourth station P4. The fourth station provides the operator an opportunity to remove the damaged primer from the primer gear 146. If a case was not present when the priming pin 134 pushed the primer upward, the primer would return downward to the primer holder 152 and would subsequently travel to the fourth primer station P4. An undamaged primer in the fourth priming station does not need to be removed. The primer would remain in the primer holder 152 as it turns under the primer tube assembly 144 and would prevent another primer from falling into the primer holder. The primer gear 146 can be referred to as "recirculating" because it recirculates primers not picked up by a case.

Figure 47:
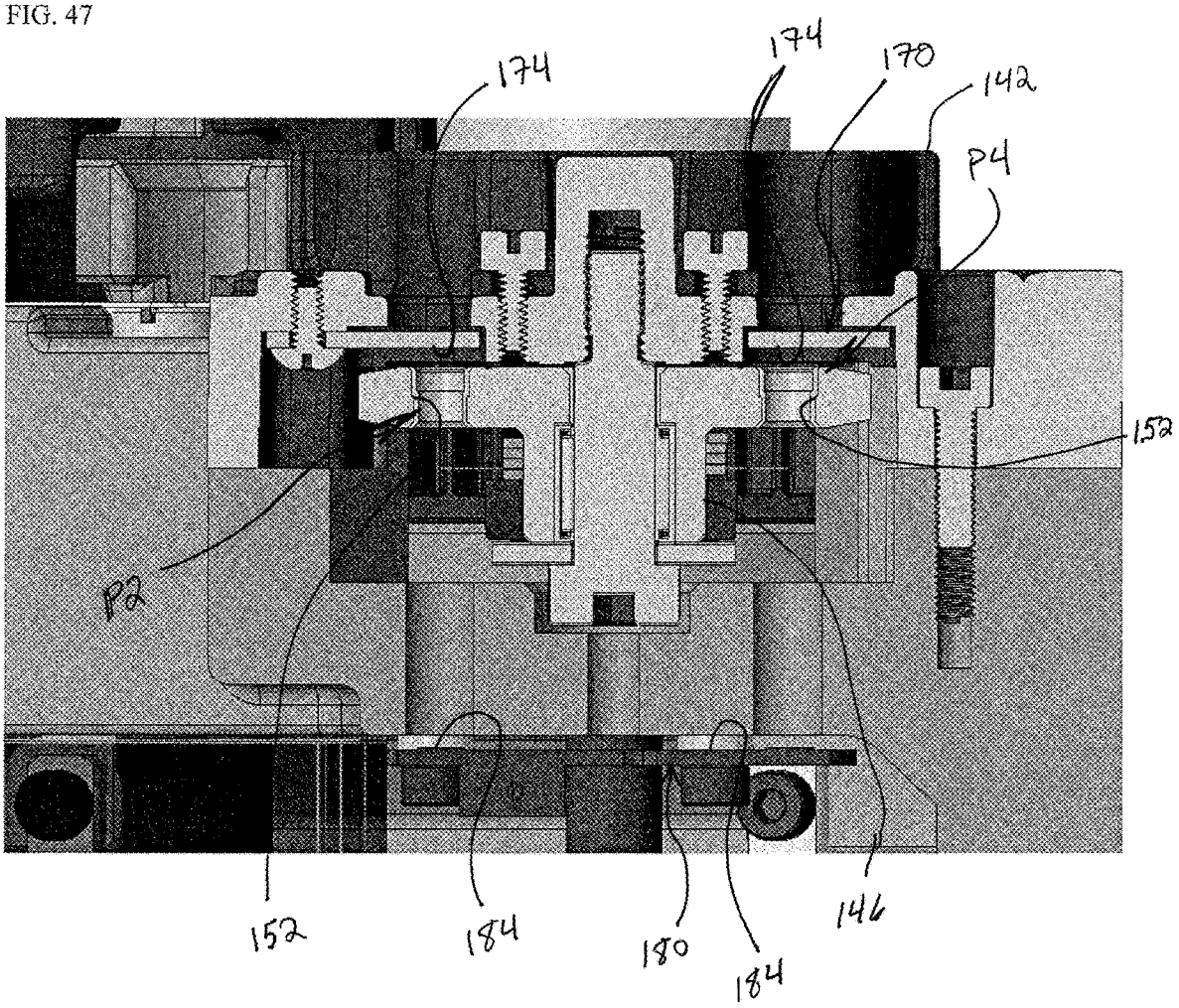
FIG. 47 is an enlarged fragmentary section of the frame and primer feeder with an automatic primer detector system.
Figure 48:
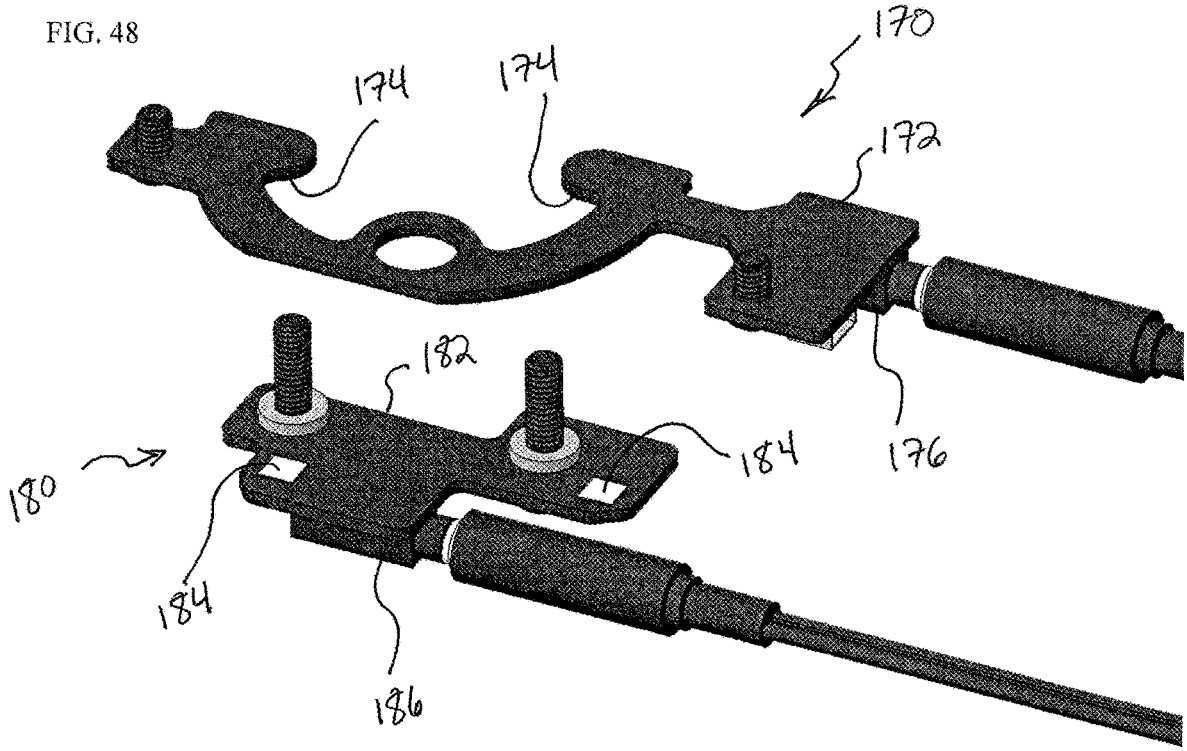
FIG. 48 is a perspective of components of the automatic primer detector system.
Figure 49:
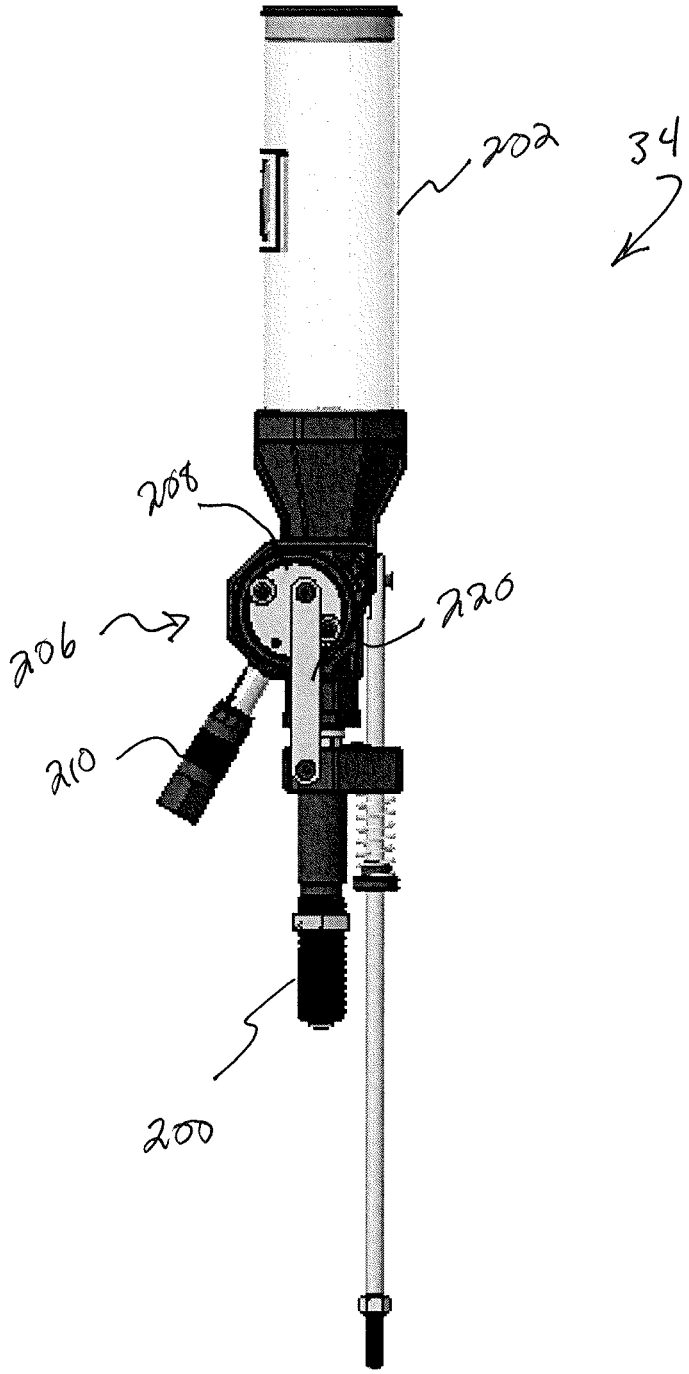
FIG. 49 is a side elevation of a power dispenser in a non-actuated configuration.
Figure 50:
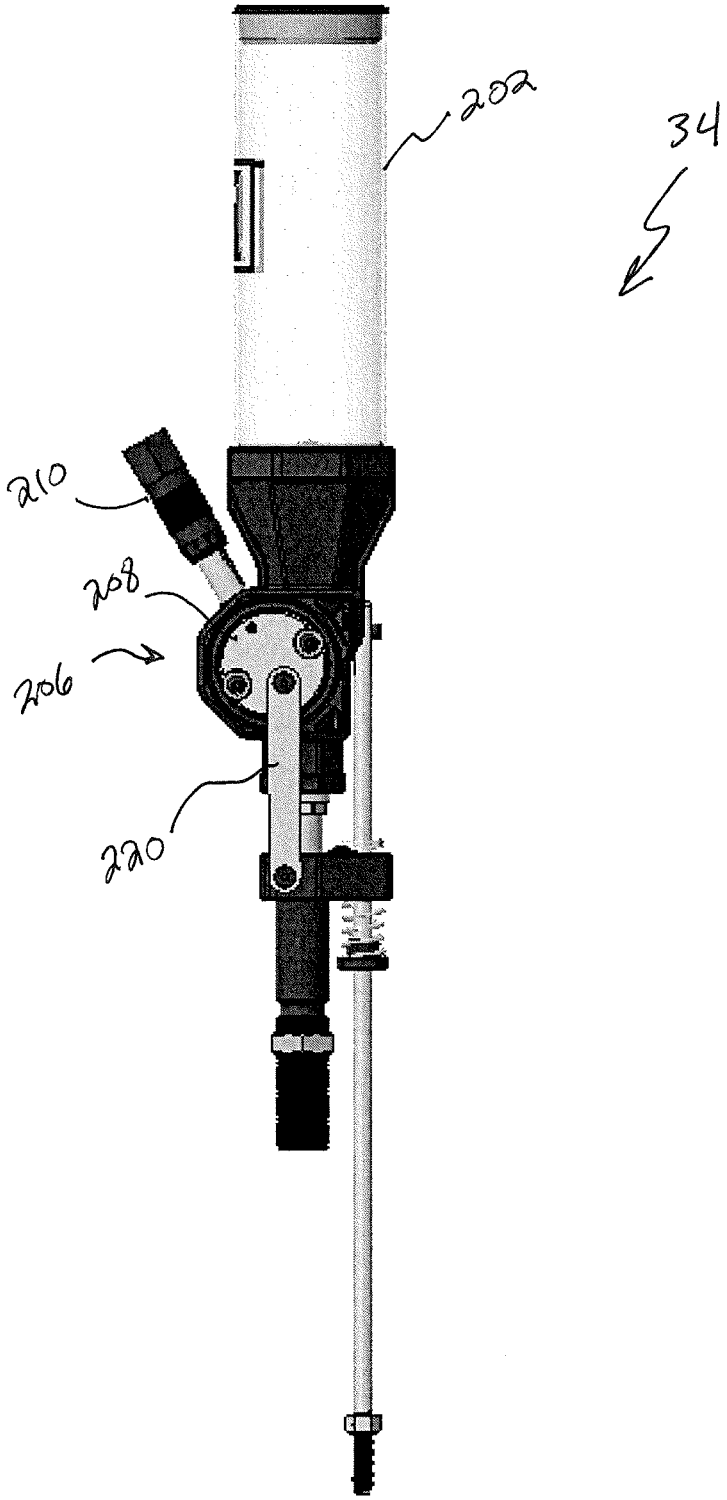
FIG. 50 is a side elevation of the powder dispenser in an actuated configuration.

Referring to FIGS. 47 and 48, the witnessing of the second and fourth primer stations P2, P4 can be automated. As shown in FIG. 48, a first circuit board assembly 170 can be configured to include a circuit board structure 172, two photo sensors 174 (broadly, "primer detectors" 134), a power and communication port 176 (e.g., 3.5 mm socket), and circuitry operatively connecting these components. A second circuit board assembly 180 can be configured to include a circuit board structure 182, two LEDs 184 (broadly, "primer holder illuminators" 132), a power and communication port 186 (e.g., 3.5 mm socket), and circuitry operatively connecting these components. Referring to FIG. 47, the first circuit board assembly 170 is mounted by fasteners to the feeder body 142 such that the photo sensors 174 overlie and look downward toward the primer holders 152 in the second and fourth primer stations P2, P4. The second circuit board assembly 180 is mounted by fasteners to the frame 14 such that the LEDs 184 face upward and are in registration with openings in the frame below the second and fourth primer stations P2, P4. The light from the LED 184 associated with the second primer station P2 should always be blocked by a staged primer, and the light from the LED 184 in the fourth primer station P4 should always be able to pass through the primer holder 152 to be sensed by the photo sensor 174. Any failure to satisfy one of these conditions would result in an alarm (or a stoppage if the automation kit is attached). The tangible storage medium 114 of the press control system 110 can include instructions to signal an alarm, such as by strobing the LEDs 120, changing the colors of the LEDs 120, and/or energizing an audible alarm 116B, when one of the conditions is not met. The photo sensors 174 detect the presence or absence of a primer by the absence or presence of light.

Figure 30:
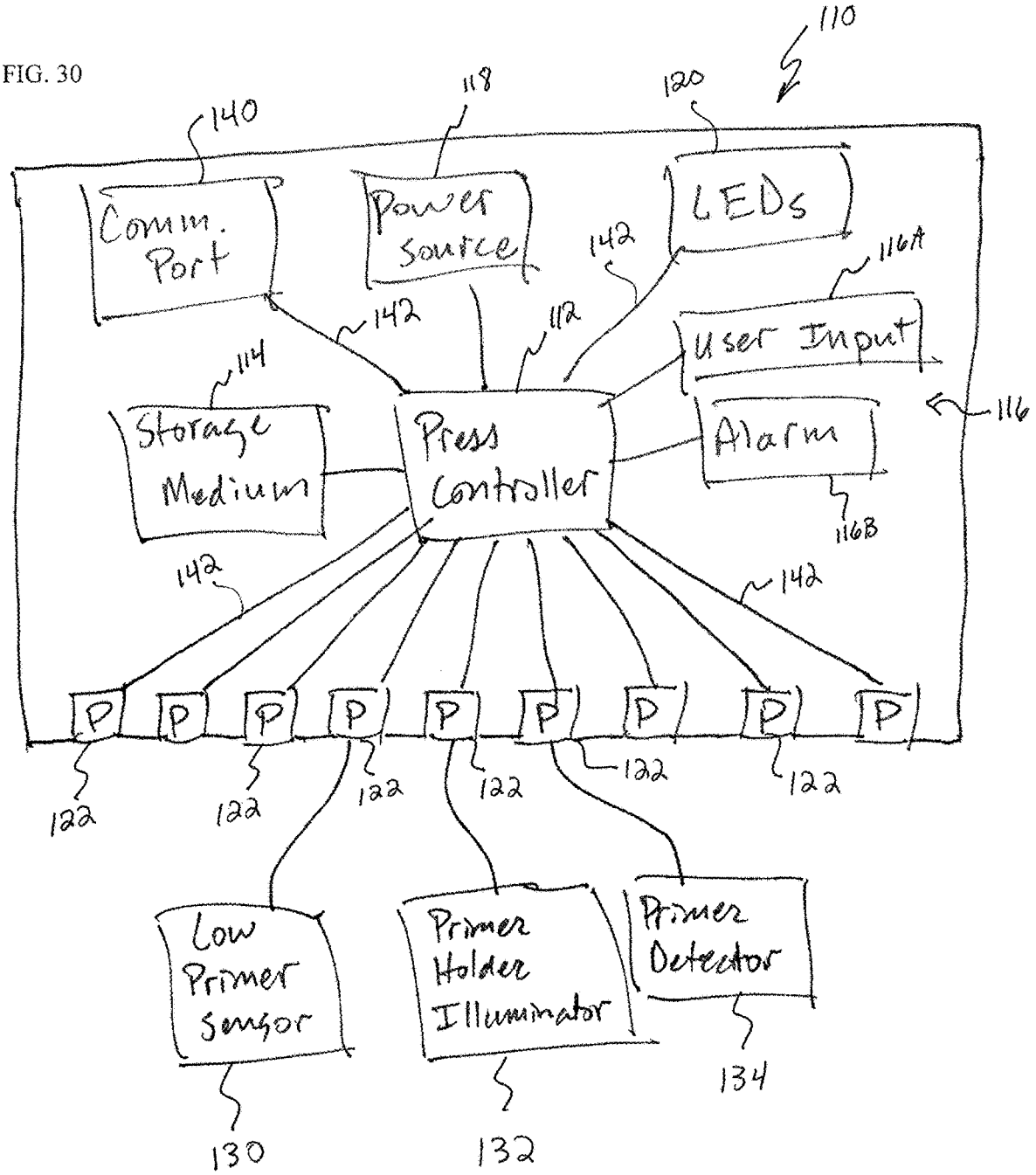
FIG. 30 is a schematic of a control system of the ammunition press system.

Referring to FIGS. 30 and 48, the first and second circuit board assemblies 170, 172 can be connected to respective ports 122 of the upper tool head 18 for providing power thereto and communication of the sensor signal to the press controller 112. Alternatively, the first and second circuit board assemblies 170, 180 could be tethered together with one of them (e.g., the first circuit board assembly) being connected to a port 122 of the upper tool head 18, for providing power to both of the circuit board assemblies, and communication from the photo sensors 174 to the press controller 112.

It will be appreciated that other types of primer detectors can be used without departing from the scope of the present disclosure. For example, one or more mechanical switches can be used instead of an optical switch or photo sensor.

Referring to FIGS. 43-46, the primer feeder 32 can be configured to automatically indicate whether the stack of primers remaining in the primer feed tube assembly 144 is low or has run out. This is can be accomplished by installing a primer follower 190 in the primer feed tube 144A. The follower 190 has a bottom end that rests on the top of the stack of primers. The primer follower has an upper end that includes a cylindrical magnet 190A. In the illustrated embodiment, the magnet 190A is overmolded to capture the magnet and connect it to an upper end of a shaft of the follower. As primers are removed from the bottom of the stack, the stack of primers shortens, and the primer follower moves downward.

A low primer sensor 130 is provided on the upper end of the primer feed tube assembly 144 for sensing when the magnet 190A moves near the low primer sensor. In the illustrated embodiment the low primer sensor 130 includes a sensor support body 192 having first and second portions secured together by fasteners. The body portions capture a printed circuit board assembly 194 which includes a printed circuit board structure 194A, a Hall effect sensor or magnetic Hall switch 194B, a power and communication port 194C (e.g., 3.5 mm socket), and circuitry operatively connecting the components. When the body portions are secured to each other, the body 192 captures the upper end of the primer tube assembly, and the port 194C is accessible to permit connection of a cord 196 (e.g., cable having opposite ends including 3.5 mm jacks). As shown in FIG. 30, the opposite end of the cord 196 can be connected to a port 122 of the upper tool head for providing power to the printed circuit board assembly 194 and providing communication to the press controller 112.

When the stack of primers reduces in height, eventually the magnet 190A of the primer follower 190 becomes close enough to the Hall effect switch 194B to cause it to change state, which is communicated to the press controller via the cord 196. The press controller 112 executes instructions stored on the tangible storage medium 114 to, after the change in state is detected, generate an alarm, such as by strobing the LEDs 120, changing the color of the LEDs 120, and/or energizing an audio alarm 116B. When the user removes the primer follower 190 to install more primers, the magnet 190A moves away from the sensor 194B and the alarm stops, and the cycle begins again. It will be appreciated that the low primer sensor 130 does not have a mechanical fatigue limit and should yield long life. Optionally, the sensor signal could be communicated to a control system component offboard the press via the communications port.

Figure 51:
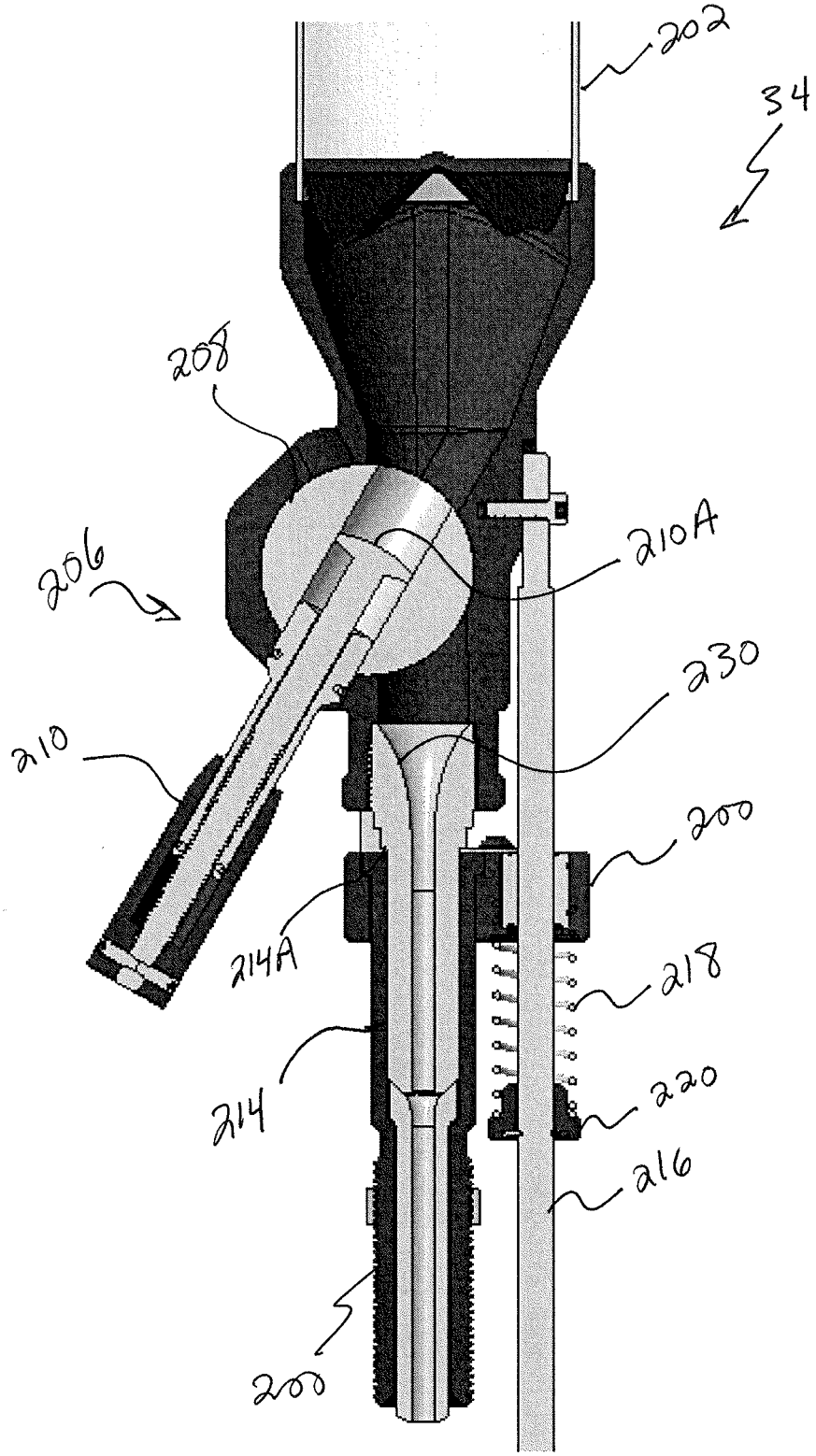
FIG. 51 is an enlarged fragmentary section of the powder dispenser in the non-actuated configuration.

Referring to FIGS. 49-52, the powder dispenser 34 will be described in further detail. The powder dispenser includes a threaded stem 200 and a powder hopper 202 supported by the stem. The powder hopper 202 is configured to funnel powder into a powder measure 206. The powder measure includes a drum 208 and a micrometer 210. The micrometer 210 is adjustable to change a position of a plunger 210A in the drum 208 to change a volume of a cavity in the drum for receiving powder. The hopper 202 and powder measure 206 are connected to a powder delivery tube 214. The powder delivery tube 214 has a shoulder 214A that rests on an upper end of the stem 200 to locate the tube with respect to the stem. A lower end of the powder delivery tube 214 extends out of the bottom end of the stem 200 and is positioned to be engaged by a case mouth. For example, the stem 200 could be installed in the upper tool head 18 in the die mount 38 corresponding to the seventh station S7. When the upper tool head 18 is lowered, the lower end of the powder delivery tube 214 (broadly, "activator rod") engages the case mouth, which causes the powder delivery tube to be pushed upward. This raises the shoulder 214A of the powder delivery tube off the upper end of the stem 200 and raises the drum 208 and hopper 202. This movement causes links 220 connected off-center to the drum 208 and to the stem to cause the drum to rotate to raise the powder measure 206, shown by comparison of FIGS. 49 and 50. Referring to FIG. 51, when the powder measure 206 is pivoted upward, a mouth of the drum 208 opens to a chute below the drum leading to the powder delivery tube 214 for delivery of the powder to the case below.

Figure 52:
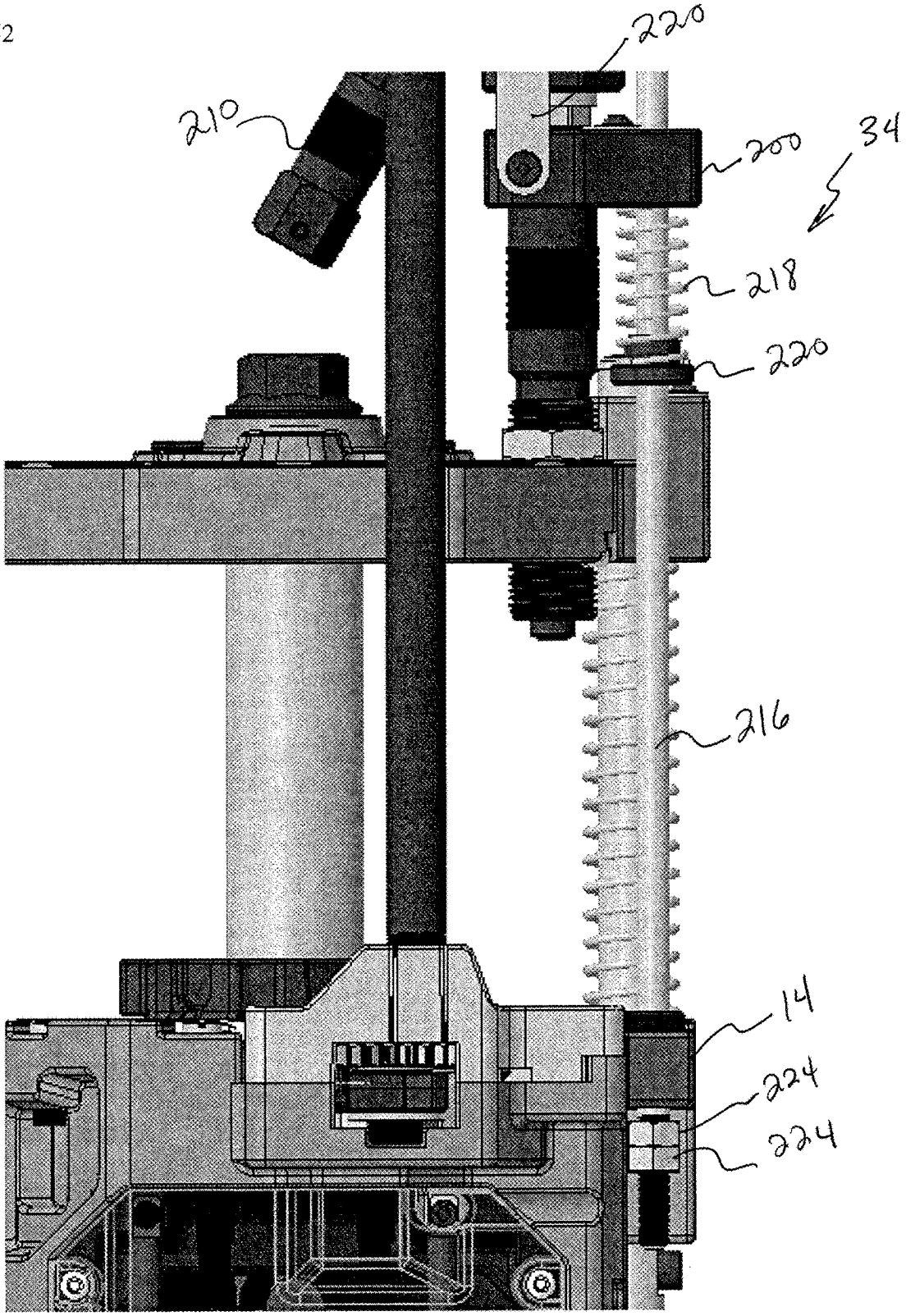
FIG. 52 is an enlarged fragmentary elevation of the powder dispenser and frame showing a powder dispenser guide rod and reset feature.

A guide rod 216 connected to the hopper 202 by two fasteners extends through an opening of the stem 200. A compression spring 218 on the guide rod 216 is captured between the stem 200 and a spring retainer 220 secured to the guide rod. The arrangement is such that when the hopper 202 is raised to cause the powder measure 206 to dispense powder, the guide rod 216 moves upward and the spring retainer 220 compresses the spring 218. The compression of the spring 218 and downward bias on the spring retainer 220 facilitates return of the powder measure 206 to the lowered position when the upper tool head 18 is raised. In some instances, the spring 218 may not provide sufficient force to reset the powder measure 206. For example, powder may block the drum 208 from pivoting. The powder dispenser 34 of the includes a reset feature to ensure the powder measure 206 resets even if the spring is not able to reset the powder measure. Referring to FIG. 52, a lower end of the guide rod 216 passes through an opening in the frame 16. Two nuts 224 are threaded onto the guide rod 216 below the opening in the frame. The nuts 224 are adjusted such that the upper nut is positioned (and the lower nut locks the position) to crash into the frame 16 if the powder measure 206 has not reset and the upper tool head 18 is moving upward. The engagement of the frame 16 with the nut 224 holds the guide rod 216 in position as the powder measure 206 moves upward, thus forcing the drum 208 to rotate and reset the powder measure. This will prevent the press from loading subsequent rounds with the powder measure 206 stuck in the activated position. Rounds loaded while powder measure is stuck will not receive powder, and can cause "squibs," which are rounds that do not have enough gas pressure to propel the bullet completely through the barrel. Squib rounds can be extremely hazardous to the shooter if they are not immediately recognized and subsequent rounds are fired.

Existing powder measures use a simple cone shape to funnel the powder through the outlet and into the case. This type of funnel can cause issues such as "bridging," "rat-holing," and "flooding" when used with coarse powders. The funnel 230 of the present disclosure a parabolic shape and does not have sharp edges that could cause stagnant flow and lead to such issues. The parabolic funnel 230 allows coarse powders to feed into cases as small as .20 caliber.

It will be appreciated that powder dispensers having other configurations can be used without departing from the scope of the present disclosure. Moreover, aspects of the powder dispenser can be used in benchtop powder measures (not on a press), and a stand-alone powder funnel kit, without departing from the scope of the present disclosure.

Figure 53:
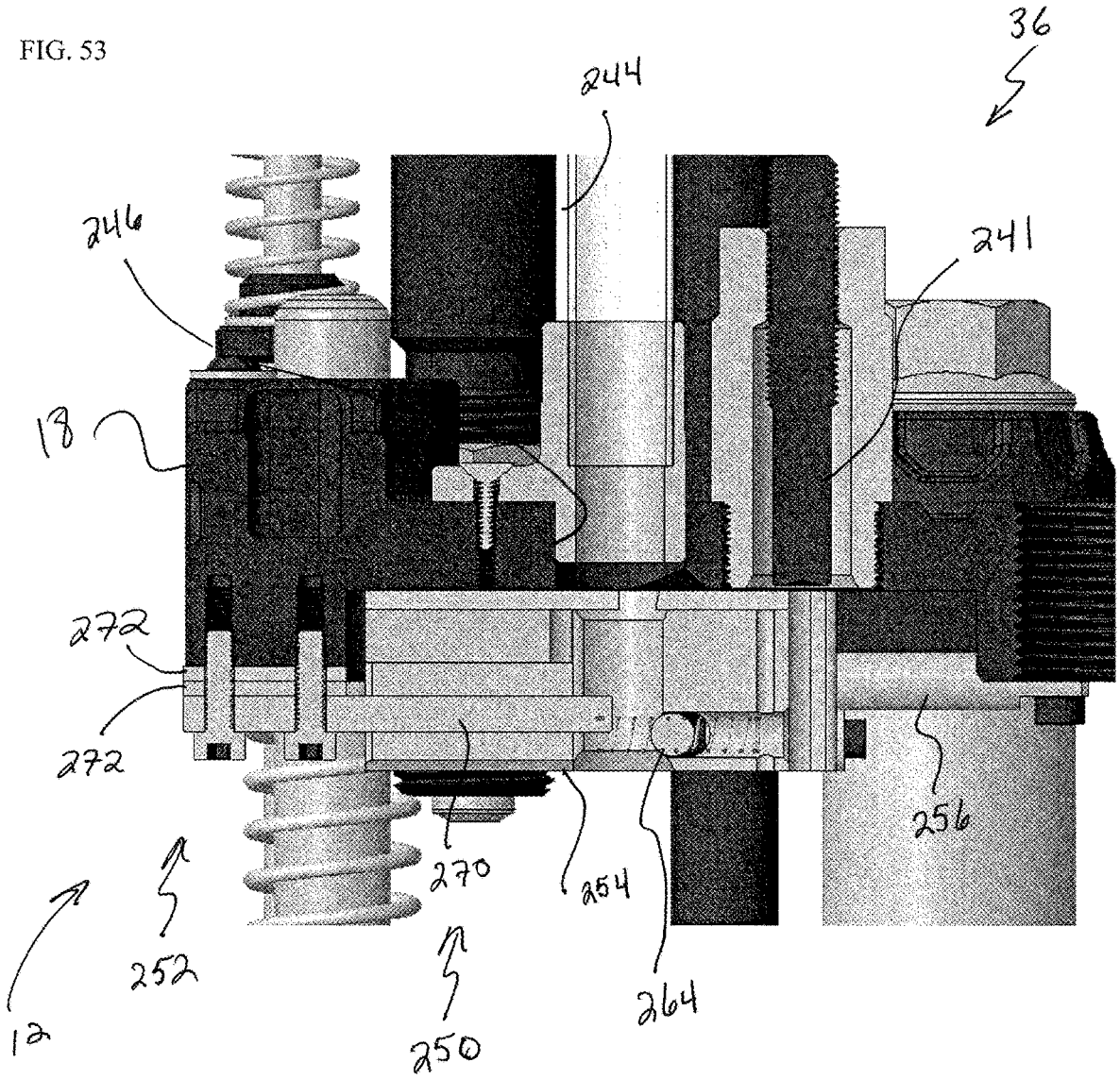
FIG. 53 is an enlarged fragmentary section of a bullet feeder on the upper tool head.
Figure 54:
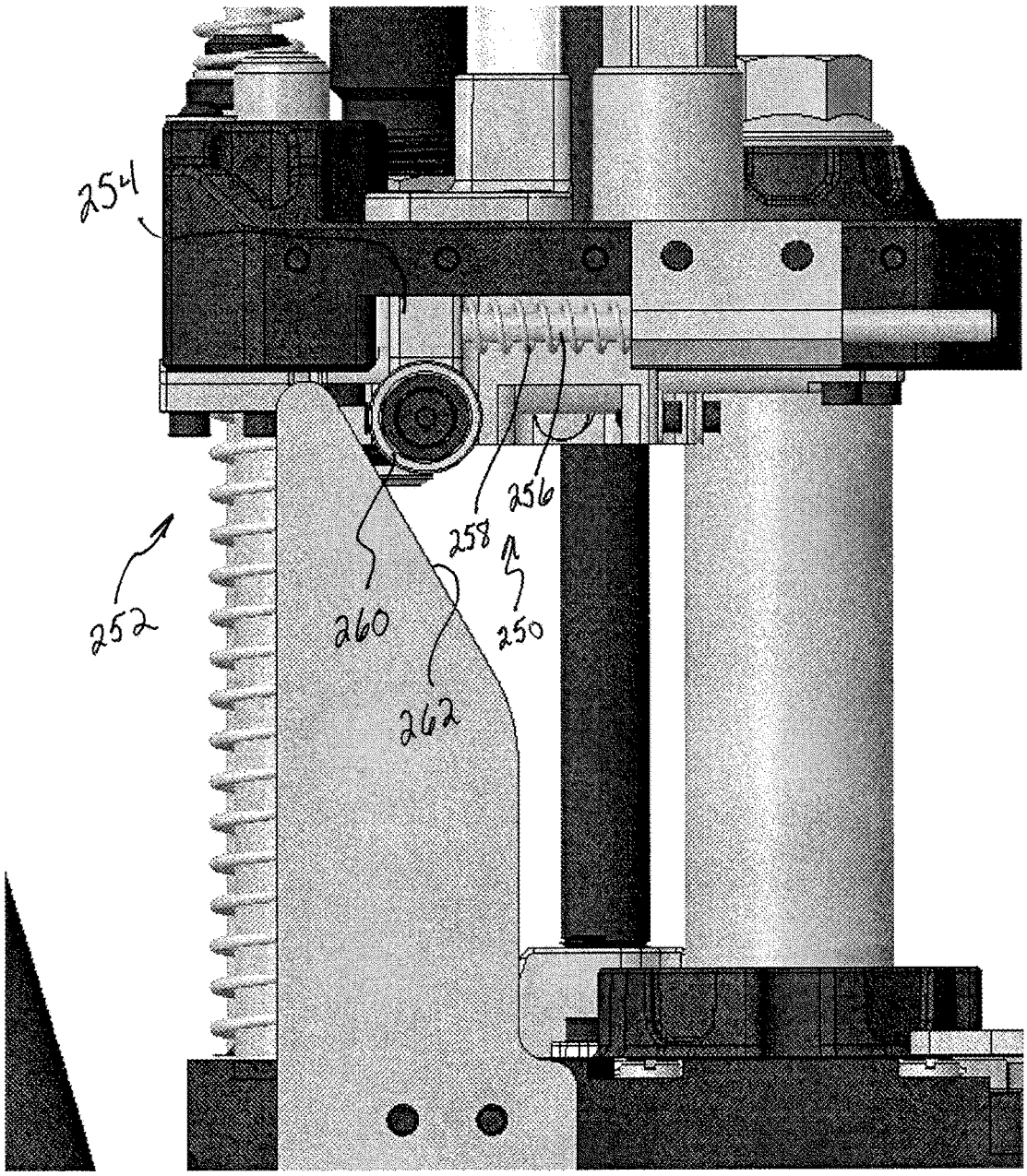
FIG. 54 is an enlarged fragmentary elevation of the bullet feeder showing drive components.
Figure 55:
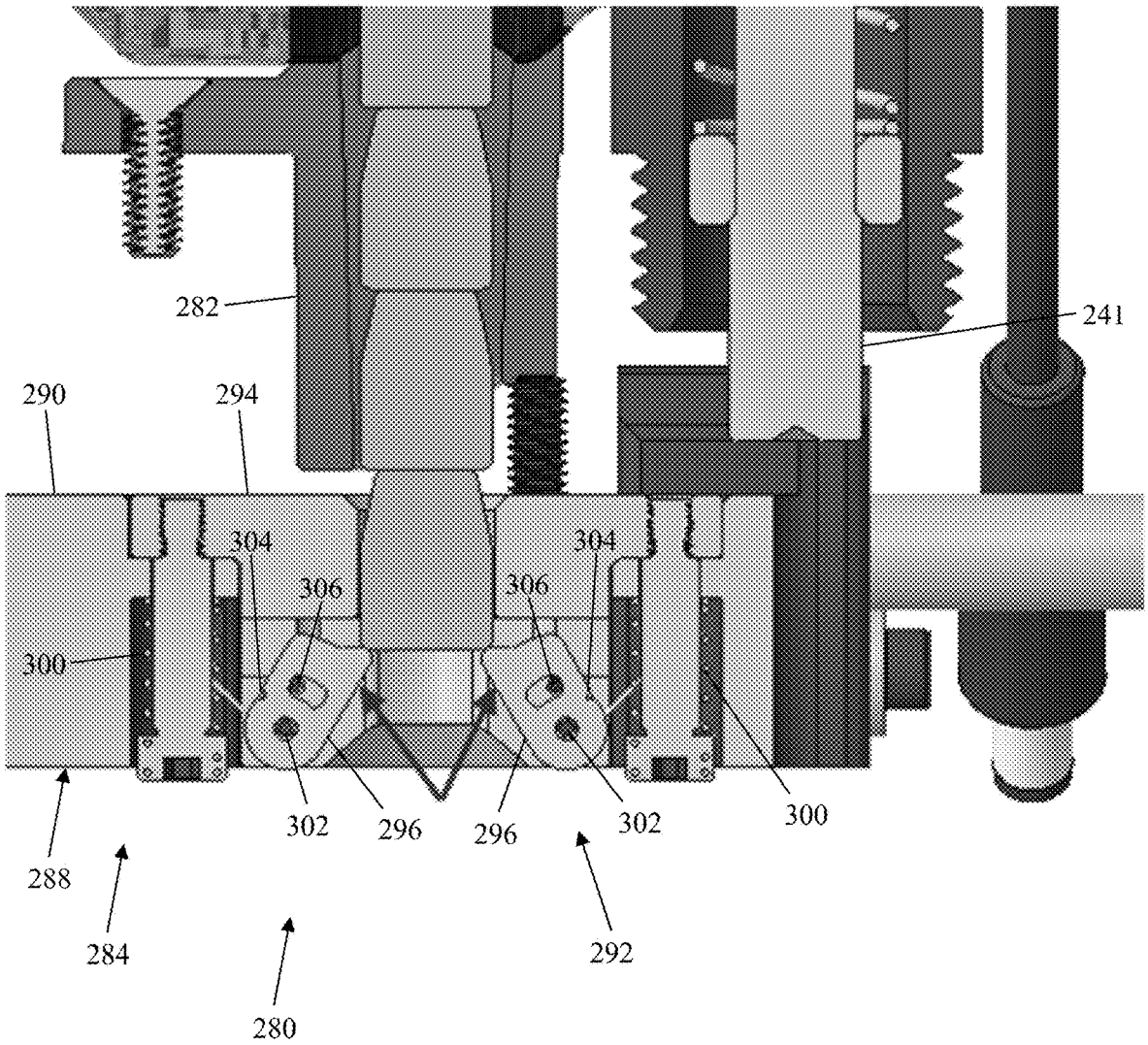
FIG. 55 is an enlarged fragmentary section of an alternative embodiment of a bullet feeder.

With reference to FIGS. 53-54, the press 12, and in particular the upper tool head 18, includes a provision for an integrated bullet feeder 36. The tool head 18 has clearance and mounting provisions for a proprietary bullet feeding system 36 which enables feeding and completely seating bullets in the same station S9.

In conventional case activated bullet feeders, the feeder threads into one of the die stations on the tool head, and places a bullet on top of a case as the tool head is lowered. The bullet is then required to ride on top of the case to the next station as the machine indexes, and is seated into the case by the next stroke of the ram. Requiring the bullet to ride on top of the case between stations creates the potential for the bullet to tip and crush the case as it is seated, or to fall off completely, potentially resulting in powder spillage and waste.

The bullet feeder 36 of the present disclosure attaches to the bottom of the upper tool head 18, and uses a shuttle 254 to place the bullet directly under the seating stem 241 of the seating die prior to the tool head 18 being lowered. As shown in FIG. 4, the upper tool head 18 includes a bullet feeder mount 242 including three openings for receiving fasteners to secure a bullet feeding tube 244 to the top of the tool head. The tool head 18 also includes a bullet feeder opening 246 to allow passage of bullets from the tube 244 to the shuttle below the tool head. The bottom of the tool head 18 includes openings for receiving fasteners to secure a shuttle assembly 250 of the bullet feeder 36 to the bottom of the tool head 18. The shuttle assembly 250 includes a shuttle mount 252 and a shuttle 254 movable with respect to the shuttle mount. The shuttle mount 252 includes a track 256 and a compression spring 258 biasing the shuttle toward a bullet receiving position in registration with the bullet feeder opening 246. As the upper tool head 18 moves downward, a bearing 260 (broadly, "wheel") carried by the shuttle 254 engages a ramp 262 that causes the shuttle to move to position the bullet in registration with the bullet seating stem 202 in the ninth station S9. The shuttle 254 includes a spring biased pin 264 (broadly, "bullet retainer") that functions to hold the bullet in the shuttle but permits the case to deflect the pin so the case can move upwardly past the pin to push the bullet against the seating stem 241 to seat the bullet into the case mouth. When the tool head 18 is raised, the bullet is held by the case and withdrawn from the shuttle 254 past the pin 224, and the shuttle returns to receive another bullet and the cycle repeats. Accordingly, bullet feeding and seating occurs at the same station S9.

The shuttle mount 252 can include an adjustable limiter 270 to accommodate different size bullets so that the shuttle 254 can move laterally without pinching the top of the bullet in the shuttle or the bottom of the next bullet in the feeder tube. The height of the limiter 270 can be adjusted by adding or removing spacers 272 between the limiter and the tool head 18. As the shuttle 254 moves under the seating station S9, the bullet drops off of the limiter 270 and onto the detent pin 264.

If the press 12 is cycled with no case in the bullet feeding station S9, the shuttle 254 will return to the feeder tube station with the bullet still sitting on the detent pin 264. The shuttle 254 will be pushed rearward until the bullet contacts the limiter 270. This will prevent the shuttle 254 from picking up an additional bullet from the feeder tube, but the spring 258 will not exert enough force to damage the bullet in the shuttle.

It will be appreciated that other configurations of bullet feeders can be used without departing from the scope of the present disclosure. For example, the limiter 270 can be omitted. Moreover, the shuttle may be located above the tool head 18 and deliver a bullet into a seating die (e.g., a side window in the seating die) from above the tool head to fall into position under the seating stem.

An alternative embodiment of a bullet feeder 280 is shown in FIGS. 55-58. In this embodiment, a bullet feeding tube 282 is connected to the top of the tool head 18 as in the previous embodiment. Likewise, this embodiment includes a shuttle assembly 284 including a shuttle mount and a shuttle 288. The shuttle mount is not shown in FIGS. 55-58, but it will be understood the shuttle mount is similar to the mount 252 described above, including a track and associated spring. The shuttle 288 is moveable from registration with the bullet feeding tube 280 to registration with the bullet seating stem 241 at the ninth station S9 in the same manner described above (bearing engaging ramp). In this embodiment, the shuttle 288 has a different configuration. The shuttle 288 includes a shuttle body 290 and a bullet holder 292 carried by the shuttle body. The bullet holder 292 includes a bullet cradle 294 and bullet gates 296 connected to the bullet cradle. The bullet cradle 294 is connected to the shuttle body 290 by two fasteners. Springs 300 on the fasteners are captured between heads of the fasteners and the shuttle body 290 such that the bullet holder 292 is biased downward into engagement with shoulders of the shuttle body, but the bullet holder is moveable upward against the bias of the springs. The bullet gates 296 are pivotable with respect to the bullet cradle 294 about pivot connections 302. Torsion springs 304 are provided on the pivot connections to bias the gates 296 toward bullet retaining positions. Pins 306 connected to the bullet cradle 294 are received in slots of the bullet gates 296 to limit movement of the gates under the bias of the torsion springs 304.

Figure 56:
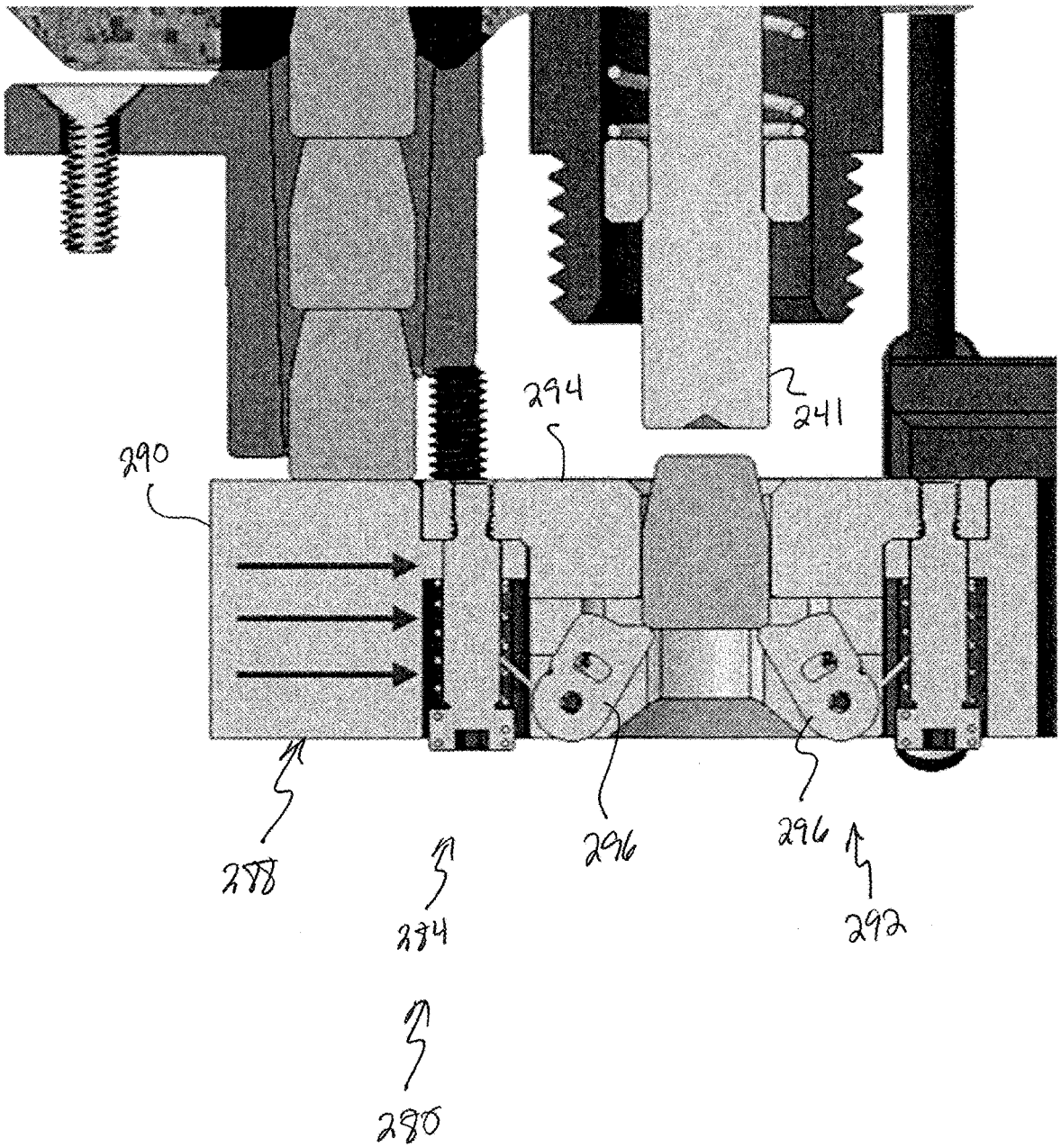
FIG. 56 is a view similar to FIG. 55 but showing a shuttle of the bullet feeder moved to position a bullet in registration with a bullet seating die.
Figure 57:
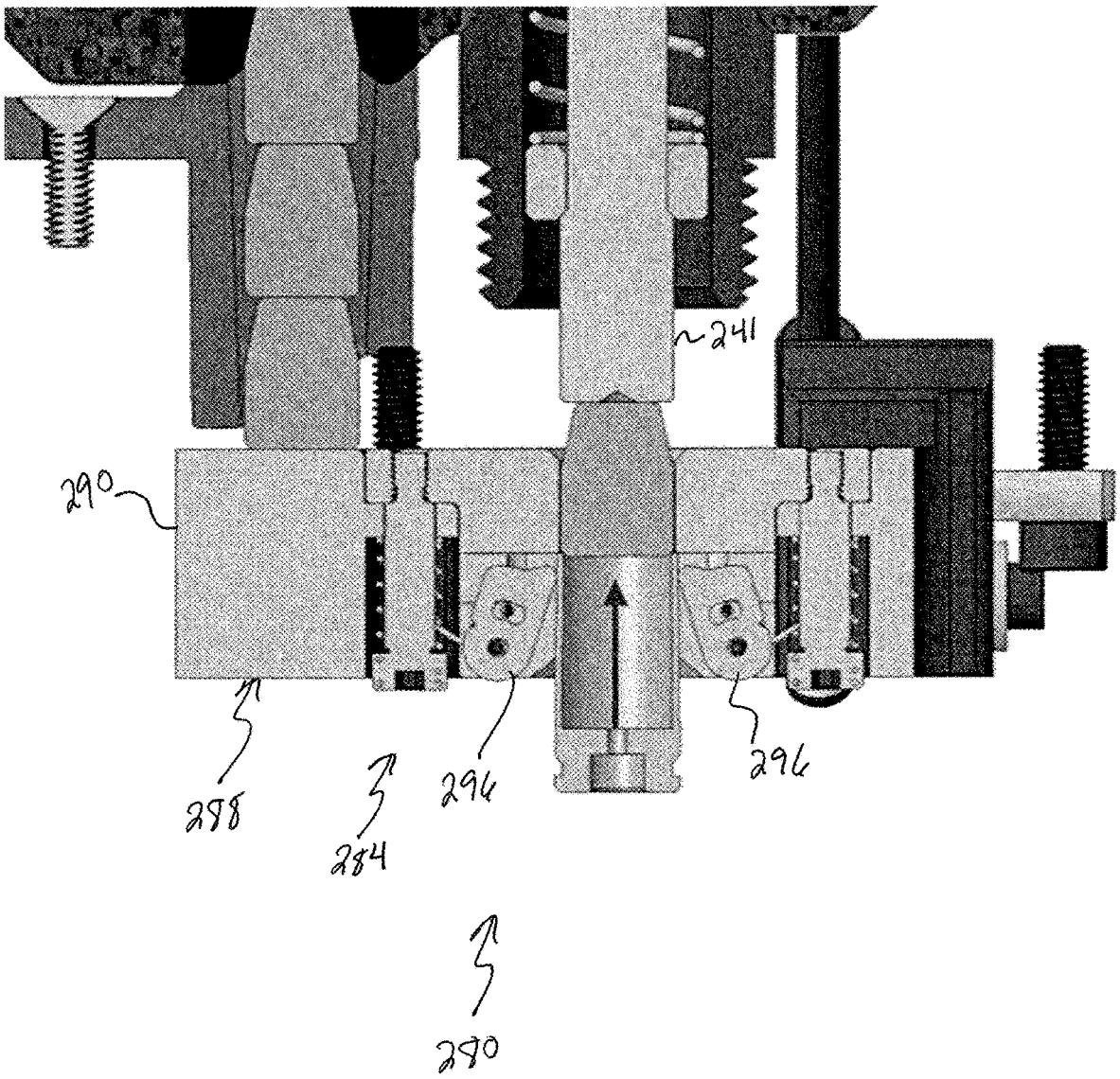
FIG. 57 is a view similar to FIG. 56 but showing a case entering the bullet feeder.
Figure 58:
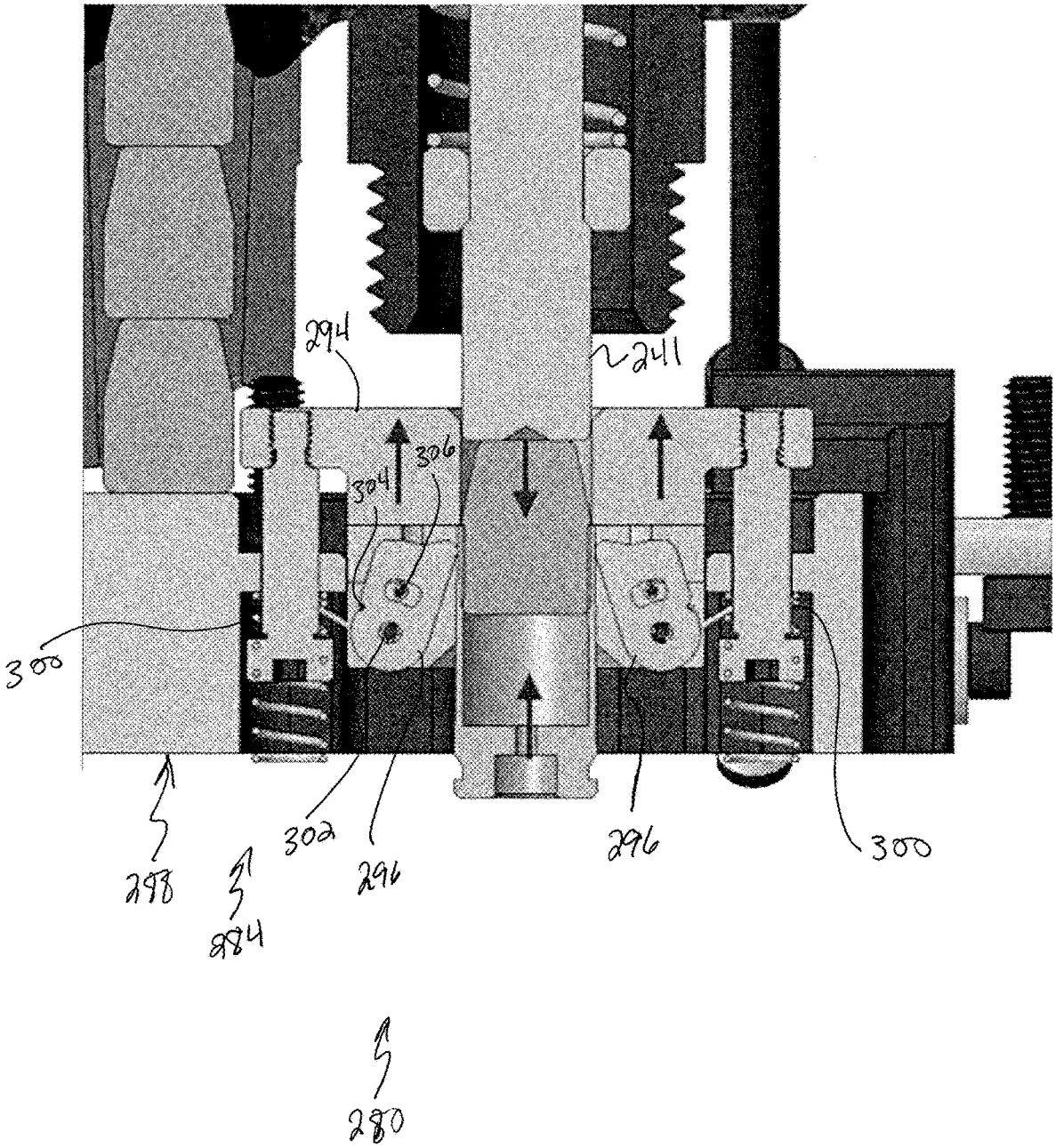
FIG. 58 is a view similar to FIG. 57 but showing the bullet being seated in the case.

When a bullet falls into the bullet cradle 294, the bullet rests on the bullet gates 296, as shown in FIG. 56. When the shuttle 288 moves to position the bullet in registration with the seating stem 241 at the ninth station S9, the next bullet in the stack falls onto an upper surface of the shuttle 288, as shown in FIG. 56. Referring to FIG. 57, when the tool head 18 moves downward, the case engages the gates 296 and deflects them laterally out of the way. The case carries the bullet upward for engagement with the seating stem 241. Desirably, the cradle 294 has a relatively tight fit to the bullet to prevent the bullet from tipping. As shown in FIG. 58, as the bullet is pressed into the mouth of the case to the proper seating depth (adjustable via adjustment of the seating die), the bullet holder 292 moves upward. The case mouth engages the bottom of the bullet cradle 294 and causes the bullet holder 292 to move upward against the bias of the springs 300. When the upper tool head 18 is raised, the bullet is held by the case and withdrawn from the gates 296, and the gates return to the bullet retaining positions. When the shuttle 288 returns to locate the bullet holder 292 in registration with the bullet feeder tube 280, the next bullet falls from the top of the shuttle into the bullet cradle 294 onto the gates 296, and the cycle repeats.

Figure 59:
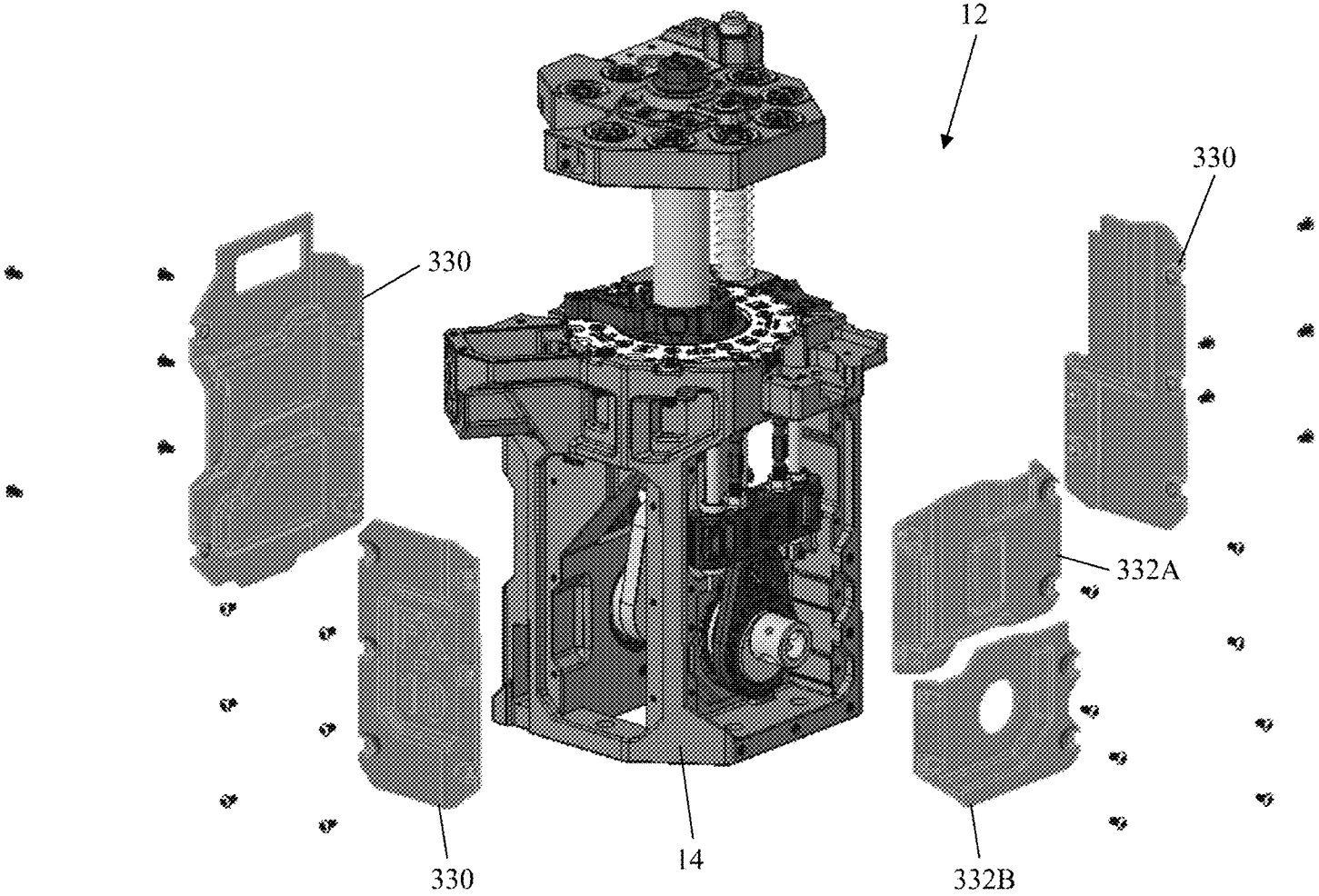
FIG. 59 is an exploded perspective of the press system showing covers for installation on the frame.

Referring to FIG. 59, the press 12 includes a plurality of covers. The covers can be connected to sides of the frame 14 by fasteners to cover openings in the frame. In the illustrated embodiment, three one-piece covers 330 are installed on the front, left, and rear of the frame. A two-piece cover is installed on the right side of the frame. The top section 332A of the right hand cover can be removed to allow adjustment of the swaging and priming pins without removing the lower section 332B of the cover. The covers 330, 332A, 332B can comprise translucent or transparent material (e.g., plastic) to permit the operator to observe the function of the press components but be protected from them.

Figure 60:
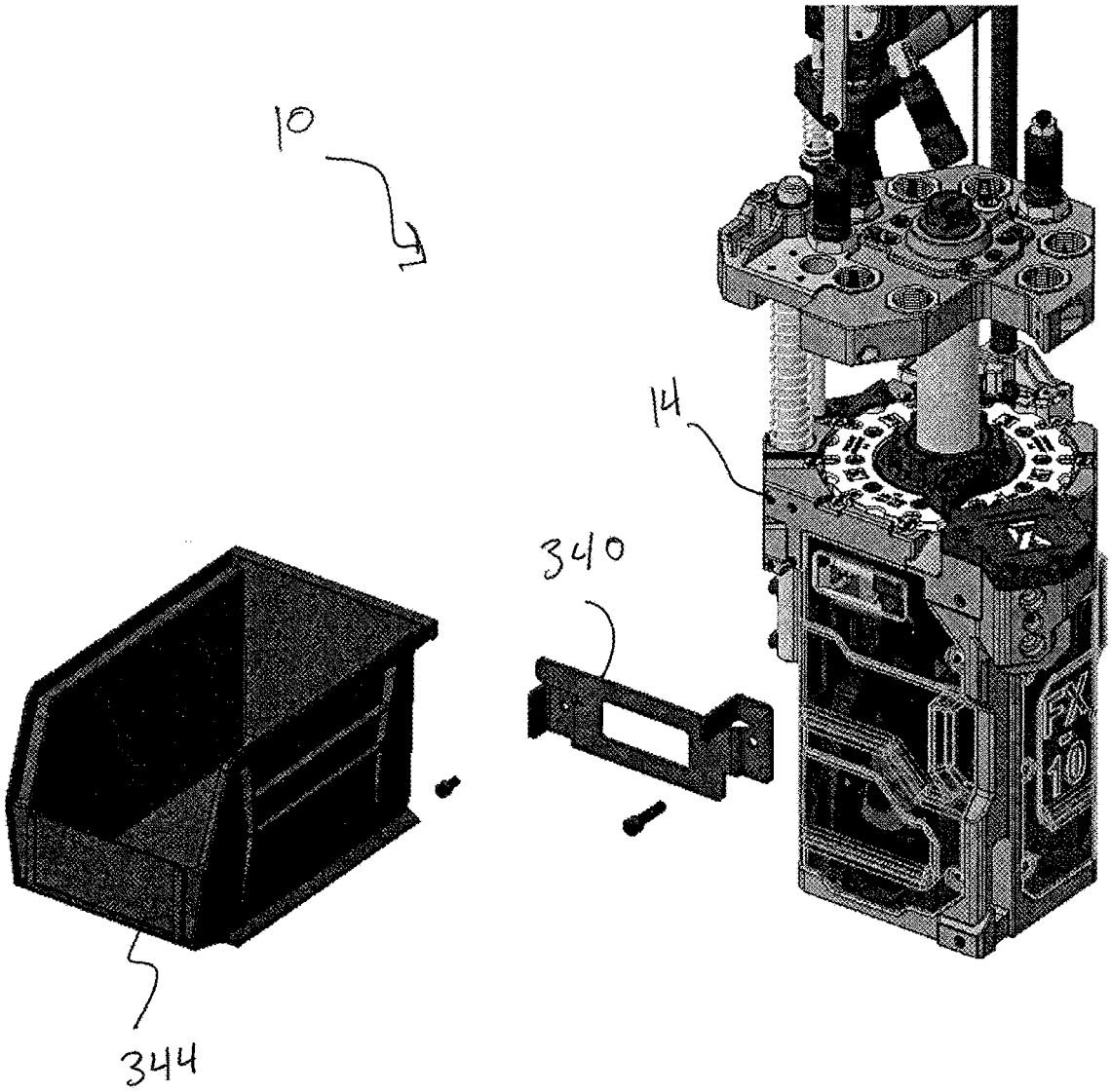
FIG. 60 is a fragmentary exploded perspective of the ammunition press system showing a bracket and associated bin for receiving assembled rounds of ammunition.
Figure 61:
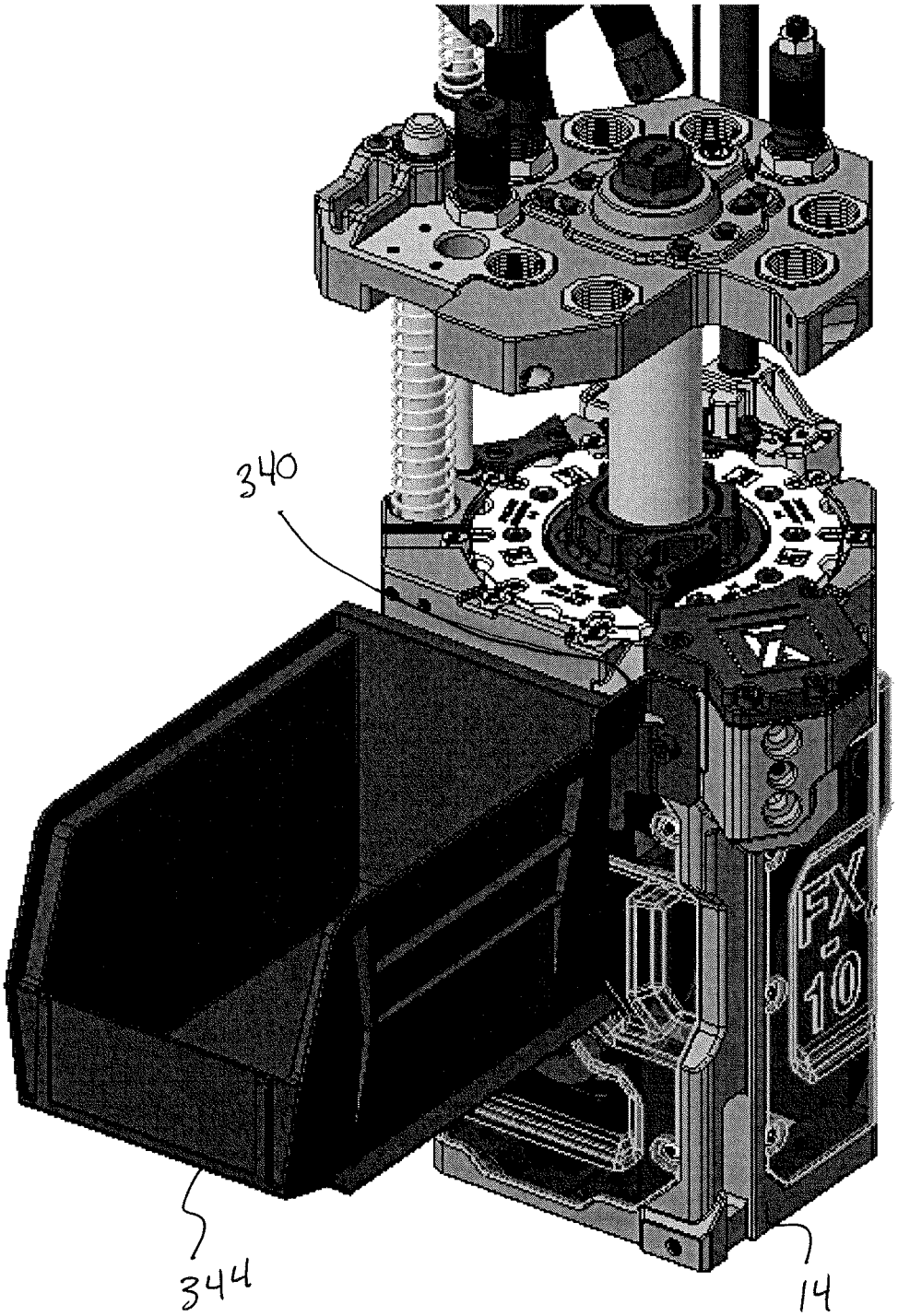
FIG. 61 is a fragmentary perspective showing the bracket connected to the frame and the bin on the bracket.

As shown in FIG. 60, the press system includes a bracket 340 connectable to the frame 14 by fasteners. The bracket 340 is configured to carry a bin 344 and to locate the bin to receive loaded cartridges ejected from the case carrier 58.

In one aspect of the press system 10, the drive system 22 is configured to receive back-and-forth drive input, or receive 360 degree rotation input, with no change in operation of the press 12. It will be appreciated that if the stop screws 56 (FIG. 6) are removed from the frame 14, the crank throws 50 become unobstructed and are permitted to rotate 360 degrees rather than 180 degrees. Accordingly, the user can rotate the lever 26 in 360 degrees instead of in a back-and-forth or down-and-up fashion. A full 360 degrees of rotation causes the drive system 22 to output movement to the press system components in the same manner as back-and-forth operation described above. As the lever 24 turns in the first 180 degrees of motion, the tool heads 18, 20 move toward the case carrier 58, and as the lever turns in the next 180 degrees of motion, the tool heads move away from the case carrier. Most likely, if the press 12 is to be used in a manual mode of operation, the 180 degrees range of motion will be desirable. But if the press is to be operated by a motor, the 360 degrees of motion is desirable.

Figure 62:
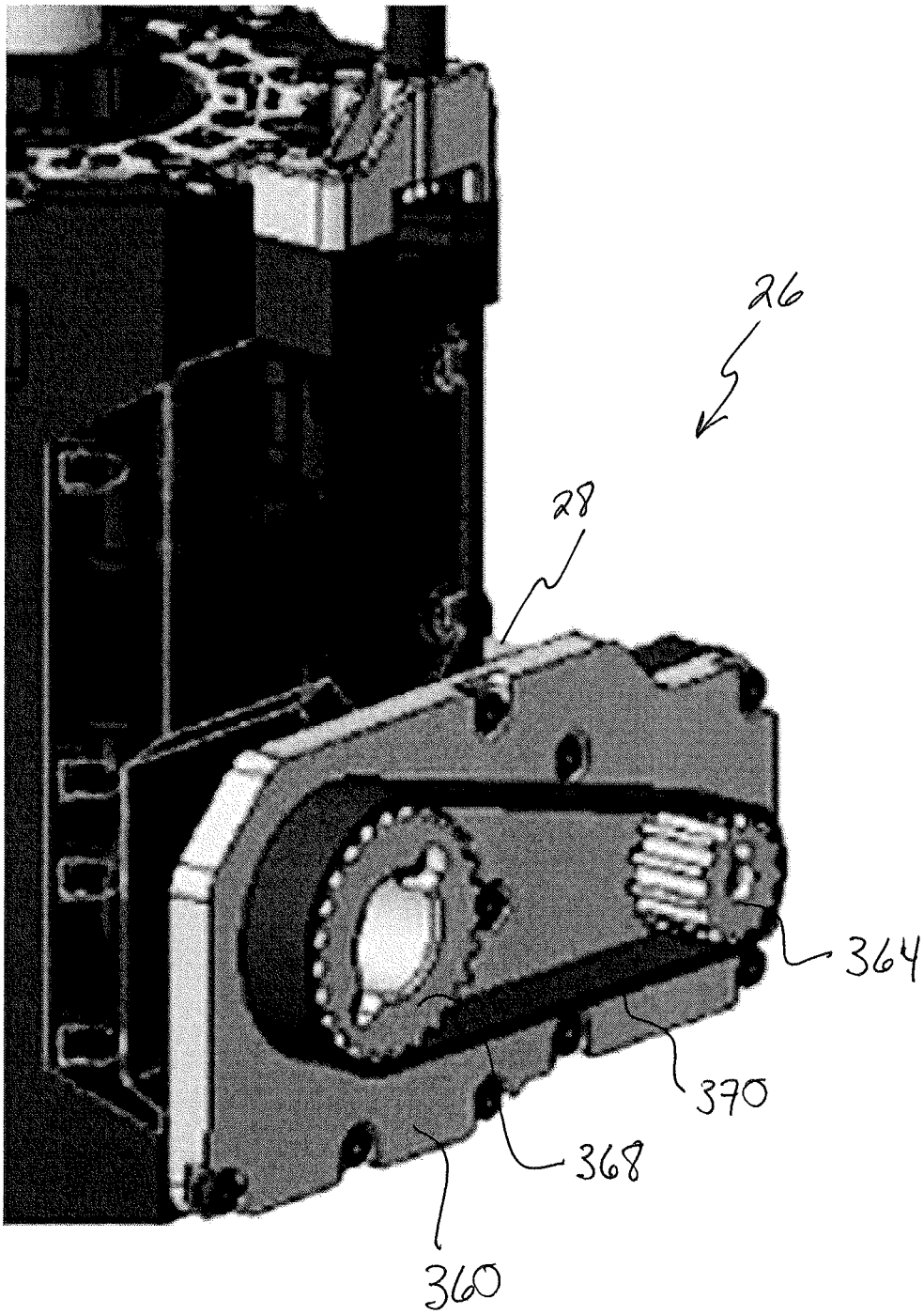
FIG. 62 is a fragmentary perspective of the ammunition press system including an automatic actuation mechanism.

An example of an automatic press actuation system 26 is shown in FIG. 62. The actuation system 26 includes a support 360 to which a motor 28 is connected. A first wheel 364 is mounted on an output shaft of the motor 362. The first wheel 364 is operatively connected to a second wheel 368 that is connected to the hub of the right journal shaft 42. Although the wheels 364, 368 are shown as geared pulleys connected via a belt 370, it will be appreciated the wheels could be smooth pulleys used with a belt, could be sprockets used with a chain, or could be gears in mesh with each other (without belt or chain). Other configurations could be used without departing from the scope of the present disclosure.

With an automatic press actuation system 26, the main drive input can be a continuous 360° motion. This offers the following advantages for automation. The control software can be simplified because the controller does not reverse the input motion at each end of the stroke and therefore does not need to know the exact position of the crank to determine when to reverse the input. The machine runs smoother, because it does not have to load and unload all of the play in the system at the end of each stroke. The ram is guaranteed to achieve both top dead center and bottom dead center on each stroke.

In one example, the press system 10 could be set up in the following manner (e.g., to load .223 caliber ammunition). The first station S1 could include a conventional case feeder. The second station S2 could include a universal decapping die on the upper tool head 18. The third station S3 could include a decapping and resizing die, or just a decapping die, on the upper tool head 18. The fourth station S4 could include a swaging tool 132 on the lower tool head 20 and the case support die 108 on the upper tool head 18. The fifth station S5 could include the gear driven primer feeder 32 discussed above on the upper tool head 18 and a priming pin 134 on the lower tool head 20. The sixth station S6 could include a trimmer on the upper tool head 18. The seventh station S7 could include the powder dispenser 34 on the upper tool head 18. The eighth station S8 could include a powder check or a blank die (e.g., depth stop die). The ninth station S9 could include the bullet feed and seat operation described above. The tenth station S10 could include a crimp die or secondary seating die (redundant).

Embodiments of the aspects of the invention may be described in the general context of data and/or processor-executable instructions, such as program modules, stored one or more tangible, non-transitory storage media and executed by one or more processors or other devices. Generally, program modules include, but are not limited to, routines, programs, objects, components, and data structures that perform particular tasks or implement particular abstract data types. Aspects of the invention may also be practiced in distributed computing environments where tasks are performed by remote processing devices that are linked through a communications network. In a distributed computing environment, program modules may be located in both local and remote storage media including memory storage devices.

In operation, processors, computers and/or servers may execute the processor-executable instructions (e.g., software, firmware, and/or hardware) such as those illustrated herein to implement aspects of the invention.

Embodiments of the aspects of the invention may be implemented with processor-executable instructions. The processor-executable instructions may be organized into one or more processor-executable components or modules on a tangible processor readable storage medium. Aspects of the invention may be implemented with any number and organization of such components or modules. For example, aspects of the invention are not limited to the specific processor-executable instructions or the specific components or modules described herein. Other embodiments of the aspects of the invention may include different processor-executable instructions or components having more or less functionality than illustrated and described herein.

The order of execution or performance of the operations in embodiments of the aspects of the invention illustrated and described herein is not essential, unless otherwise specified. That is, the operations may be performed in any order, unless otherwise specified, and embodiments of the aspects of the invention may include additional or fewer operations than those disclosed herein. For example, it is contemplated that executing or performing a particular operation before, contemporaneously with, or after another operation is within the scope of aspects of the invention.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that several advantages of the aspects of the invention are achieved and other advantageous results attained.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively or in addition, a component may be implemented by several components.

The above description illustrates the aspects of the invention by way of example and not by way of limitation. This description enables one skilled in the art to make and use the aspects of the invention, and describes several embodiments, adaptations, variations, alternatives and uses of the aspects of the invention, including what is presently believed to be the best mode of carrying out the aspects of the invention. Additionally, it is to be understood that the aspects of the invention are not limited in its application to the details of construction and the arrangement of components set forth in the description or illustrated in the drawings. The aspects of the invention are capable of other embodiments and of being practiced or carried out in various ways. Also, it will be understood that the phraseology and terminology used herein is for the purpose of description and should not be regarded as limiting.

It will be apparent that modifications and variations are possible without departing from the scope of aspects of the invention as defined in the appended claims. It is contemplated that various changes could be made in the above constructions, products, and methods without departing from the scope of aspects of the invention. In the preceding specification, various embodiments have been described with reference to the accompanying drawings. It will, however, be evident that various modifications and changes may be made thereto, and additional embodiments may be implemented, without departing from the broader scope of the aspects of the invention as set forth in the claims that follow. The specification and drawings are accordingly to be regarded in an illustrative rather than restrictive sense.

What is claimed is:

1. A progressive ammunition press system comprising:

a frame configured to be supported by a support surface;

a case carrier supported by the frame, the case carrier including multiple case holders each configured to hold an ammunition case, the case carrier being moveable with respect to the frame to move the case holders to a plurality of stations;

a tool head supported by the frame, the tool head comprising a plurality of press accessory mounts, the tool head being moveable with respect to the case carrier;

a drive system operatively connected to the tool head to move the tool head with respect to the case carrier;

a communications output port supported by and moveable with the tool head; and a communications input port supported by and moveable with the tool head and operatively coupled to the communications output port to transmit communication signals to the communications output port.

2. The progressive ammunition press system of claim 1, wherein the tool head includes an opening corresponding to the communications input port and the communications input port is accessible via the opening.

3. The progressive ammunition press system of claim 1, wherein the opening is located in an upper surface of the tool head.

4. The progressive ammunition press system of claim 1, further comprising a printed circuit board structure, the communications output port and communications input port being connected to the printed circuit board structure, the printed circuit board structure including circuitry operatively coupling the communications input port to the communications output port.

5. The progressive ammunition press system of claim 4, further comprising at least one LED connected to the printed circuit board structure and configured to receive electrical power from the communications output port, the at least one LED configured to emit light downward to illuminate an area below the tool head.

6. The progressive ammunition press system of claim 4, wherein the printed circuit board structure is connected to a bottom of the tool head.

7. The progressive ammunition press system of claim 4, wherein the printed circuit board structure comprises a single printed circuit board.

8. The progressive ammunition press system of claim 1, further comprising a press controller and a tangible storage medium each supported by the tool head, the tangible storage medium storing press controller executable instructions to generate a command signal to control an operation of the press system based on a sensor signal received from the communications input port.

9. The progressive ammunition press system of claim 8, wherein the press system includes an audible alarm, and the operation of the press system comprises energizing the audible alarm.

10. The progressive ammunition press system of claim 8, wherein the press system includes at least one illuminator, and the operation of the press system comprises changing a state of the illuminator.

11. The progressive ammunition press system of claim 10, wherein the illuminator is oriented to illuminate the case carrier.

12. The progressive ammunition press system of claim 1, wherein the communications signal input port includes an electrical power terminal.

13. The progressive ammunition press system of claim 1, wherein the communications input port comprises a 3.5 mm socket.

14. The progressive ammunition press system of claim 1, wherein the communications output port comprises a USB type connector.

15. The progressive ammunition press system of claim 1, wherein the communications input port is a first communications input port, and the progressive ammunition press system further comprises a second communications input port supported by and moveable with the tool head and operatively coupled to the communications output port to transmit communication signals to the communications output port.

16. The progressive ammunition press system of claim 1, wherein the communications input port is a first communications input port, and the progressive ammunition press system further comprises a second, third, and fourth communications input ports supported by and moveable with the tool head and operatively coupled to the communications output port to transmit communication signals to the communications output port.

* * * * *